US006347805B1

(12) United States Patent
Maravetz et al.

(10) Patent No.: US 6,347,805 B1
(45) Date of Patent: Feb. 19, 2002

(54) INTERFACE FOR ENGAGING A SNOWBOARD BOOT TO A BINDING

(75) Inventors: Paul T. Maravetz; Jake Burton Carpenter, both of Stowe; David J. Dodge, Williston; Thomas M. McGann, Jericho, all of VT (US); Steven C. McDonald, Timberlakes; David Narajowski, Heber City, both of UT (US); Frank Phillips, Richmond, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/062,131

(22) Filed: Apr. 17, 1998

Related U.S. Application Data

(63) Continuation-in-part of application No. 08/887,530, filed on Jul. 3, 1997.

(60) Provisional application No. 60/051,703, filed on Jul. 3, 1997, provisional application No. 60/044,715, filed on Apr. 18, 1997, and provisional application No. 60/044,716, filed on Apr. 18, 1997.

(51) Int. Cl.[7] ..... A63C 9/20

(52) U.S. Cl. ..... 280/624; 280/14.22

(58) Field of Search ..... 280/7.12, 7.13, 280/11.33, 14.22, 617, 618, 624, 625, 626, 627, 631, 632; 36/115, 117.3, 117.4, 131, 132, 134

(56) References Cited

U.S. PATENT DOCUMENTS

| | | | | |
|---|---|---|---|---|
| 3,398,969 A | | 8/1968 | Perry | |
| 3,526,976 A | * | 9/1970 | Jacobs | 280/7.13 |
| 3,538,627 A | | 11/1970 | Labat-Camy | |

(List continued on next page.)

FOREIGN PATENT DOCUMENTS

| | | | | |
|---|---|---|---|---|
| AT | 163522 | * 12/1948 | | 280/617 |
| DE | 92 16 831 U | 5/1993 | | A63C/9/16 |
| DE | 43 33 503 C2 | 4/1995 | | A43B/5/04 |
| DE | 196 02 667 | 1/1997 | | |
| EP | 0 719 505 A3 | 7/1995 | | A43B/5/04 |
| EP | 0 668 090 A1 | 8/1995 | | A63C/9/08 |
| EP | 0 740 908 A1 | 11/1996 | | A43B/5/04 |
| EP | 0 743 023 A1 | 11/1996 | | A43B/5/04 |

(List continued on next page.)

OTHER PUBLICATIONS

English translation of JP 9–248360.
English translation of EP 0 753 269.
PCT International Search Report.
English translation of DE 196 02 667.

*Primary Examiner*—Frank Vanaman
(74) *Attorney, Agent, or Firm*—Wolf, Greenfield & Sacks, P.C.

(57) ABSTRACT

One embodiment is directed to a system for mounting a rider to a snowboard, and an interface for use in such a system. The system comprises a snowboard boot, a snowboard binding and an interface having at least one mating feature adapted to be releasably engaged by the snowboard binding. The interface further includes at least one strap adapted to mount the interface to the snowboard boot. The outer sole of the snowboard boot includes a recess rearward of the arch area that is adapted to receive the interface so that the interface does not protrude below the outer sole when the interface is mounted to the snowboard boot. In another embodiment, the interface includes a base that is adapted to pass under the sole of the snowboard boot, the base having a non-planar contoured upper surface that is adapted to fit within a recess in a sole of the snowboard boot. In another embodiment, the mating feature of the interface includes at least one engagement pin that extends outwardly from medial and lateral sides of the interface and is circular in cross-section. The various features of the system can be combined or used separately.

67 Claims, 24 Drawing Sheets

U.S. PATENT DOCUMENTS

| | | | | | |
|---|---|---|---|---|---|
| 3,636,642 | A | | 1/1972 | Walther | |
| 3,775,866 | A | | 12/1973 | Marker | |
| 3,964,758 | A | | 6/1976 | Kent | 280/613 |
| 4,403,789 | A | | 9/1983 | Hickey | 280/614 |
| 4,570,363 | A | * | 2/1986 | Annovi | 36/117.4 |
| 4,945,658 | A | | 8/1990 | Provence | |
| 4,973,073 | A | | 11/1990 | Raines et al. | 280/624 |
| 5,035,443 | A | | 7/1991 | Kincheloe | 280/618 |
| 5,142,798 | A | | 9/1992 | Kaufman et al. | |
| 5,145,202 | A | | 9/1992 | Miller | 280/613 |
| 5,156,644 | A | | 10/1992 | Koehler et al. | 280/14.2 |
| 5,299,823 | A | | 4/1994 | Glaser | 280/625 |
| 5,354,088 | A | | 10/1994 | Vetter et al. | 280/618 |
| 5,356,170 | A | | 10/1994 | Carpenter et al. | 280/618 |
| 5,410,821 | A | * | 5/1995 | Hilgendorf | 36/132 |
| 5,505,478 | A | | 4/1996 | Napoliello | 280/618 |
| 5,520,406 | A | | 5/1996 | Anderson et al. | 280/624 |
| 5,544,909 | A | | 8/1996 | Laughlin et al. | 280/617 |
| 5,558,355 | A | * | 9/1996 | Henry | 280/824 |
| 5,577,757 | A | | 11/1996 | Riepl et al. | 280/624 |
| 5,595,396 | A | | 1/1997 | Bourdeau | 280/607 |
| 5,660,410 | A | | 8/1997 | Alden | 280/627 |
| 5,664,344 | A | | 9/1997 | Marmonier | 36/117.3 |
| 5,669,630 | A | | 9/1997 | Perkins et al. | 280/613 |
| 5,690,350 | A | | 11/1997 | Turner et al. | 280/613 |
| 5,695,210 | A | | 12/1997 | Goss et al. | 280/624 |
| 5,697,631 | A | | 12/1997 | Ratzek et al. | 280/613 |
| 5,704,139 | A | | 1/1998 | Okajima | 36/115 |
| 5,713,587 | A | * | 2/1998 | Morrow et al. | 280/14.2 |
| 5,799,957 | A | * | 9/1998 | Okajima et al. | 280/14.2 |
| 5,815,953 | A | | 10/1998 | Kaufman et al. | 36/118.3 |
| 5,887,886 | A | * | 3/1999 | Bourdeau | 280/634 |
| 5,941,553 | A | | 8/1999 | Korman | 280/613 |
| 6,010,138 | A | * | 1/2000 | Bobrowicz et al. | 280/14.2 |

FOREIGN PATENT DOCUMENTS

| | | | | |
|---|---|---|---|---|
| EP | 0 753 269 | | 1/1997 | |
| EP | 0 774 217 A2 | | 5/1997 | A43B/5/04 |
| EP | 0 793 920 A1 | | 9/1997 | A43B/5/04 |
| FR | 2 592 807 A1 | | 7/1987 | A63C/15/06 |
| FR | 2 604 913 A1 | | 4/1988 | A63C/5/00 |
| FR | 2 627 993 A1 | | 9/1989 | A63C/5/00 |
| FR | 2 732 230 | | 10/1996 | |
| FR | 2 752 685 | | 3/1998 | |
| IT | 322456 | | 11/1934 | |
| JP | 9-248360 | | 9/1997 | |
| WO | 80/00063 | * | 1/1980 | 280/617 |
| WO | WO 96/36407 | | 11/1996 | A63C/9/08 |
| WO | WO 97/03734 | | 2/1997 | A63C/9/20 |
| WO | WO 97/22390 | | 6/1997 | A63C/9/00 |
| WO | WO 97/27773 | | 8/1997 | A43B/5/04 |
| WO | WO 97/35494 | | 10/1997 | A43B/5/04 |
| WO | WO 98/06465 | | 2/1998 | A63C/9/08 |
| WO | WO 98/07479 | | 2/1998 | A63C/9/086 |

* cited by examiner

INTERFACE FOR ENGAGING A SNOWBOARD BOOT TO A BINDING

CROSS REFERENCE TO RELATED APPLICATIONS

This application claims the benefit of U.S. Provisional Applications Nos. 60/044,715 and 60/044,716, filed Apr. 18, 1997, and U.S. Provisional Application No. 60/051,703, filed Jul. 3, 1997, and is a continuation-in-part of U.S. application Ser. No. 08/887,530, filed Jul. 3, 1997, pending.

FIELD OF THE INVENTION

The present invention is directed generally to the field of boots and bindings for gliding ports, and more particularly, to the field of snowboard boots and bindings.

DESCRIPTION OF THE RELATED ART

Specially configured boards for gliding along a terrain are known, such as snowboards, snow skis, water skis, wake boards, surf boards and the like. For purposes of this patent, "gliding board" will refer generally to any of the foregoing boards as well as to other board-type devices which allow a rider to traverse a surface. For ease of understanding, however, and without limiting the scope of the invention, the inventive boot, binding and interface systems for a gliding board to which this patent is addressed is discussed below particularly in connection with a snowboard. However, it should be appreciated that the present invention is not limited in this respect, and that the aspects of the present invention described below can be used in association with other types of gliding boards.

Conventional snowboard binding systems used with soft snowboard boots are one of two general types. A first type, known as a tray binding, typically includes a rigid high-back piece against which the heel of the boot is placed, and one or more straps that secure the boot to the binding. Such bindings can be somewhat inconvenient to use because after each run, the rider must unbuckle each strap of the rear binding to release the boot when getting on the chairlift, and must re-buckle each strap before the next run. To address those convenience concerns, a second type of binding known as a step-in binding has been developed that typically does not employ straps, but rather includes one or more strapless engagement members into which the rider can step to lock the boot into the binding. Some of these systems include a handle or lever that must be actuated to move one of the engagement members into and out of engagement with the snowboard boot, and therefore, are not automatically actuated by the rider stepping into the binding. Furthermore, most step-in systems include a metal engagement member on the binding and a corresponding metal engagement member on the boot, such that when the boot is engaged with the binding, it is held rigidly into the binding by the metal-to-metal engagement interface.

Many riders are unhappy with conventional step-in bindings for two reasons. First, most step-in bindings do not have the feel of a conventional tray binding when riding. In particular, the straps in conventional tray bindings allow the rider's foot to roll laterally when riding, which is a characteristic desired by many riders. In contrast, the rigid metal-to-metal interface employed in most step-in systems between the boot and binding does not allow for any foot roll, which results in a ride having a feel that many riders find to be unacceptable. A second problem with most step-in systems is that the boot includes a rigid sole, making the boot very uncomfortable to walk in. In addition, many step-in systems include a relatively large metal plate attached to the sole of the boot for interfacing with the binding, which further reduces the comfort of the boot when walking.

In view of the foregoing, it is an object of the present invention to provide an improved system for engaging a snowboard boot to a snowboard.

SUMMARY OF THE INVENTION

One embodiment of the invention is directed to a system for mounting a rider to a snowboard. The system comprises a snowboard boot to receive a foot of the rider, the snowboard boot including an outer sole having a heel area, an arch area and a toe area; a snowboard binding to be mounted to the snowboard; and an interface having at least one mating feature adapted to be releasably engaged by the snowboard binding, the interface further including at least one strap adapted to mount the interface to the snowboard boot. The outer sole of the snowboard boot includes a recess rearward of the arch area that is adapted to receive the interface so that the interface does not protrude below the outer sole when the interface is mounted to the snowboard boot.

Another embodiment of the invention is directed to an interface for use in a system for mounting a rider to a snowboard, the system comprising a snowboard binding to be mounted to the snowboard, a snowboard boot, and the interface. The interface comprises a body having at least one mating feature adapted to be releasably engaged by the snowboard binding, the body further including a base that is adapted to pass under the sole of the snowboard boot, the base having a non-planar contoured upper surface that is adapted to fit within a recess in a sole of the snowboard boot; and at least one strap, supported by the body, adapted to mount the interface to the snowboard boot.

A further embodiment of the invention is directed to a system for mounting a rider to a snowboard. The system comprises a snowboard boot to receive a foot of the rider; a snowboard binding to be mounted to the snowboard; and an interface having at least one strap adapted to mount the interface to the snowboard boot, the interface further including at least one mating feature adapted to be releasably engaged by the snowboard binding, the at least one mating feature including at least one engagement pin that extends outwardly from medial and lateral sides of the interface and is circular in cross-section.

A further embodiment of the invention is directed to an interface for engaging a snowboard boot to a snowboard binding. The interface comprises a body having at least one mating feature adapted to be releasably engaged by the snowboard binding, the at least one mating feature including at least one engagement pin that extends outwardly from medial and lateral sides of the interface and is circular in cross-section; and at least one strap, supported by the body, adapted to mount the interface to the snowboard boot.

Another embodiment of the invention is directed to a system for mounting a rider to a snowboard. The system comprises a snowboard boot to receive a foot of the rider, the snowboard boot including a sole having a recess; a snowboard binding to be mounted to the snowboard; and an interface. The interface has a body including a base that is adapted to pass under the sole of the snowboard boot, the base having a non-planar contoured upper surface that is adapted to fit within the recess in the sole of the snowboard boot; at least one mating feature that is supported by the body and is adapted to be releasably engaged by the snowboard binding; and at least one strap that is supported by the body and is adapted to mount the interface to the snowboard boot.

A further embodiment of the invention is directed to a snowboard binding to mount a snowboard boot to a snowboard, the snowboard binding comprising a base having a toe end and a heel end; and a guide, supported by the base, that is adapted to guide the snowboard boot back toward the heel end of the base when the snowboard boot is stepped into the binding.

Another embodiment of the invention is directed to a snowboard binding comprising a baseplate; a heel hoop mounted to the baseplate, the heel hoop being hinged for rotation relative to the baseplate about a first axis; and a high-back supported by the heel hoop.

A further embodiment of the invention is directed a snowboard binding to mount a snowboard boot to a snowboard, the snowboard boot including at least one pin extending from medial and lateral sides thereof. The snowboard binding comprises a base having medial and lateral sides; a pair of engagement cams each mounted to one of the medial and lateral sides of the base for rotation between a closed position to engage the at least one pin and an open position to release the at least one pin; at least one lever that is adapted to move the pair of engagement cams from the closed position to the open position; and a cocking mechanism that is adapted to maintain the pair of engagement cams in the open position upon release of the at least one lever.

A further embodiment of the present invention is directed to a system for mounting a rider to a snowboard. The system comprises a snowboard boot having a sole including a heel area, an arch area and a toe area; a snowboard binding; a first engagement member; and a second engagement member; wherein one of the first and second engagement members is mounted to the sole of the snowboard boot forward of the arch area and the other of the first and second engagement members is mounted to the binding; wherein the first engagement is adapted to mate with the second engagement member to releasably engage the snowboard boot to the binding; and wherein the first engagement member is an active engagement member that is movable between a first state wherein the first engagement member does not engage the second engagement member and a second state wherein the first engagement member engages the second engagement member to inhibit lifting of the toe area of the boot from the binding during riding, and wherein the active engagement member is automatically movable, in response to the rider stepping out of the binding, from the second state to the first state.

Another embodiment of the invention is directed to a snowboard boot adapted for use with a binding to mount the snowboard boot to a snowboard, the binding including a pair of spaced apart engagement members. The snowboard boot comprises a sole; and a cleat having a base that is supported by the sole, the cleat being adapted to be releasably engaged by the pair of spaced apart engagement members, the cleat including medial and lateral sides, wherein at least one of the medial and lateral sides tapers inwardly from a wider base-end portion of the cleat adjacent the base to a narrower free-end portion of the cleat away from the base, the at least one of the medial and lateral sides being adapted to separate the pair of spaced apart engagement members when the snowboard boot steps into the binding.

Another embodiment of the invention is directed to a snowboard boot adapted for use with a binding to mount the snowboard boot to a snowboard, the binding including a first engagement member. The snowboard boot comprises a sole; and a second engagement member supported by the sole, the second engagement member including engagement means for releasably engaging the first engagement member, the engagement means including means for automatically disengaging from the first engagement member in response to the snowboard boot stepping out of engagement with the binding.

A further embodiment of the invention is directed to a snowboard binding to mount a snowboard boot to a snowboard, the snowboard boot including a first engagement member. The snowboard binding comprises a base; and a second engagement member, mounted to the base, that is adapted to mate with the first engagement member to releasably engage the snowboard boot to the binding, the second engagement member being an active engagement member that is movable between a first state wherein the second engagement member does not engage the first engagement member and a second state wherein the second engagement member engages the first engagement member to inhibit lifting of the boot from the binding during riding, and wherein the active engagement member is automatically movable, in response to the rider stepping out of the binding, from the second state to the first state.

Another embodiment of the invention is directed to a method of interfacing a first engagement member on a snowboard boot with a second engagement member on a snowboard binding that is engageable with the first engagement member to mount the snowboard boot to a snowboard, wherein at least one of the first and second engagement members is an active engagement member that is moveable between an open position and a closed position. The method comprises a step of stepping the snowboard boot out of the snowboard binding so that the active engagement member automatically moves from the closed position to the open position without operating a lever on the snowboard boot or the snowboard binding, so that the first engagement member is disengaged from the second engagement member.

A further embodiment of the invention is directed to a snowboard boot for use in a system for mounting a rider to a snowboard, the system comprising a snowboard binding to be mounted to the snowboard and an interface having at least one mating feature adapted to be releasably engaged by the snowboard binding, the interface including at least one strap adapted to releasably mount the interface to the snowboard boot. The snowboard boot comprises a boot upper; and a sole including a heel area, an arch area and a toe area, the sole further including a recess, disposed rearwardly of the arch area, that is adapted to receive the interface so that the interface does not protrude below the sole when the interface is mounted to the snowboard boot.

A further embodiment of the invention is directed to a snowboard boot for use in a system for mounting a rider to a snowboard, the system comprising a snowboard binding to be mounted to the snowboard and an interface including at least one mating feature adapted to be releasably engaged by the snowboard binding, the interface further including a base that is adapted to pass under the sole of the snowboard boot, the base having a non-planar contoured upper surface, the interface further including at least one strap that is adapted to releasably mount the interface to the snowboard boot. The snowboard boot comprises a boot upper; and a sole including a recess periphery that defines a recess adapted to receive the interface, the recess periphery including at least one bottom-facing non-planar contoured surface that is adapted to mate with the non-planar contoured upper surface of the interface.

DETAILED DESCRIPTION OF THE INVENTION

One aspect of the present invention is directed to an improved step-in binding. Another aspect of the invention is directed to an interface system for interfacing a snowboard boot to a binding. Although these two aspects of the present invention are advantageously employed together in accordance with several illustrative embodiments of the invention, the present invention is not limited in this respect, as each of these aspects of the present invention can also be employed separately. For example, the binding aspect of the present invention can be employed to directly engage a snowboard boot, rather than engaging a snowboard boot through the use of a separate interface. Similarly, the interface aspects of the present invention can be employed with numerous types of bindings, and are not limited to use with the illustrative embodiments disclosed herein.

Figure 1:
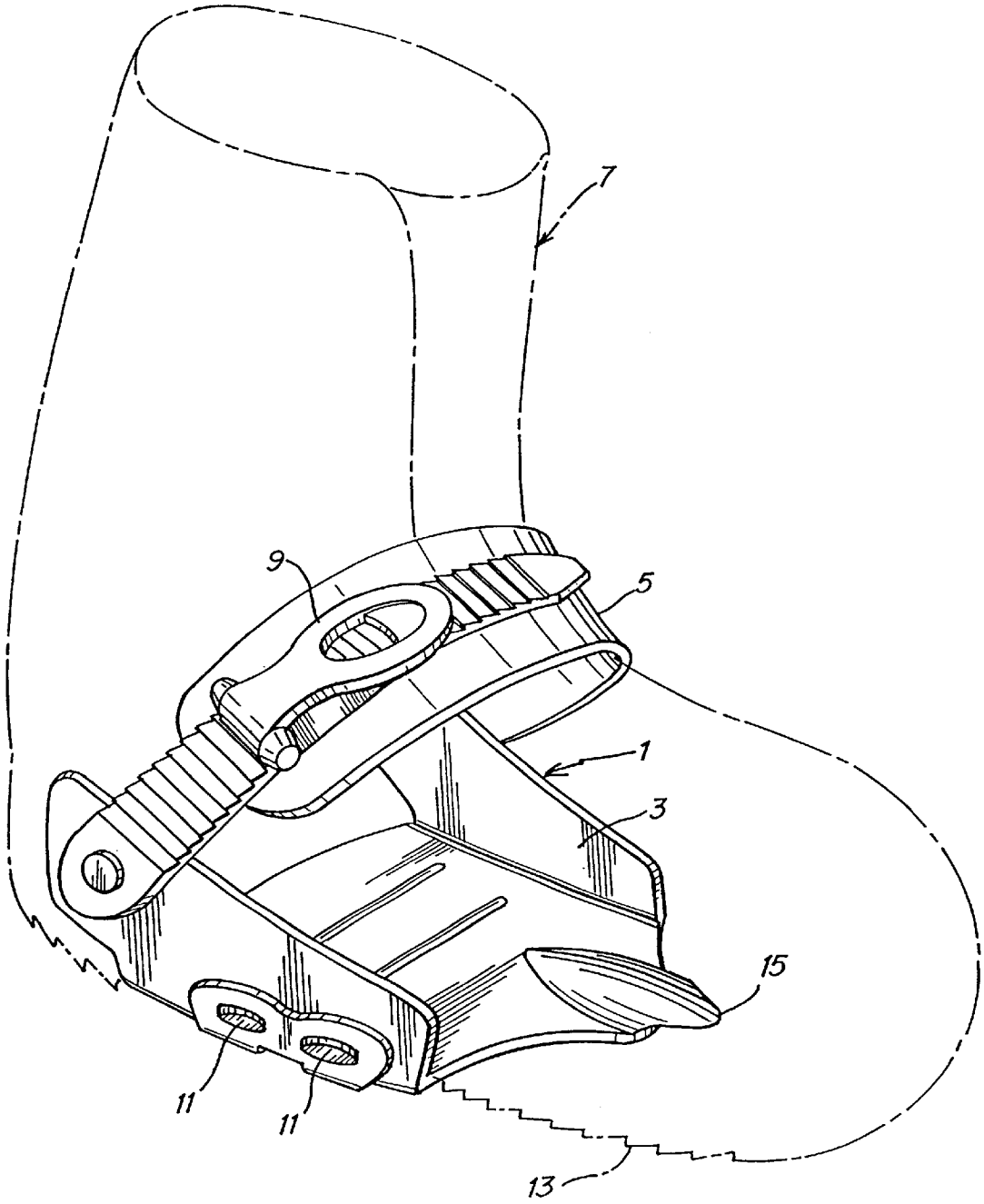
FIG. 1 is a perspective view of one illustrative embodiment of an interface for engaging a snowboard boot to a binding.
Figure 2:
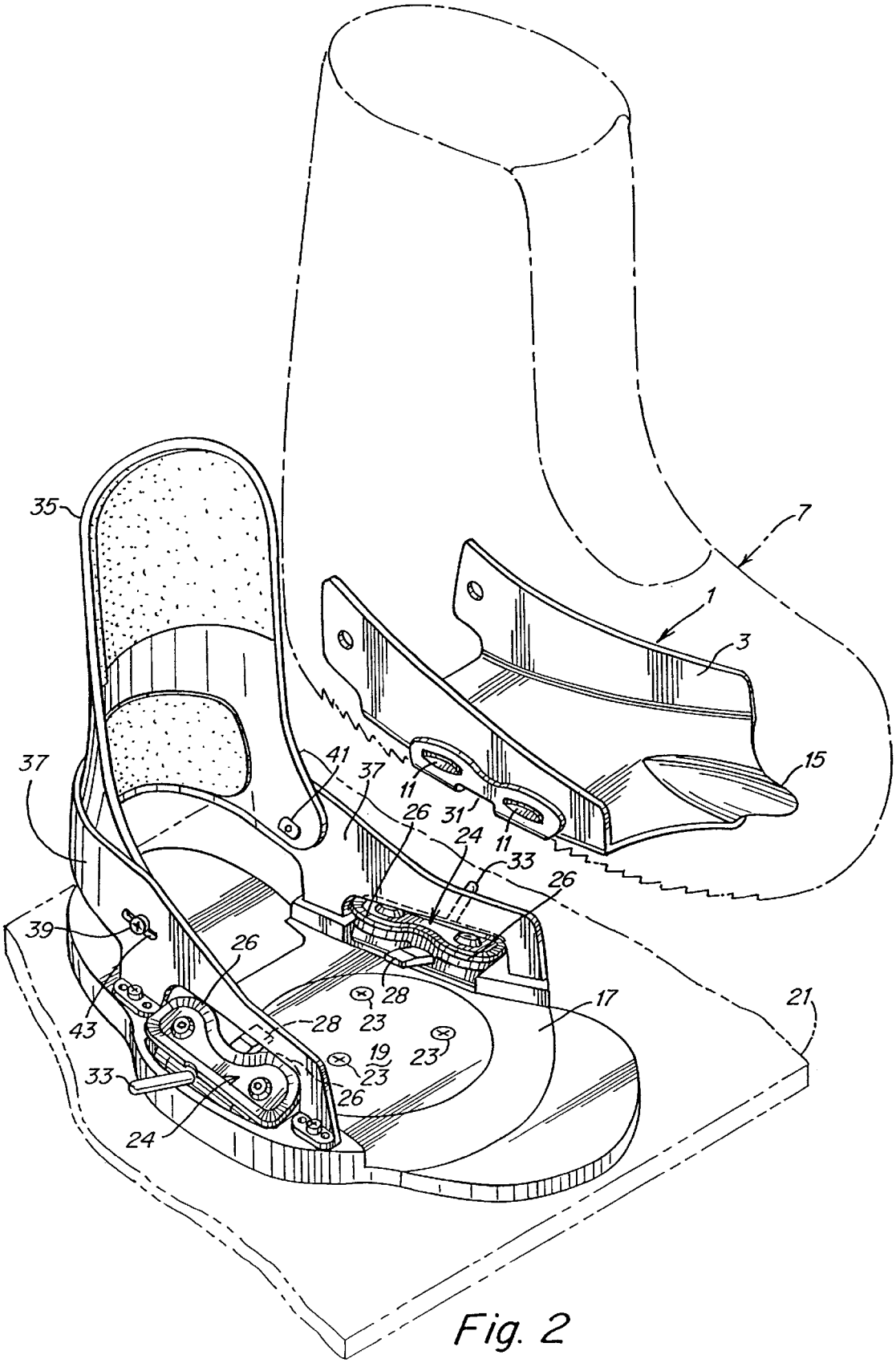
FIG. 2 is an exploded perspective view of the interface of FIG. 1 and a binding compatible therewith.

One illustrative embodiment of an interface 1 in accordance with the present invention is illustrated in FIGS. 1–2. The interface 1 includes a body 3 and at least one strap 5 that is arranged to be disposed about the ankle area of the snowboard boot 7, which is shown schematically in FIGS. 1–2. In the embodiment shown in FIGS. 1–2, the strap 5 includes a ratchet-type buckle 9 to enable adjustment of the strap. However, it should be appreciated that the present invention is not limited to the use of any particular type of strap, as numerous other strap arrangements can be employed. As will be appreciated from the description below, the strap performs the function of attaching the interface 1 to the snowboard boot 7 in a manner that enables the sole of the snowboard boot 7 to roll relative to the interface during riding. Thus, as used herein, the term strap is intended to indicate any structure that passes over the boot upper and performs this attachment function, including web-like structures, bails, etc.

The body 3 of the interface will typically include one or more mating features adapted to engage with a corresponding strapless engagement member on a step-in binding. As stated above, the interface aspect of the present invention is not limited to use with any particular binding, and therefore, is not limited to the use of any particular engagement features for engaging with a binding. In the illustrative embodiment shown in FIGS. 1–2, the interface 3 is provided with a pair of recesses 11 formed on each lateral side of the binding in accordance with the teachings of U.S. patent application Ser. No. 08/584,053, which is incorporated herein by reference. It should be appreciated that alternate arrangements are possible to accomplish engagement between the interface 3 and the binding, such as with a single recess provided on one side of the interface with a pair on the other, or with a single recess provided on each side of the binding. In accordance with one embodiment of the invention, the interface body 3 is formed of molded plastic, such that engagement between the interface and the binding does not involve metal-to-metal contact, resulting in a more forgiving engagement between the interface and the binding. However, as is discussed in more detail below, the flexibility of the engagement between the interface body 3 and the binding is less significant that in a conventional step-in binding system, because the interface body 3 is not rigidly attached to the boot 7. Rather, the boot is locked into engagement with the interface primarily via the ankle strap 5. The attachment is through the ankle strap 5 allows the rider's foot (e.g., the sole of the boot 7) to roll when riding, providing a feel similar to conventional tray bindings that many riders find to be desirable.

When the rider desires to disengage the back boot from the binding when advancing along the slope or in the lift line, the rider can simply pop the interface 1 out of engagement with the binding. When used in conjunction with a step-in binding, this disengagement is extremely convenient. When it is desired to re-engage the back boot, the rider can simply step into the step-in binding, which thereafter engages the interface 1, thereby securing the rider's boot 7 to the snowboard. In this manner, the interface aspect of the present invention provides the rider with the convenience of a step-in system, while simultaneously providing the riding characteristics of a conventional tray binding. In addition, if the rider desires to disengage from the bindings for a more prolonged period of time, for example to have lunch, the rider can simply undo the ankle straps 5 to release the boots while leaving the interfaces I engaged with the binding. In this respect, the rider can walk around unencumbered by the interface. In addition, because the boot 7 itself does not include any rigid metal members for direct engagement with the binding, the sole of the boot 7 can be flexible, providing the comfort of a conventional soft boot.

It should be appreciated that it is significantly more convenient for the rider to pop the back boot out of the binding with the interface 1 attached thereto than with some known systems wherein the entire binding can be popped off of the board. For example, U.S. Pat. No. 5,354,088 discloses a rear binding that can be popped of the board to allow the rider to advance the board along the snow to negotiate a lift line. However, using that system, the rider has the entire binding attached to the back boot which is much less convenient than the interface 1. For example, the binding in the known system has a high-back attached thereto, resulting in the boot having a structure attached thereto that is not nearly as low profile as the interface 1 according to one illustrative embodiment of the invention. In addition, in the known system, the structure attached to the rider's boot includes complete toe and heel attachment mechanisms for binding the rider's foot to the board. In contrast, the interface 1 of the present invention does not extend forward of the ball area of the foot, again resulting in a more low profile structure attached to the rider's boot.

The present invention contemplates a number of alternative ways in which the interface can engage with the sole 13 of the boot. In one embodiment of the invention not shown, the body 3 of the interface has a flat surface adapted to engage with the sole 13 of the boot, so that the interface 1 can be used with any snowboard boot. This feature of the present invention is advantageous in that through the use of such a universal interface 1, any boot 7 can be made compatible with a step-in binding, simply by employing an interface 1 that is compatible with the, step-in binding. In this manner, a rider can use a boot alone with a tray binding, or the same boot can be used with any of a plurality of different step-in bindings by simply employing an interface compatible with the desired step-in binding.

In the embodiment of the invention shown in FIGS. 1–2, the body 3 of the interface includes a toe hook 15 that is adapted to engage with a recess (not shown) in the sole 13 of the boot. The recess can be implemented in any of a number of ways. For example, one possible implementation is shown in U.S. patent application Ser. No. 08/887,530, which is incorporated herein by reference, and is directed to an opening in the sole that is defined by a hollowed out cavity including a rear-facing mouth that is adapted to receive the toe hook 15. A support member or shank can be provided to prevent the sole from sinking in the area above the cavity, and to reinforce the lower wall of the cavity that engages with the bottom surface of the toe hook 15. It should be appreciated that the present invention is not limited to any particular toe hook arrangement, as numerous other implementations are possible to inhibit lifting of the toe portion of the boot 7 from the interface 1, and consequently from the surface of the snowboard.

As discussed in more detail below, in other embodiments of the present invention, a toe hook or other mating feature can be provided directly on the base of the binding for engaging with the boot 7, rather than being provided on the interface 1. Furthermore, it should be appreciated that the arrangement of the toe hook and a corresponding cavity or engagement member can be reversed, such that the hook can be on the snowboard boot 7, with its mating feature on the interface 1 or the base of the binding. Finally, it should further be appreciated that it is not entirely necessary to prevent lifting of the toe of the boot, such that a snowboard boot, binding and interface system can be provided with no engagement between the boot 7 and the snowboard other than the strap 5 of the interface.

As discussed above, the aspect of the present invention directed to the interface 1 is not limited to any particular step-in binding. However, an illustrative example of a binding suitable for use with the particular implementation of the interface shown in FIG. 1 is illustrated in FIG. 2. The binding includes a baseplate 17 and a hold-down disc 19 that is adapted to mount the baseplate to a snowboard 21. The hold-down disc includes holes for receiving a plurality of screws 23 to mount the hold-down disc to the snowboard. Mounted to the baseplate 17 is a pair of moveable engagement members 24, each including a pair of spaced apart engagement lobes 26 that are adapted to mate with the recesses 11 in the interface 1. Each moveable engagement member further includes a trigger 28 that is adapted to be stepped upon by the interface 1 to cause the engagement lobes 26 to move into engagement with the recesses 11. The interface 1 can optionally include a pair of lower recesses 31 adapted to receive the triggers 28. The moveable engagement members 24 each is further coupled to a handle 33 that can be used to move the engagement member from its closed to an open position.

The binding shown in FIG. 2 further includes a high-back 35 that is mounted to a pair of lateral sidewalls 37 of the baseplate 17. In the implementation shown in the drawings, the attachment of the high-back to the sidewalls is accomplished via a screw 39 and nut 41, each of which is received in a slot 43 formed in the corresponding sidewalls 37, to enable rotational adjustment of the high-back about an axis substantially normal to the baseplate 17.

The particular binding shown in FIG. 2 is described in greater detail in U.S. patent application Ser. No. 08/780,721, which is incorporated herein by reference. An alternate binding that can be employed with the particular interface 1 shown in FIG. 1 is described in U.S. patent application Ser. No. 08/655,021, which is also incorporated herein by reference.

As discussed above, the present invention is not limited to any particular binding or mating features on the interface 1 for engagement therewith. In addition, another aspect of the present invention is directed to a unique step-in binding. In accordance with one embodiment of the present invention, the unique step-in binding is used in conjunction with a corresponding interface to form a system for mounting a snowboard boot to a snowboard.

An alternate embodiment of the present invention is shown in FIGS. 3–6. This embodiment of the present invention includes an alternate implementation of an interface 51 for interfacing the snowboard boot 7 to a binding, as well as a binding 53 compatible therewith. As with the embodiment of the interface shown in FIG. 1, the interface 51 includes a body 55 and a single adjustable ankle strap 57. The ankle strap 57 can be implemented in any of a number of ways, and the present invention is not limited to any particular implementation.

In contrast to the embodiment of FIGS. 1–2, the embodiment of the present invention shown in FIGS. 3–6 does not include any feature mounted on the interface 51 for holding down the toe of the boot 7 during riding. Rather, in this embodiment of the invention, corresponding strapless mating features are provided on the boot and the binding 53 for inhibiting toe lift during riding. In the particular embodiment shown in FIGS. 3–6, the toe-end engagement between the boot 7 and the binding is accomplished via a pin 59 that is embedded in the sole of the boot and a forward engagement member 61 mounted on the binding. As is discussed in more detail below, these engagement and mating features can be reversed between the boot and the binding, and the toe-end engagement between the boot and the binding can be accomplished in any number of other ways. The present invention is not limited to the particular arrangement shown in FIGS. 3–6.

It should be appreciated that when the interface 51 is engaged within the binding 53 during riding, a principle force generated on the interface 51 will be a lifting force generated by the boot 7 on the strap 57, which force will be transmitted to the body 55 of the interface through the components of the strap 57 attached thereto. To inhibit rotation of the interface 51 relative to the sole of the boot 7, the interface 51 is provided with a heel counter 63. In the particular embodiment shown in the drawings, the interface 51 is formed from a substantially rigid material (e.g., aluminum, glass-filled nylon, polycarbonate, thermoplastic polyurethane), and the heel counter 63 is formed from a relatively flexible material (e.g., leather, nylon, canvas, surlyn or a flexible plastic). However, it should be appreciated that the present invention is not limited in this respect, and that the heel counter 63 and the body 55 of the interface can be formed (e.g., by injection molding) as a single integral piece from the same material, with either the same or varying degrees of stiffness.

In one illustrative embodiment of the invention, the particular dimensions and configuration of the interface 51 are selected to optimize performance. As discussed above, one of the advantages of using the interface 51 is that the engagement of the boot 7 via the strap 57 enables lateral roll of the sole of the boot 7 relative to the interface 51. Thus, the upstanding sidewalls 65 of the interface are preferably provided to have a height (e.g., not to exceed approximately three inches) that is sufficiently low to terminate below the ankle bone, so that the upstanding sidewalls 65 do not inhibit bending of the rider's ankle from side-to-side. It should be appreciated that the sidewalls of the interface 1 of FIG. 1, as well as other alternate embodiments of the present invention, can be sized to achieve the same result. Second, the heel counter 63 is preferably provided to be relatively thin and to have a low profile so as to fit comfortably between the heel of the boot 7 and the high-back 67 on the binding 53. Third, the heel counter 63 is arranged to form an angle A (FIG. 3) relative to the sidewalls 65 of the interface 51 so that the lifting force on the strap 57 can be resisted by the heel counter 63 without requiring that the heel counter 63 be relatively stiff or strong. In one embodiment of the present invention, the angle A is preferably less than ninety degrees.

In the embodiment of the present invention shown in FIGS. 3–6, the interface 51 is arranged to fit on any snowboard boot, and is not integrated into any particular geometry in the sole of the snowboard boot. As discussed below, in alternate embodiments of the invention, the snowboard boot and the interface have particular mating geometries so that the interface is integrated into the sole of the boot.

A number of soft snowboard boots for use with step-in bindings include a heel strap mounted directly thereto to inhibit lifting of the rider's foot inside the boot. However, the holding down of the rider's foot with a strap (e.g., 5 in FIG. 1 or 57 in FIG. 3) mounted to the boot via the interface provides a number of advantages over mounting a strap directly to the soft snowboard boot. In this respect, when an ankle strap is mounted directly to the boot and is tightened down by the rider, the strap provides tension across the entire width of the foot between the two areas wherein the strap is attached. This is in contrast to the ankle straps used in a conventional tray binding, wherein the straps are attached to the sidewalls of the binding, and only engage the rider's boot from substantially above the ankle area. Thus, as compared to a strap mounted directly to the boot, an ankle strap in a tray binding applies force substantially only in the downward direction to inhibit heel lift, but yet does not wrap around the foot, and therefore does not inhibit foot roll. As discussed above, as tray bindings have been the performance standard for years for use with soft snowboard boots, it is desirable to provide a step-in system that maintains the feel of a tray binding. Thus, in accordance with one illustrative embodiment of the present invention, the sidewalls 65 of the interface 51 (as well as the sidewalls of the interface 1 in FIG. 1) are provided from a substantially rigid material so that they do not collapse around the rider's foot when the strap 57 is tightened down. When the sidewalls of the interface are substantially rigid, the ankle strap 57 does not collapse around the entire width of the boot 7, but rather applies substantially only downward pressure to the top of the heel area, while still enabling foot roll in much the same manner as the ankle strap in a tray binding. Also, by not collapsing around the side of the boot 7, the sidewalls 65 enable some space for the sliding portion 69 of the strap to advance over the top surface of the boot 7 when the strap 57 is tightened. As discussed below, in one embodiment of the invention, a truss can be provided between the bottom surface 71 of the interface and each of the sidewalls 65 to provide the additional rigidity desired to resist collapsing.

In the embodiment of the present invention shown in FIGS. 3–6, the interface 51 includes an engagement pin 73 that projects from each lateral side of the interface for engagement with a locking mechanism on the binding 53. Although a single engagement pin is shown in the drawings, it should be appreciated that separate pins can be used for the medial and lateral sides of the binding. As discussed above, the present invention is not limited to any particular mating features for engaging the interface 51 to the binding 53. However, the use of the engagement pin 73 that is circular in cross-section is advantageous in that it provides a relatively small surface area on the interface 51 for engaging with the binding, which facilitates minimizing the overall size of the interface 51. Minimizing the size of the interface 51 is advantageous because, as discussed above, there are times when the rider will pop at least the back boot out of the binding 53 with the interface attached thereto, so that it is desirable to minimize the structure attached to the sole of the boot 7 in those circumstances. Thus, in accordance with the embodiment of the present invention shown in FIGS. 3–6, an interface 51 is provided that advantageously has a small overall size, and that has a forward edge that terminates rearwardly of a midline of the snowboard boot, so that the interface does not underlie any portion of the snowboard boot forward of the boot's midline.

It should be appreciated that the engagement pin 73 will be subjected to significant lifting forces during riding. Thus, in accordance with one illustrative embodiment, the engagement pin 73 is formed from a relatively strong material (e.g., stainless steel, hardened steel, hardened aluminum, etc.) to withstand the significant lifting forces.

The illustrative binding 53 shown in FIGS. 3–14 has a number of advantageous features that will become apparent from the description below. However, the aspect of the present invention relating to the interface for interfacing a snowboard boot to a binding is not limited to use with this or any other particular binding arrangement. Furthermore, the aspect of the present invention relating to the binding shown in FIGS. 3–14 is not limited to use with an interface 51, as the boot 7 can be provided with an engagement pin 73 mounted directly thereto for mating with the binding 53.

The illustrative implementation of the binding 53 includes a baseplate 75 and a hold-down disc 77 for mounting the baseplate to the snowboard 21 in a plurality of rotational positions. The baseplate 75 includes a heel hoop 79 to which the high-back 67 is mounted via a pair of screws 81. Although not shown in the drawings, the screws 81 can be passed through a pair of elongated slots in the heel hoop 79 to enable the high-back 67 to be rotated about an axis substantially normal to the snowboard 21 in accordance with the teachings of U.S. Pat. No. 5,356,170. Although the provision of a rotatable high-back and a separate hold-down disc for mounting the baseplate 75 to the snowboard are advantageous, it should be appreciated that the present invention is not limited to a binding that includes these features.

The illustrative embodiment shown in FIGS. 3–14 includes a strapless forward engagement member 61 for engaging a forward section of the rider's boot to prevent it from lifting from the baseplate when riding. As discussed above, the strapless forward engagement member can be implemented in any of a number of ways and the present invention is not limited to the particular implementations shown in the drawings, which are provided merely for illustrative purposes.

In the embodiment shown in FIGS. 3–5, the strapless forward engagement member 61 includes a hook 83 for engaging a mating feature (e.g., the pin 59) that is disposed in the sole of the boot in any of a number of ways as described below. The strapless forward engagement member 61 can be formed from hardened steel, aluminum, or some other rigid material such as glass filled nylon, or possibly even a non-reinforced plastic such as rubber or polyurethane. When formed from metal, the engagement member can be formed by casting or bending the metal piece to form the hook 83, leaving sufficient room for the bar or other mating feature in the boot sole to be disposed under the hook 83. When formed from a plastic material, the member 61 can be molded using any of a variety of suitable techniques such as injection molding. The forward engagement member 61 can be attached to the base plate 75 via a set of screws 85 and T-nuts 87, or any other technique that would provide a sufficiently strong engagement to resist the lifting forces applied to the forward engagement member when riding. Alternatively, the forward engagement member 61 can be molded integrally with the base plate 75. In the embodiment of the invention shown in the figures, the hook 83 defines an opening that faces toward the front of the binding, such that the rider draws the forward portion of the boot backward when stepping into the binding to engage with the forward engagement member 61. As discussed below, in other embodiments of the invention, the hook can alternatively be disposed facing rearwardly.

In one embodiment of the invention, the base plate 75 is provided with a plurality of holes 89 that are adapted to receive the screws 85 for mounting the forward engagement member 61 in a number of different positions along the length of the base plate to accommodate different boot sizes. The mating member on the boot can be fixed thereto so that it is not adjustable by the rider, thereby reducing the possibility of misalignment when the strapless engagement member 61 is set in the appropriate set of holes 89 for the corresponding boot size. Alternatively, in another embodiment of the invention, the mating member on the boot can be releasably attached thereto to enable the rider to adjust the position of the mating member on the sole.

The optimal positioning of the strapless forward engagement member 61 along the length of the base plate 75 is impacted by a number of factors. First, the engagement member 61 should be positioned on the base plate so that it will engage and lock down the corresponding mating member on the boot when the rider's heel is securely inserted in the back of the binding. In general, the further forward the mating member (e.g., bar 59 in FIG. 3) is disposed on the boot, the easier it is for the rider to engage it with the forward engagement member 61 when stepping into the binding. In view of the fact that the toe of the boot may overhang the toe edge of the binding, it is desirable to mount the mating member on the boot such that it does not extend beyond the length of the boot in the toe area. The mating member can be disposed on the boot as close as one cm from the most forward edge of the rubber outer sole of the boot using mounting techniques such as those described below. However, in one embodiment of the invention, the placement of the mating member on the boot is measured forward from the heel end of the boot, so that boots of at least two different sizes can have the mating member disposed in the same location relative to the binding. Thus, in at least one of its adjustment positions provided by the plurality of holes 89 in the base plate 75, the strapless forward engagement member 61 can be used to receive boots of at least two different sizes. The forward engagement member 61 can be disposed as far rearwardly as the center line that marks the midway point between the toe and heel along the length of the boot, while effectively holding the toe end of the boot, and in one embodiment of the invention for a size nine boot, is disposed approximately four cms from the forward toe edge of the boot's outer sole.

As mentioned above, the position of the forward engagement member 61 along the length of the base plate 75 can be adjusted using the plurality of holes 89 to accommodate boots of different sizes. The toe of the boot will typically extend some distance beyond the forward edge 91 of the base plate for some boot sizes. Thus, the forward engagement member 61 can be positioned all the way up to the forward edge 91 of the base plate, and may even overhang and extend beyond the edge 91, without extending beyond the toe edge of the boot. In addition, the holes 89 can extend rearwardly as far as is desired to accommodate positioning of the engagement member 61 so that it will underlie the boot mating member (e.g., 59 in FIG. 3), which may be disposed as far back as the midway point along the length of the boot. In the embodiment shown in the figures, the plurality of holes 89 extends only as far back as the opening 95 in the base plate that is adapted to accommodate the hold-down disc 77, because as discussed briefly above, the rotational orientation of the base plate 75 can be adjusted with respect to the hold-down disc 77, which would result in an offsetting of any of the plurality of holes 89 extending across the hold-down disc 77.

The positioning of the strapless forward engagement member 61 across the width of the base plate 75, as well as the positioning of the corresponding mating member across the width of the boot sole, impacts the performance of the system. In particular, when these elements are respectively disposed along the center line midway across the width of the binding and boot, foot roll (defined herein as a rolling of the boot sole relative to the base plate 75) will be achieved in both the medial and lateral directions. Offsetting the mating member in the boot and the portion (e.g., hook 83) of the strapless engagement member that is adapted to engage it toward the lateral side of the boot will reduce foot roll toward the medial side of the boot. Conversely, offsetting these members toward the medial side of the boot will reduce foot roll toward the lateral side of the boot. Thus, the position of the forward engagement member 61 and the corresponding mating member on the boot can be adjusted to control and achieve the desired direction of foot roll. In addition, in one illustrative embodiment of the invention (not shown), two separate strapless engagement members are employed across the width of the base plate 12, to separately control the amount of foot roll in the medial and lateral directions.

In one embodiment of the invention, the opening of the strapless forward engagement member 61 is arranged to be in-line with the direction of motion of the boot sole mating member as the rider steps into the binding, to thereby facilitate engagement between the boot and binding. In this embodiment of the invention, the forward engagement member 61 is mounted in an asymmetric fashion, such that the opening defined by the engagement member is offset slightly from the central axis along the length of the boot, with the hook opening facing slightly toward the medial side of the binding.

Figure 3:
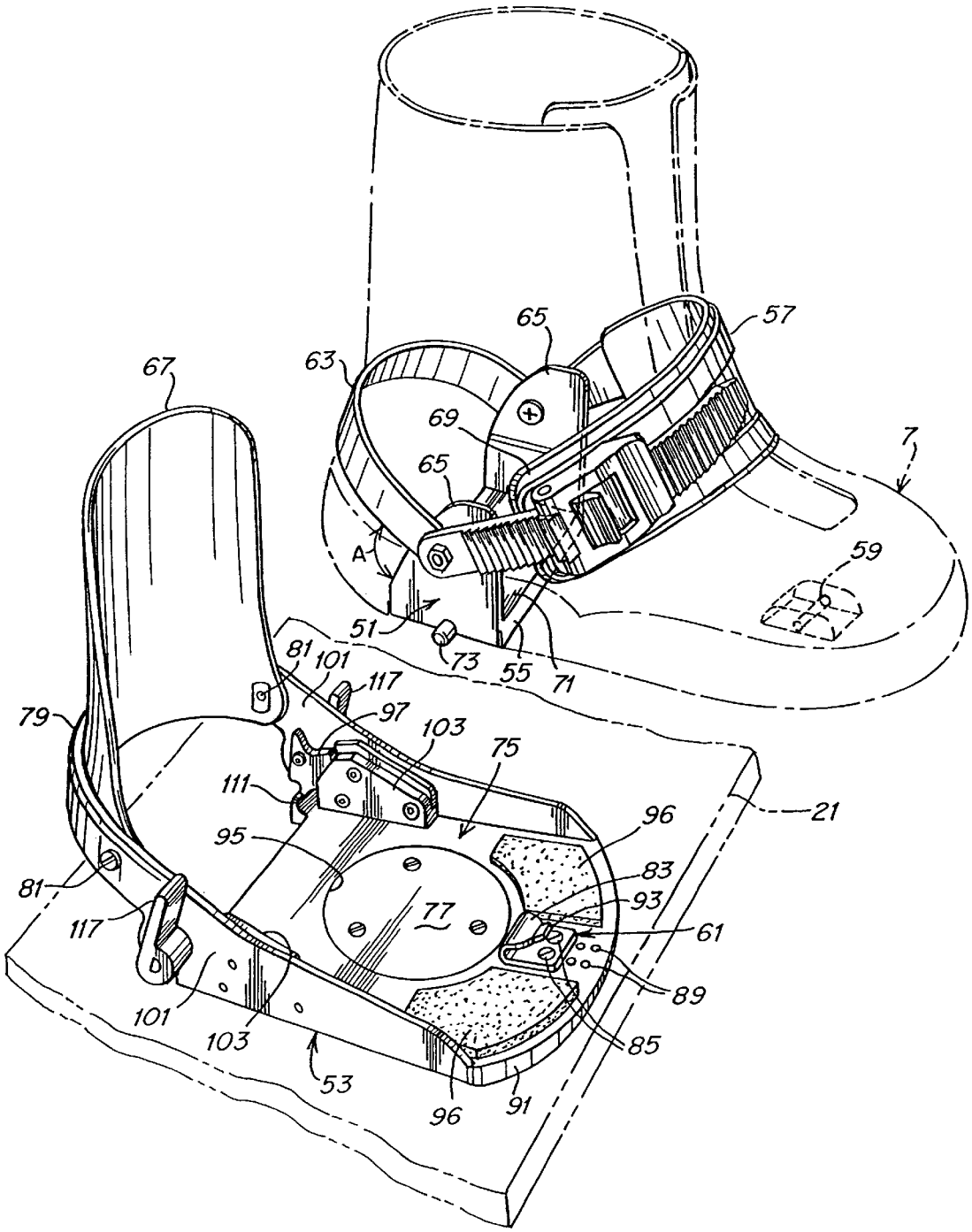
FIG. 3 is an exploded perspective view of an alternate embodiment of an interface according to the present invention, as well as one illustrative embodiment of a binding in accordance with the present invention.
Figure 4:
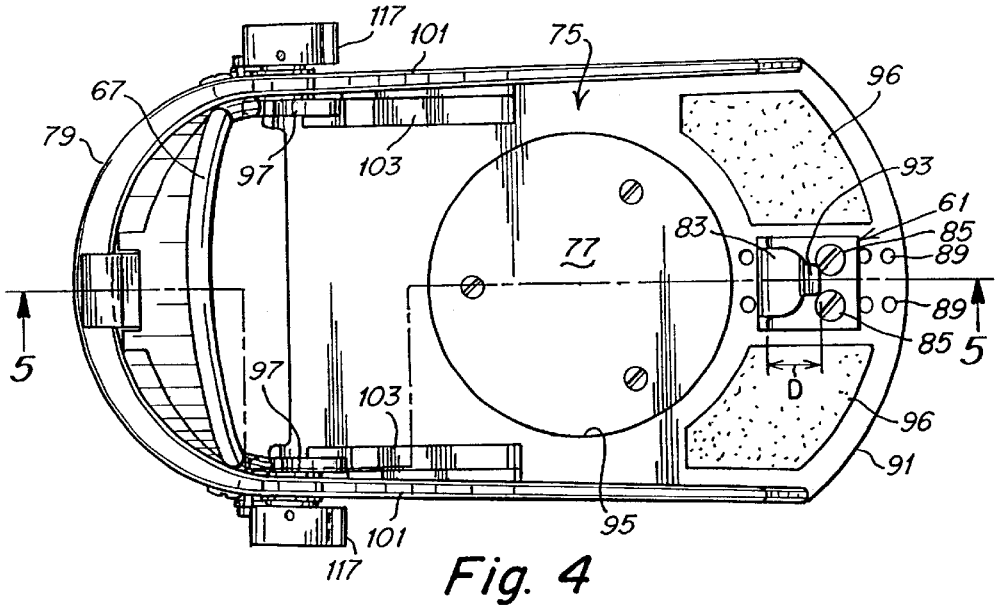
FIG. 4 is a top view of the binding of FIG. 3.
Figure 5:
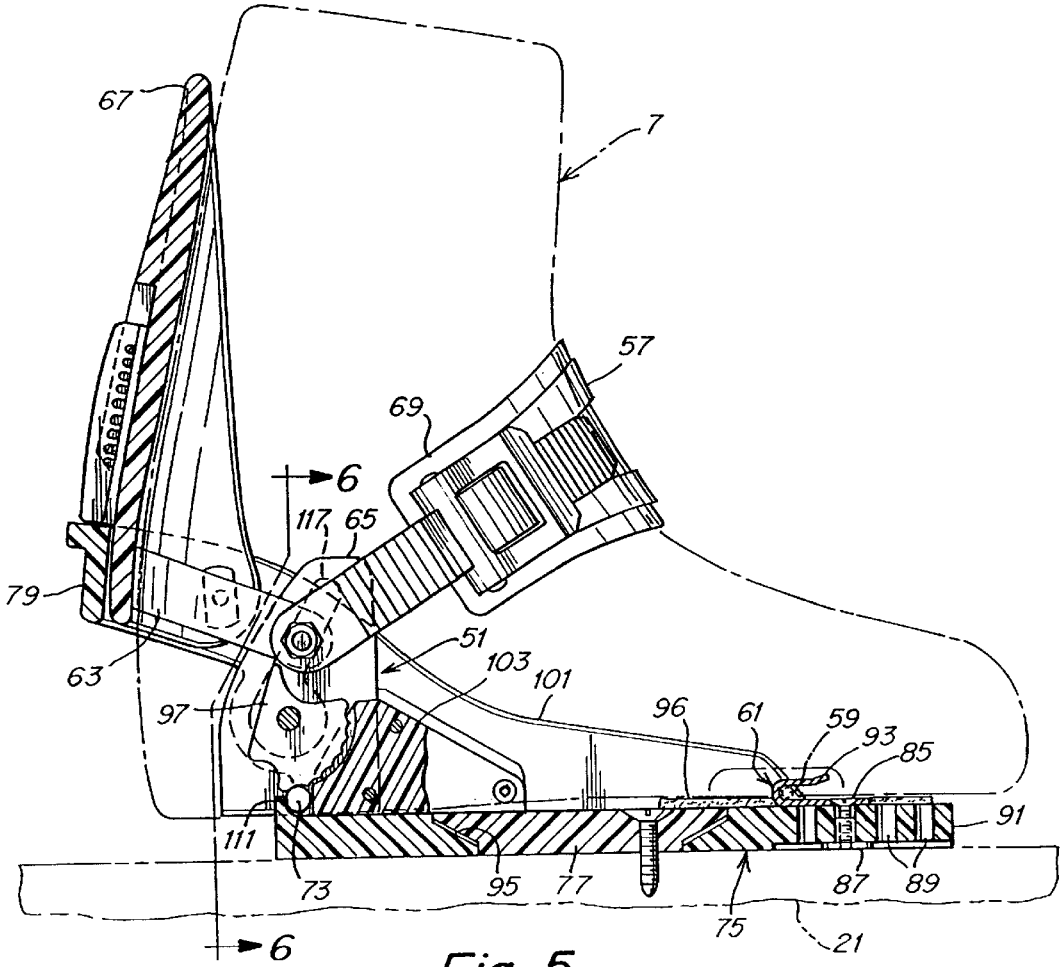
FIG. 5 is cross-sectional view, taking along line 5—5 of FIG. 4, of the binding of FIG. 4 engaging the interface of FIG. 3.

As discussed above, in the embodiment of the invention shown in FIGS. 3–5, the hook 83 of the strapless forward engagement member 61 faces the front of the binding. However, in an alternate embodiment of the invention, the open portion of the engagement member faces the rear of the binding. Different advantages can be achieved with each of these alternate embodiments.

In the rear-facing embodiment, the rider's boot is securely locked between the rear portion of the binding, including the high-back 67, and the strapless forward engagement member 61. As the rider steps into the binding, pressure exerted on the boot by the high-back 67 and the engagement between the mating feature on the boot sole and the forward engagement member 61 causes the boot to be tightly seated therebetween. Thus, when the rider steps into the binding, it is clear when the boot engages the forward engagement member and is secured to the binding thereby. In addition, the heel of the boot is advantageously seated firmly against the rear portion of the binding.

In contrast to the rear-facing embodiment, when the forward engagement member 61 faces the front of the binding as shown in FIGS. 3–5, the binding is relatively easier to step into and out of than in the above-described rear-facing embodiment, because the boot is not wedged between the high-back 67 and the forward engagement member 61. However, the front-facing embodiment does not provide the same wedging action wherein the boot is positively locked between the high-back 67 and the forward engagement member 61, and does not provide the same confirmation that the boot is engaged by the strapless forward engagement member 61.

As should be appreciated from the foregoing, the present invention is not limited to either a forward or rear-facing strapless engagement member, and contemplates the use of both embodiments, each of which provides particular advantages.

As discussed above, the direction of foot roll achieved with the binding of the present invention can be controlled by varying the placement of the strapless forward engagement member 61 relative to the central axis of the binding. Another characteristic of the system that affects the amount of foot roll is the width of the hook portion 83 (FIG. 4) of the strapless engagement member. In particular, a relatively wide hook portion 83 can be used to control and limit the amount of foot roll experienced with the binding, whereas a relatively narrow hook portion 83 will have less impact on restricting the amount of foot roll. A range of acceptable widths for the hook portion 83 of the forward engagement member in accordance with one illustrative embodiment of the invention is from five mm to three cm, with one particular embodiment employing a width of 1.5 cm.

It should be appreciated that the width of the hook portion 83 of the forward engagement member also impacts the ease of insertion of the corresponding mating member (e.g., bar 59 in FIG. 3) in the boot sole. In particular, the narrower the hook portion 83, the easier it is to insert the boot sole mating member. Thus, to facilitate insertion of the boot sole mating member in the strapless engagement member, in one embodiment of the invention shown in FIGS. 3–5, the hook portion 83 narrows as it extends outwardly to a point 93 (FIG. 4). Thus, at the thinnest outward point 93 that defines the mouth of the opening, it is relatively easy to slip the mating feature on the boot sole under the hook portion 83. As the boot sole member is drawn into further engagement with the hook portion 83, the engagement tightens up as more of the boot sole mating feature is engaged by the widening hook portion 83. In one embodiment of the invention, the hook portion 83 has a width of approximately five mm at the outward portion 93, and widens to approximately three cm at its widest point.

Ease of insertion of the boot sole mating member into the strapless engagement member is also facilitated in one embodiment of the invention by providing some lift to the entrance portion 93 of the hook, as shown in FIGS. 3–5. Thus, the opening formed by the hook portion 83 is largest at the mouth of the opening to facilitate insertion of the boot sole mating member, and then tapers to a smaller opening size.

The other relevant dimension of the forward engagement member is the depth D (FIG. 4) of the hook portion 83. The shallower the hook portion 83, the easier it is for the rider to fully engage the boot with the forward engagement member. However, the hook portion 83 should have sufficient depth to engage the corresponding mating member on the boot sole through a range of positions that accounts for all possible positions and forward lean adjustments for the high-back 67. In one embodiment of the invention, the hook portion 83 has a depth D within a range of 1–5 cm, and in one particular embodiment the depth is equal to approximately two cm.

In the embodiment of the invention shown in FIG. 3, the binding 53 further includes a pair of pads 96 that are mounted to the baseplate 75 on both sides of the forward engagement member 61. The pads 96 perform several functions. First, the pads distribute any downward compression force generated by the toe end of the boot on the binding to minimize the likelihood of a pressure point being created by the forward engagement member 61. This is advantageous because it is desirable to prevent the rider from feeling the forward engagement member 61 underlying the sole of the boot. Second, by varying the stiffness of the pads 96 on one or both sides of the binding, an additional control can be provided over the amount and direction of foot roll that the boot 7 will experience in the binding. It should be appreciated that the pads 96 can alternatively be provided on the boot rather than the binding. Furthermore, it should be appreciated that although the pads 96 provide the above-described advantages, they are not necessary and can be eliminated from other embodiments of the present invention.

One illustrative embodiment of a rear locking mechanism for releasably engaging the engagement pin 73 will now be described making reference to FIGS. 3–14. Although the illustrative locking arrangement provides a number of advantages as discussed below, it should be appreciated that the present invention is not limited in this respect, and that numerous other locking arrangements for engaging with the engagement pin 73 are possible.

The rear locking mechanism includes a pair of biased engagement cams 97, one each disposed on the medial and lateral sides of the binding 53, rotatably mounted to the sidewalls 101 of the baseplate 75. The cams 97 are biased via springs 99 for rotation toward the forward edge 91 (FIG. 3) of the baseplate 75. Thus, from the cross-sectional side view of FIG. 5, the cam 97 is biased for rotation in the counterclockwise direction. Mounted to the baseplate sidewall 101 on each side of the binding is also a guide 103 that is adapted to guide the engagement pin 73 into engagement with the corresponding engagement cam 97. The guide 103 includes a rearward-facing ramp surface 105 (FIGS. 9–10) that is inclined rearwardly toward the heel end of the binding, and that facilitates engagement between the pin 73 (FIG. 3) and the engagement cam 97 as the rider steps into the binding 53 as shown in FIGS. 9–13. As the rider steps into the binding, the guide 103 draws the pin 73 back along a rearwardly extending path toward the heel end of the binding.

Figure 9:
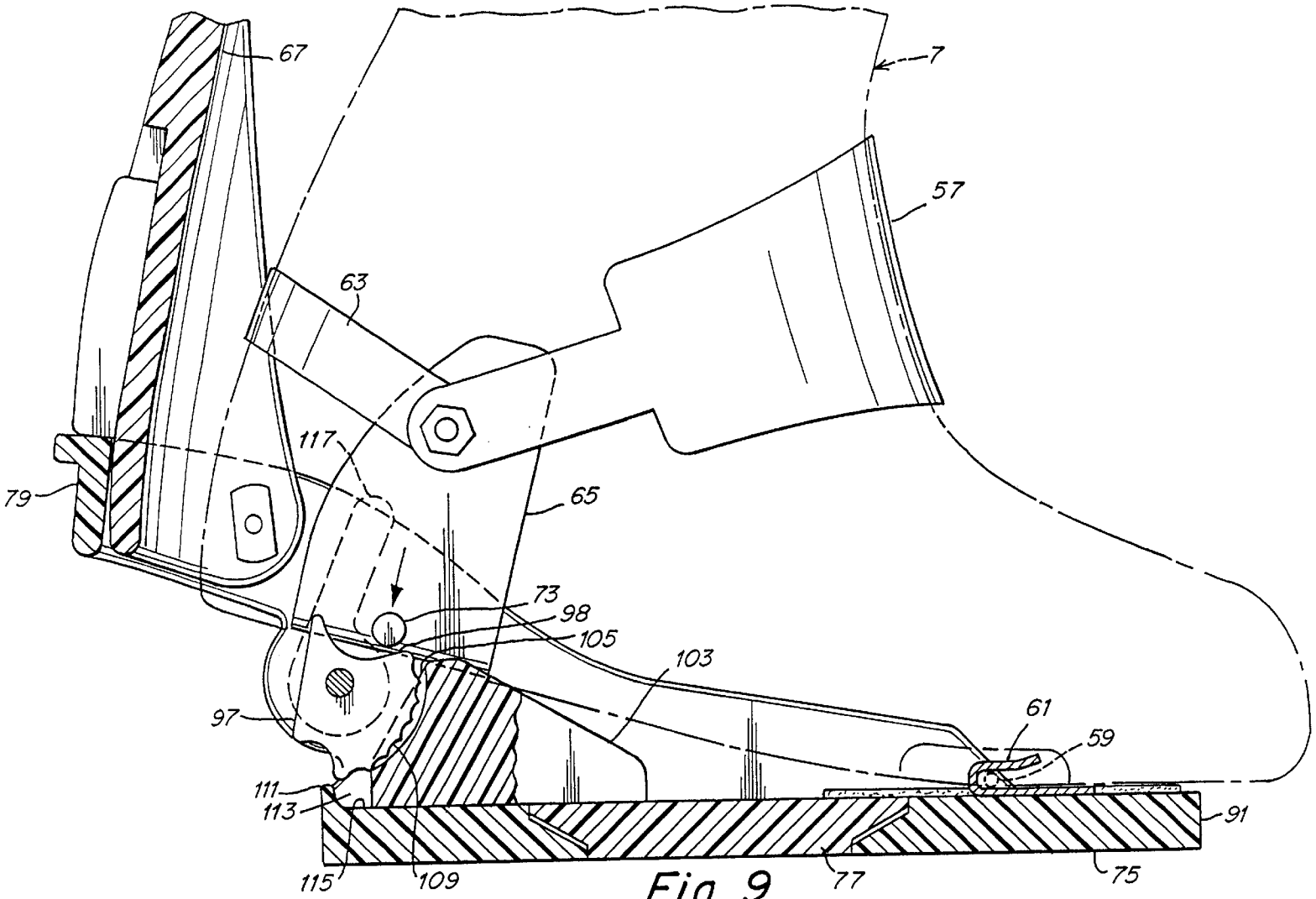
FIG. 9 is a cross-sectional schematic side view of the interface and the binding of FIG. 3.
Figure 10:
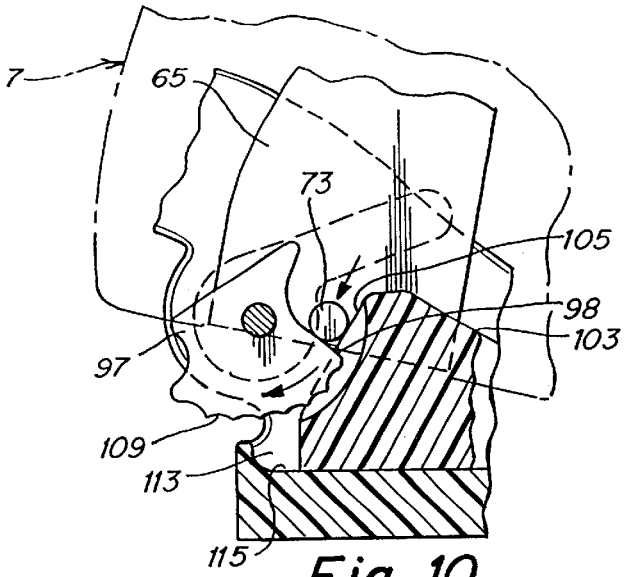
FIG. 10 is a schematic representation of the rear locking mechanism of the binding of FIG. 3 with the interface stepping into the binding.
Figure 11:
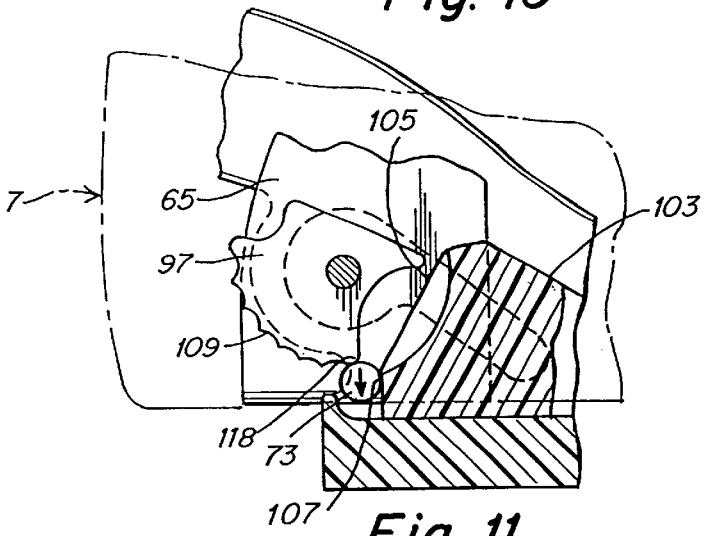
FIG. 11 is a schematic representation of the rear locking mechanism of the binding of FIG. 3 with the interface stepping further into but not yet locked by the rear locking mechanism of the binding.
Figure 12:
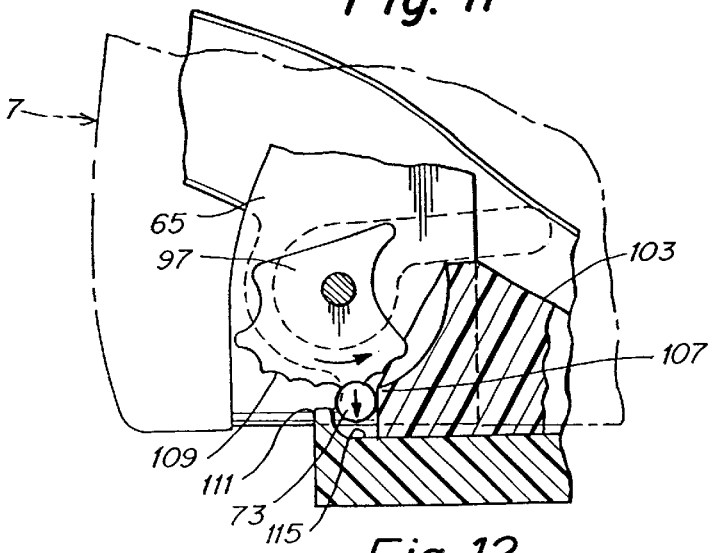
FIG. 12 is a schematic representation of the rear locking mechanism of the binding of FIG. 3 with the interface engaged thereby, but not yet fully seated therein.

As shown in FIG. 9, the rider can simply step into the binding by aligning the strapless forward engagement member 61 with the corresponding mating feature (e.g., bar 59) in the boot and stepping downward so that the engagement pin 73 is guided by the ramp 105 into contact with the engagement cam 97. To receive the engagement pin 73, the rear engagement mechanism can simply be in its closed or at rest position, and need not be cocked into an open position, because when in the closed position, the cam 97 intersects the rearwardly extending path along which the pin 73 travels. As the rider steps into the binding, engagement between the pin 73 and a trigger surface 98 of the cam 97 causes the cam to rotate in the clockwise direction as shown in FIG. 10, thereby enabling the engagement pin 73 to continue to move down the rearward-facing ramp surface 105. As shown in FIGS. 11–12, as the engagement pin 73 reaches the bottom 107 of the rearward-facing ramp surface 105, the engagement pin 73 clears the forward edge 118 of the cam 97, enabling the biased cam to rotate in the counterclockwise direction in FIG. 13 to capture the engagement pin 73 under the engagement cam 97.

It should be appreciated that the rearwardly-extending ramp surface 105 is advantageous because movement of the engagement pin 73 along the ramp causes the rider's boot to be drawn rearwardly into the binding as the rider steps in, thereby causing the rear portion of the boot to advantageously be seated firmly against the heel hoop 79 and high-back 67, thereby increasing the force transmission between the highback and the boot. Although the feature of the illustrative embodiment relating to the drawing backward of the boot is advantageous, it should be understood that the present invention is not limited in this respect, and that other geometries for the rear surface of the guide 103 are possible for guiding the engagement pin 73 into the locked position shown in FIG. 13.

Figure 13:
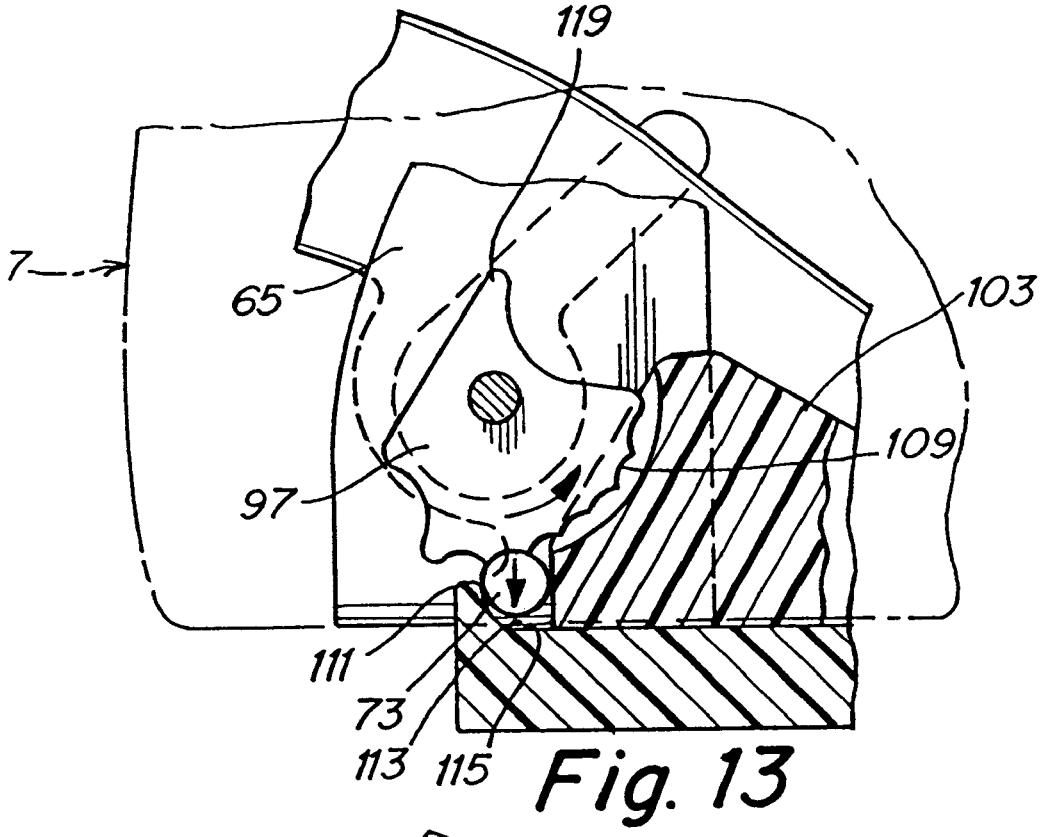
FIG. 13 is a schematic representation of the rear locking mechanism of the binding of FIG. 3 with the interface substantially fully seated therein.

In the embodiment of the invention shown in the drawings, the engagement cam 97 includes a scalloped surface 109 that engages with the engagement pin 73 when the binding is in the locked position shown in FIG. 13. The purpose of the scalloped surface 109 is to provide frictional engagement between the engagement cam 97 and the engagement pin 73 when the binding is locked. However, it should be appreciated that the present invention is not limited to this particular surface geometry, as the cam can be provided with a smooth engaging surface that does not include any feature to increase the frictional engagement with the locking pin, or alternatively, can employ a different surface configuration to achieve the same purpose as the scalloped surface 109.

As shown in the drawings, the baseplate 75 includes a raised lip 111 that, together with the rear facing surface of the guide 103, forms a recess 113 for receiving the engagement pin 73 when the binding is in the locked position. In the embodiment of the invention shown in the drawings, the engagement cam 97 is configured so that the recess 113 gets progressively smaller as the cam rotates in the clockwise direction of FIGS. 9–13, i.e., the radius of the engagement cam 97 increases when moving along the scalloped surface 109 in the clockwise direction in FIGS. 10–13. Thus, the binding can accommodate an accumulation of snow on the surface of the baseplate 75 or within the recess 113 by providing various locking positions that provide differing amounts of clearance between the cam 97 and the bottom 15 of the recess 113.

Figure 14:
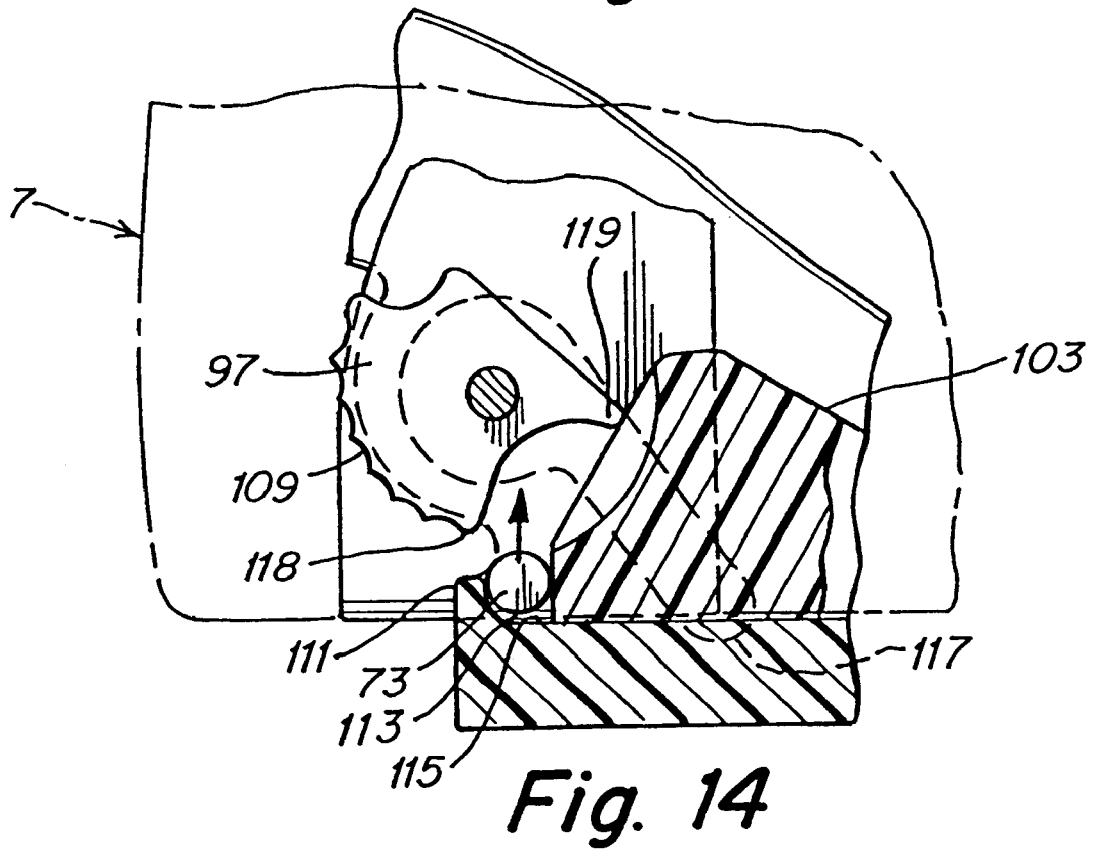
FIG. 14 is a schematic representation of the rear locking mechanism of the binding of FIG. 3 in the release position.

In the embodiment shown in the drawings, each of the engagement cams 97 has an associated lever 117 that can be manipulated to place the rear locking mechanism into a release position as shown in FIG. 14 to release the engagement pin 73. In the embodiment of the invention shown in FIGS. 3–14, the lever 117 is mounted to the cam 97 in a direct drive fashion, so that rotation of the lever 117 causes a corresponding and identical amount of rotation of the cam 97. The rider can release the engagement pin 73 from the rear locking mechanism by rotating the levers 117 (and consequently the cam 97) clockwise to the open position shown in FIG. 14, lifting the heel of the boot upwardly so that the engagement pin 73 clears the forward edge 118 of the cam 97, and then releasing the levers 117. Although the embodiments shown in FIGS. 3–14 includes two separate levers, it should be appreciated that the present invention is not limited in this respect, and that a linkage mechanism can be provided so that the two cams 97 can be manipulated via a single lever. Furthermore, in the embodiment shown in the figures, the cam includes a lip 119 that blocks the exit passage of the engagement pin 73 when the lever 117 is rotated to the release position shown in FIG. 14. In an alternate embodiment of the present invention, a mechanism can be provided to retain the lever 117 and cam 97 in the open position of FIG. 14. When such a mechanism is employed, the levers can initially be cocked to the open position, and then can be released prior to the rider stepping out of the binding. As the rider steps out of the binding, engagement between the engagement pin 73 and the lip 119 causes a disengagement with the cocking mechanism, thereby enabling the cam 97 and lever 117 to rotate to the closed position of FIG. 9. This is advantageous because the locking mechanism automatically returns to a state wherein the rider can simply step into the binding to cause the engagement pin 73 to be engaged by the engagement cam 97, without requiring any further manipulation of the lever 11 7. The cocking mechanism can implemented in any of a number of ways, one illustrative example of which is described below in connection with an alternate embodiment of the present invention.

It should be appreciated that the nature of the locking mechanism of FIGS. 3–14, particularly when provided with a cocking mechanism, provides a number of advantages. First, the rider need not hold the lever 117 in the release position (FIG. 14) while stepping out of the binding. Thus, the rider can first manipulate the lever to the release position, and can thereafter stand up to a more comfortable position prior to stepping the engagement pin 73 out of engagement with the rear locking mechanism. This feature enables the locking mechanism to be moved from a closed or armed position to an open or disarmed position without requiring any movement from the engagement pin 73 or the rider's boot. Thus, the rider can simply maintain the engagement pin 73 within the rear locking mechanism in the position shown in FIG. 14. Thereafter, the rider can choose to step out of the binding at his or her convenience, or can choose to re-arm the locking mechanism by rotating the lever 117 (counterclockwise in FIG. 14) and consequently the engagement cam 97 back into the locked position.

Figure 6:
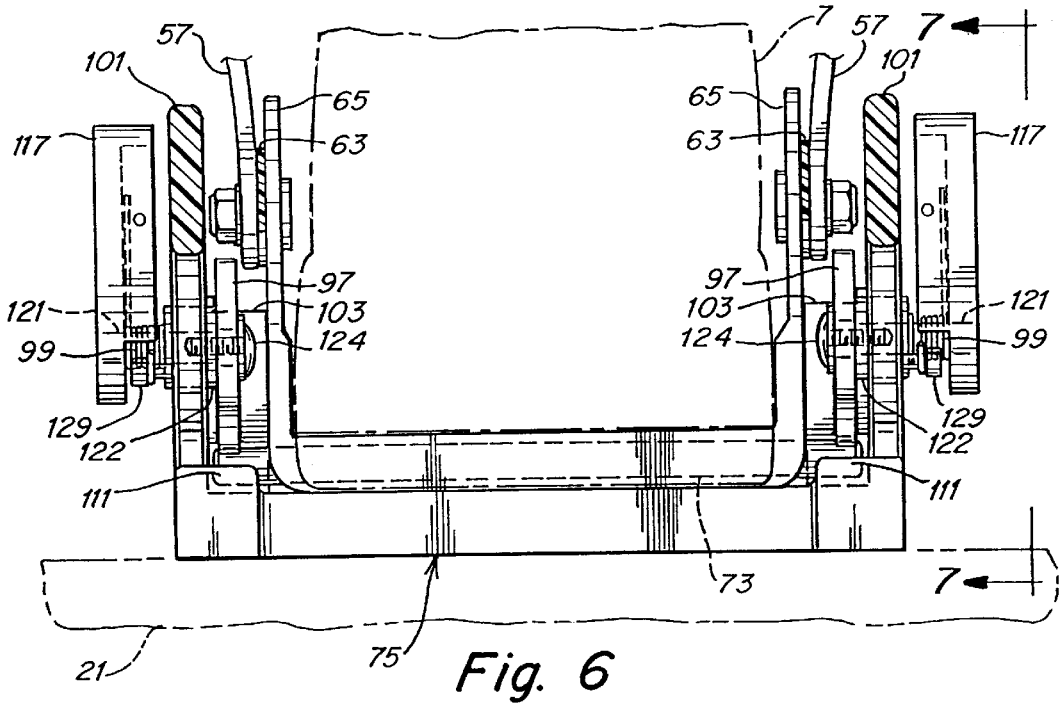
FIG. 6 is a fragmentary cross-sectional view, taken along line 6—6 of FIG. 5, of the binding and interface of FIG. 3.
Figure 7:
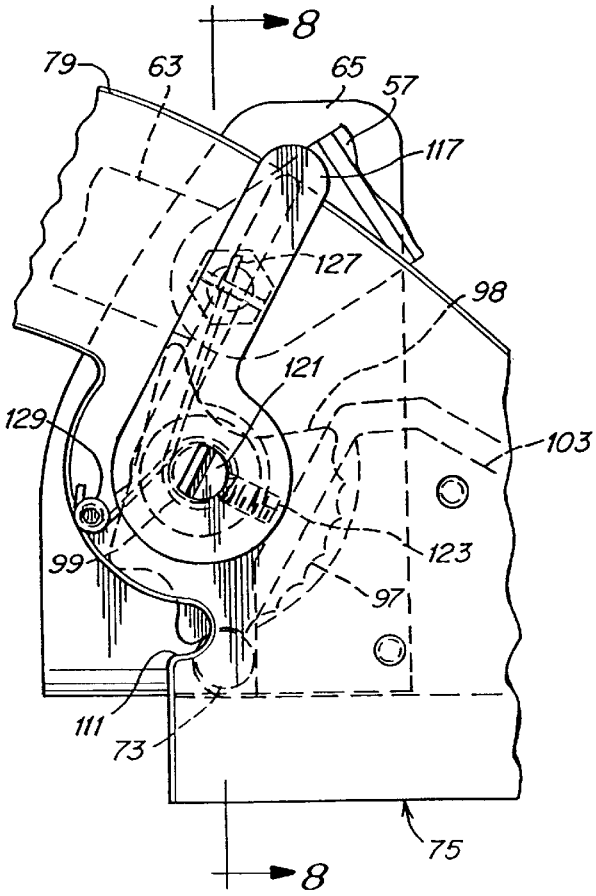
FIG. 7 is a detailed side view, taken along line 7—7 of FIG. 6, showing the rear locking mechanism of the binding of FIG. 3.
Figure 8:
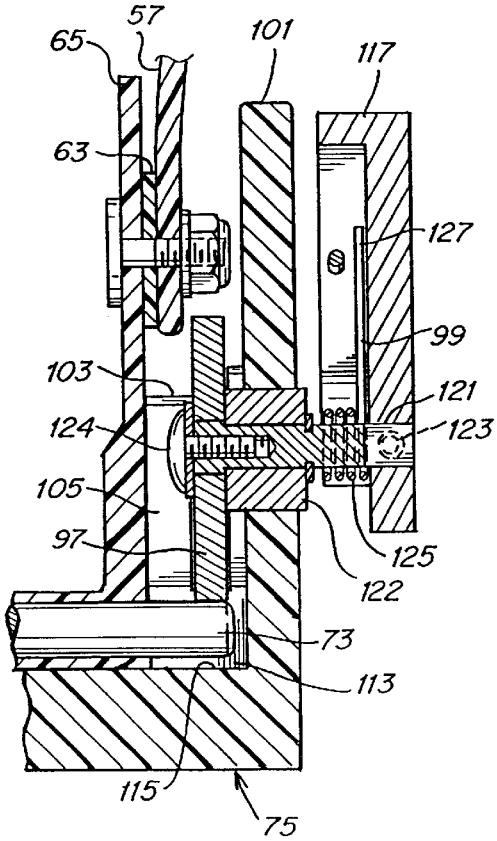
FIG. 8 is a detailed cross-sectional view, taken along line 8—8 of FIG. 7, of the rear locking mechanism of the binding of FIG. 3.

As discussed above, in one illustrative embodiment of the invention, each engagement cam 97 is directly driven by a lever 117, and is biased into the closed position of FIG. 9. The manner in which the engagement cam 97 is mounted to the lever 117 and is biased to the closed position can be implemented in any of a number of ways, with the present invention not being limited to any particular implementation. One illustrative arrangement is shown in FIGS. 6–8. The lever 117 and cam 97 each is mounted to a shaft 121 (FIG. 8) that passes through a bushing 122 fixed in the sidewall 101 of the baseplate. The lever 117 is mounted to the shaft 121 via set screw 123, and the engagement cam 97 is mounted via a screw 124. A biasing spring 99 is wrapped around the shaft 121 at 125, is fixed at one end 127 within the lever 117 and is fixed at the other end to the wall 101 of the baseplate via an anchor 129.

It should be appreciated that some mechanism should be provided for limiting the rotation of the engagement cam 97 and lever 117 once in the fully closed position. This can be accomplished in any number of ways, and the present invention is not limited to any particular implementation. For example, a stop can be provided on the outside of the binding sidewall 101 to limit the rotation of the lever 117, on the inside of the sidewall 101 to limit the rotation of the engagement cam 97, or a stop can be provided to directly limit the rotation of the shaft 121.

An alternate embodiment of the present invention is shown in connection with FIGS. 15–31. This embodiment of the present invention is similar in many respects to the embodiment shown in FIGS. 3–14. However, a number of modifications are made including modifications to all three system components, i.e., the boot 217, the interface 201 and the binding 301.

As shown in FIGS. 15–19, in this embodiment, an interface 201 is provided that is similar in many respects to the interface 51 described in connection with FIGS. 3–5. As with that embodiment described above, the interface 201 includes an engagement rod 203 for engaging with the binding, and an adjustable strap 57 for attaching the interface to a snowboard boot 217. Unlike the embodiment described above in connection with FIGS. 3–5, the heel counter 205 and the body 207 of the interface are formed (e.g., by injection molding) as a single integral piece of rigid material, such as glass-filled nylon, polycarbonate, aluminum, TPU or some other appropriate material. Each side of the interface is provided with a slot 209 for receiving the end of the strap 57 attached thereto, and includes a plurality of holes 211 adapted to receive a fastener 212 to mount the strap thereto.

As discussed above, it is desirable to provide the interface 201 to be sufficiently rigid such that the sidewalls of the interface do not collapse about the boot when the strap 57 is tightened down over the top of the boot, and when the interface is subjected to forces exerted thereon by the boot during riding. To provide additional rigidity, the embodiment of the interface 201 shown in FIGS. 15–17 includes a pair of trusses 213 provided at the intersections between the sidewalls 214 and the base 215 of the interface. Although the trusses 213 are advantageous in that they increase the rigidity of the interface, it should be appreciated that the present invention is not limited in this respect, and that the trusses need not be provided in other embodiments of the present invention.

In the embodiment of the invention shown in FIGS. 15–19, the boot 217 is provided with a number of features to enable the interface 201 to be integrated into the boot in a manner that minimizes the profile of the boot and interface combination. First, the rear heel section of the boot 217 includes a recess or ledge 219 that is adapted to accommodate the heel counter 205. As discussed above, this is advantageous to minimize the profile of the heel counter when the boot and interface combination steps into a binding having a heel hoop (e.g., 303 in FIG. 15) and/or a high-back. Second, the boot 217 also includes a sole recess 221 that is adapted to receive the base portion 215 of the interface. In accordance with one illustrative embodiment of the invention, the recess 221 is constructed and arranged so that when the interface 201 is engaged with the boot and the strap 57 is tightened, the interface 201 is pulled upward into the recess 221 so that it is not disposed below the bottom surface 223 of the boot outer sole 225, such that the engagement with the interface 201 does not alter the feel of the boot sole when walking.

In the embodiment shown in FIGS. 15–19, the sole recess 221 is disposed under the heel area of the boot 217 and extends fully across the sole of the boot 217 from the medial to the lateral side. The recess 221 has a substantially half-cylindrical shape to receive the base 215 of the interface 201, and is free of any engagement member that is adapted to be directly engaged by the binding 301. Rather, the recess 221 is adapted to receive the interface 201, and the interface 201 is in turn adapted to be directly engaged by the binding 301. It should be appreciated that the aspect of the present invention directed to the use of a sole recess to receive the interface is not limited to any particular configuration or location for the sole recess. However, in one embodiment of the present invention, the sole recess 221 is disposed rearwardly of the arch area of the boot. This is advantageous in that placement of the interface 201 near the heel of the boot 217 facilitates minimizing the size of the interface 201, because the interface can resist the lifting force on the strap 57 with a heel counter 205 that is less stiff and strong than would be required if the interface were attached to a more forward location along the sole of the boot 217.

As discussed above, the sole of the snowboard boot 217 may roll laterally relative to the interface 201 during riding. In addition, forces generated on the boot during riding may tend to shift the boot 217 both laterally and in the heel-to-toe direction relative to the interface 201. In accordance with one embodiment of the present invention, the base 215 of the interface 201 and the recess 221 are provided with a pair of complimentary mating features that are adapted to automatically maintain a desired alignment between the interface 201 and the recess 221 during riding. This alignment can be accomplished in any of a number of ways, and the present invention is not limited to any particular implementation.

In the embodiment of the present invention shown in FIGS. 15–19, automatic alignment between the interface 201 and the sole recess 221 is achieved by providing the upper surface of the base 215 of the interface with a non-planar contoured surface, and the recess 221 with a corresponding bottom-facing non-planar contoured surface adapted to mate therewith. The contoured surfaces enable the sole of the boot 217 to roll laterally relative to the interface 201, but automatically maintain alignment in the heel-to-toe direction between the interface 201 and the recess 221 during riding. In addition, the medial and lateral sides of the recess 211 are flared upwardly at 239 to accommodate the trusses 213 in the interface. Engagement between the trusses 213 and the flared sidewalls 239 helps to automatically register alignment between the interface and the boot, preventing shifting of the interface from side to side, as well as rotation of the interface within the recess 221.

The recess 221 can be provided in the boot 217 in any of a number of ways and the present invention is not limited to any particular implementation, including the illustrative implementation shown in the drawings. In the illustrative embodiment shown in the drawings, the boot is provided with a shank 227 that is embedded in the sole 220 of the boot 217. The shank can be formed from a number of materials (e.g., nylon, surlyn, TPU) and should be sufficiently flexible so as to not noticeably stiffen the sole of the boot 217. In this respect, traditional soft snowboard boots have a flexible sole that riders have become accustomed to and that provide significantly greater comfort when walking than a stiff-soled boot.

The shank 227 shown in the illustrative embodiment represented in the drawings performs two functions. First, it assists in the formation of the recess 221. Second, the shank 227 also forms a platform for mounting a strapless engagement member under the toe area of the boot for engagement with the binding in a manner discussed in greater detail below. The shank 227 can be incorporated into the boot 217 in any of a number of ways. For example, many soft snowboard boots include a two-layered sole 220, with an inner or mid sole 229 (FIG. 17) formed from a cushioning material (e.g., EVA) and an outer sole 235 formed from rubber. In accordance with one embodiment of the present invention, the shank 227 is disposed between these two sole layers. The EVA layer 229 can be provided with a recess that is adapted to conform to the upper shank portion 233 (FIG. 15) that defines the recess 221. The shank can be glued to both the EVA layer 229 and the rubber outer sole 225 and this sole assembly 220 can be attached to a leather boot upper 234. As shown in FIG. 16, the rubber outer sole 225 includes a forward sole section 235 and a heel sole section 237 that are separated via the portion 233 of the shank that defines the recess 221. In accordance with one embodiment of the present invention, the outer sole includes a web piece 231 (FIG. 17) that extends between the front and heel sole sections 235 and 237, and extends through the recess 221 defined by the shank 227. The web piece 231 provides a number of advantages. First, it enables the outer sole 225 to be formed from a single piece, rather than separate front and heel sections 235 and 237. Second, by controlling the thickness and stiffness of the web 231, the friction and stiffness between the interface 201 and the boot 217 can be controlled. Finally, the web 231 also covers the surface of the shank 227 that defines the recess 221 to increase the durability of the shank.

As discussed below, it is desirable to integrate the interface 201 into the sole 220 of the boot 217 to minimize the profile of the boot and interface combination, and to minimize the impact on the rider when walking. In one illustrative embodiment of the invention, the recess 221 and interface are arranged so that the bottom surface 238 (FIG. 17) of the interface does not extend below the bottom surface of either the front or heel sections 235, 237 of the outer sole 225. In an alternate embodiment of the invention, the bottom surface 238 is provided with a tread or rubber sole that sits flush with the lower portion of the boot outer sole 225 so that the interface 201 cannot be felt by the rider when walking.

As discussed above, in the embodiment of the invention shown in the drawings, the shank 227 is provided with a pair of upwardly extending flared sidewalls 239 in the area that defines the sidewalls of the recess 221. As mentioned previously, the purpose of the upwardly flared sidewalls 239 is to accommodate the trusses 213 in the interface, and to help register alignment between the interface and the boot.

As discussed above, the present invention is not limited to providing a customized geometry for engaging the interface with the boot, as other embodiments are directed to the use of an interface with any boot, requiring no customized geometry on the boot for receiving the interface.

Although not shown in the figures, the binding 301 can include a high-back mounted to the heel hoop 303. The heel hoop 303 can include a pair of slots or spaced holes to enable rotation of the high-back in the same manner as described in connection with the high-back 35 in the embodiment of FIG. 2. The feature of a high-back rotatable relative to an axis substantially normal to the baseplate of the binding is disclosed in commonly owned U.S. Pat. No. 5,356,170. The high-back disclosed in that patent includes a pair of arms that extend downwardly from the heel hoop substantially parallel to the sidewalls of the baseplate. Thus, the slots to which the high-back are pivotally mounted extend substantially parallel to one another, facilitating the folding down of the high-back toward the baseplate to minimize the profile of the binding for transportation or storage. In contrast, the binding 301 disclosed in FIG. 15, like the binding 53 in FIG. 3, includes an engagement mechanism that extends along the lateral sides of the binding, making it more difficult to mount a high-back to the baseplate with arms extending along the lateral sides of the binding. Thus, the high-back 67 (FIG. 3) and a high-back (not shown) for the binding of FIG. 15 are mounted higher on the heel hoop (e.g., heel hoop 303 in FIG. 15) than the high-back in the '170 patent, and are mounted for rotation about slots that may not extend parallel to one another along the sides of the baseplate.

It should be appreciated that when the slots to which the high-back is mounted do not extend parallel to one another along the lateral sides of the binding, difficulty is encountered in folding the high-back down to reduce the profile of the binding for storage or transportation. Thus, in the embodiment of the invention illustrated in FIG. 15, the binding 301 is provided with a hinged heel hoop 303 that is mounted to the sidewalls 307 of the baseplate for rotation about pivot points 309. In this manner, rotation of the high-back about an axis substantially normal to the baseplate 309 can be accomplished via movement of the high-back within slots or spaced holes in the heel hoop 303, while rotation of the high-back forwardly into a non-use position can be accomplished by rotating the entire heel hoop 303 forwardly about the pivot points 309 (which define an axis of rotation that is different than the axis about which the high-back rotates relative to the heel hoop). It should be appreciated that although rotating the high-back down into a non-use position relative to the heel hoop 303 is difficult when using non-parallel slots in the heel hoop, a smaller range of rotation of the high-back forward can be achieved with little difficulty, thereby enabling the forward lean of the high-back to be adjusted relative to the heel hoop 303. It should also be appreciated that the high-back and the heel hoop 303 can be provided with substantially the same radius of curvature to facilitate rotation of the high-back within the heel hoop 303 about an axis substantially normal to the baseplate 305.

Figure 15:
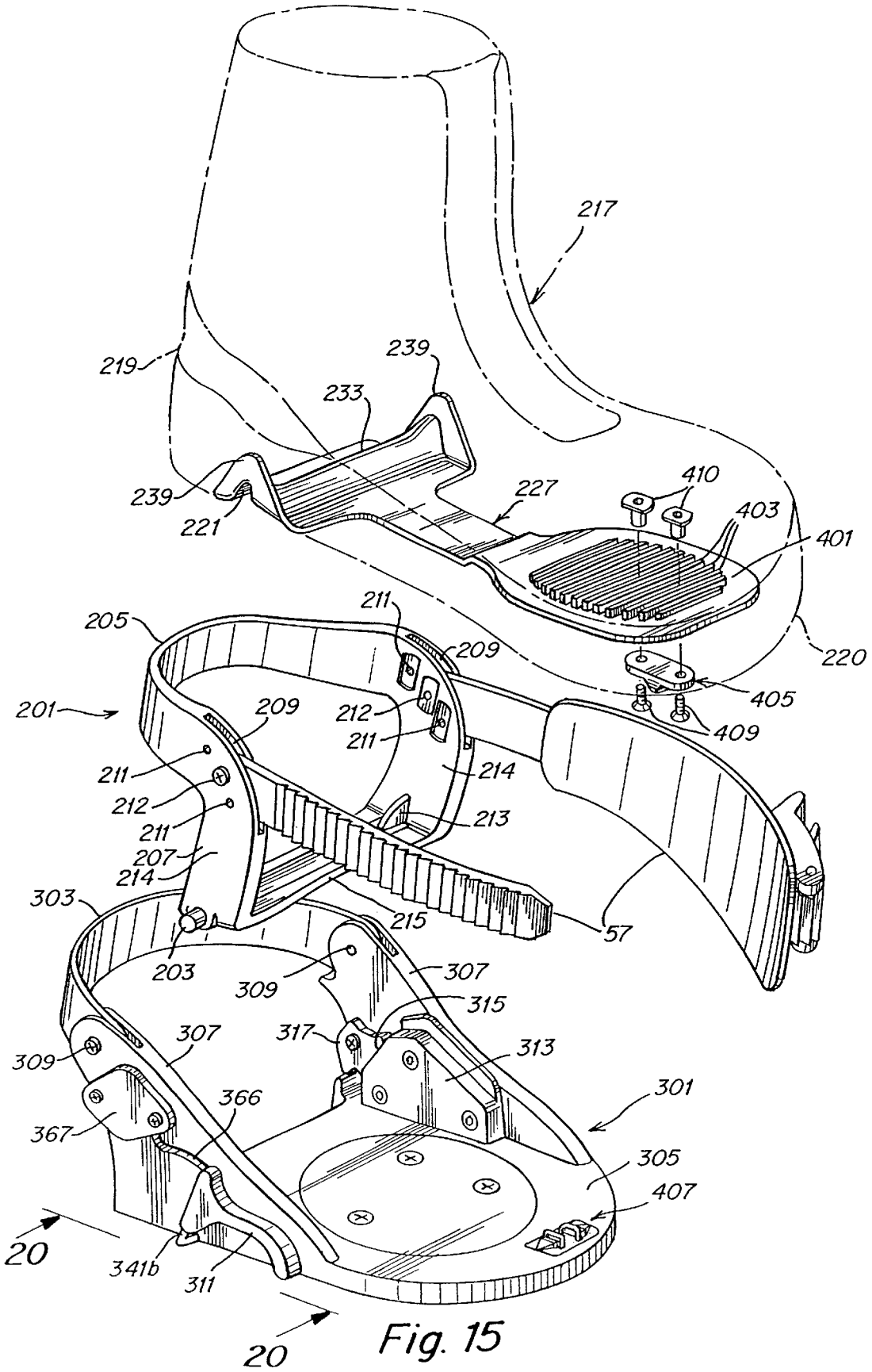
FIG. 15 is an exploded perspective view of an alternate embodiment of an interface, binding and boot according to the present invention.
Figure 16:
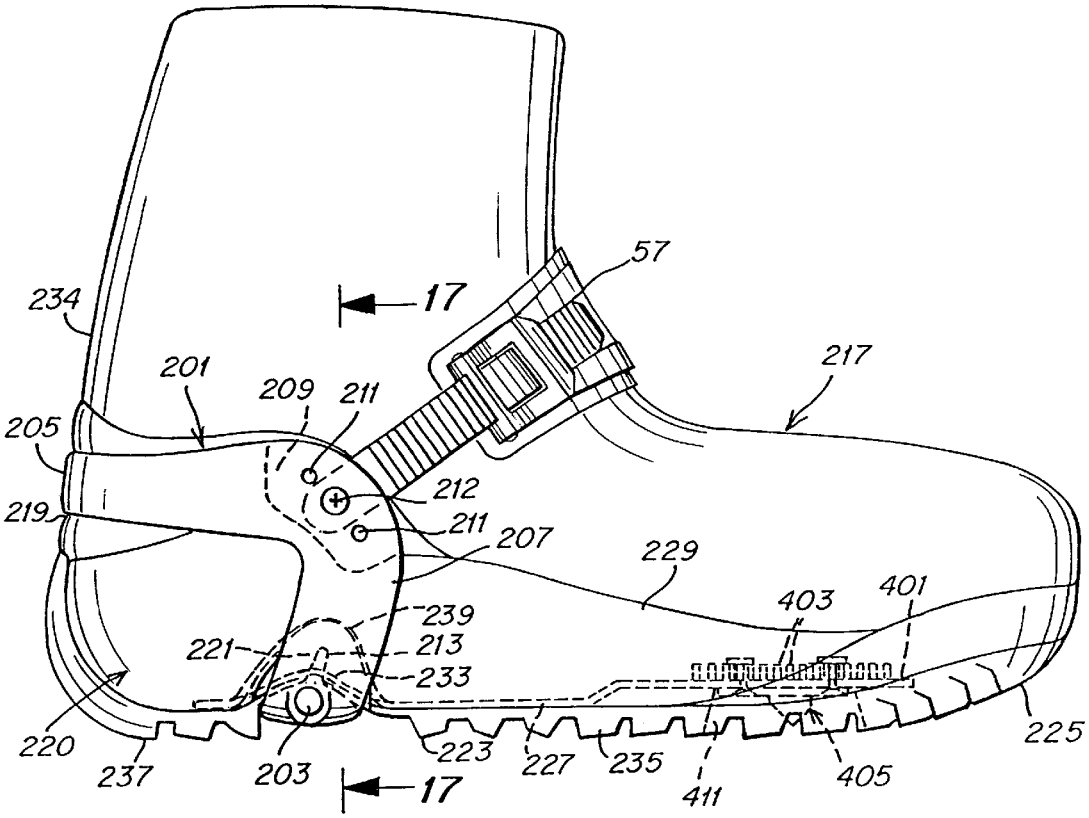
FIG. 16 is a side elevational view of the lateral side of the boot of FIG. 15 with the interface attached thereto.
Figure 17:
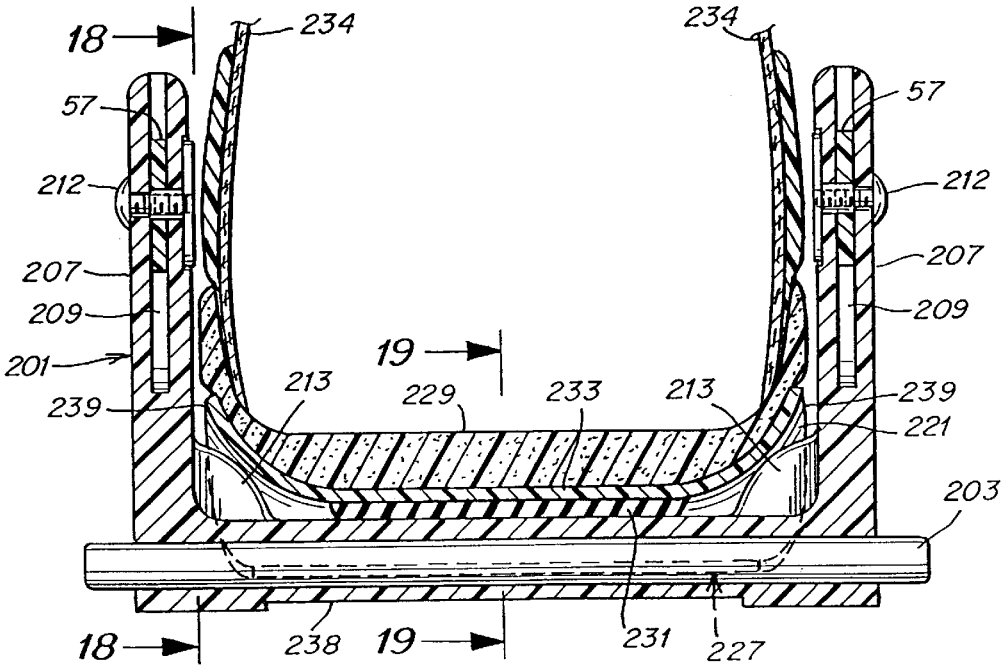
FIG. 17 is a fragmentary cross-sectional view, taken along line 17—17 of FIG. 16, illustrating the engagement between the interface and boot sole of FIG. 15.
Figure 18:
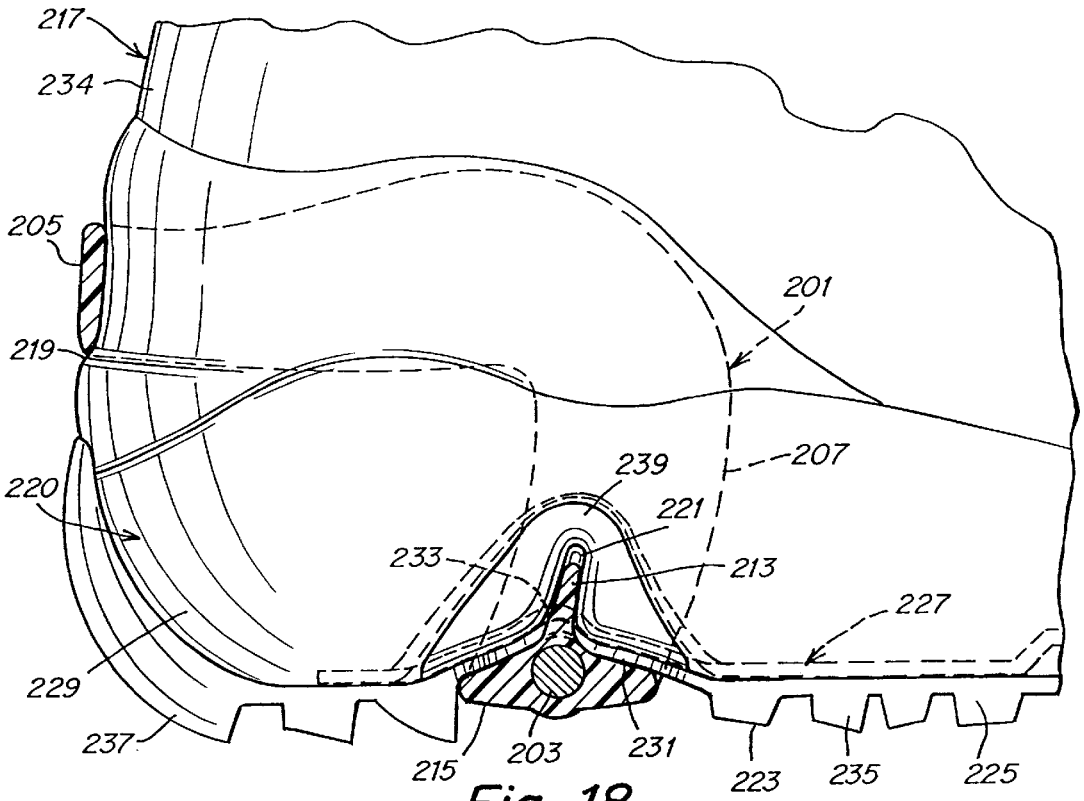
FIG. 18 is a cross-sectional detailed view, taken along line 18—18 in FIG. 17, of the alignment between the interface and the boot of FIG. 15.
Figure 19:
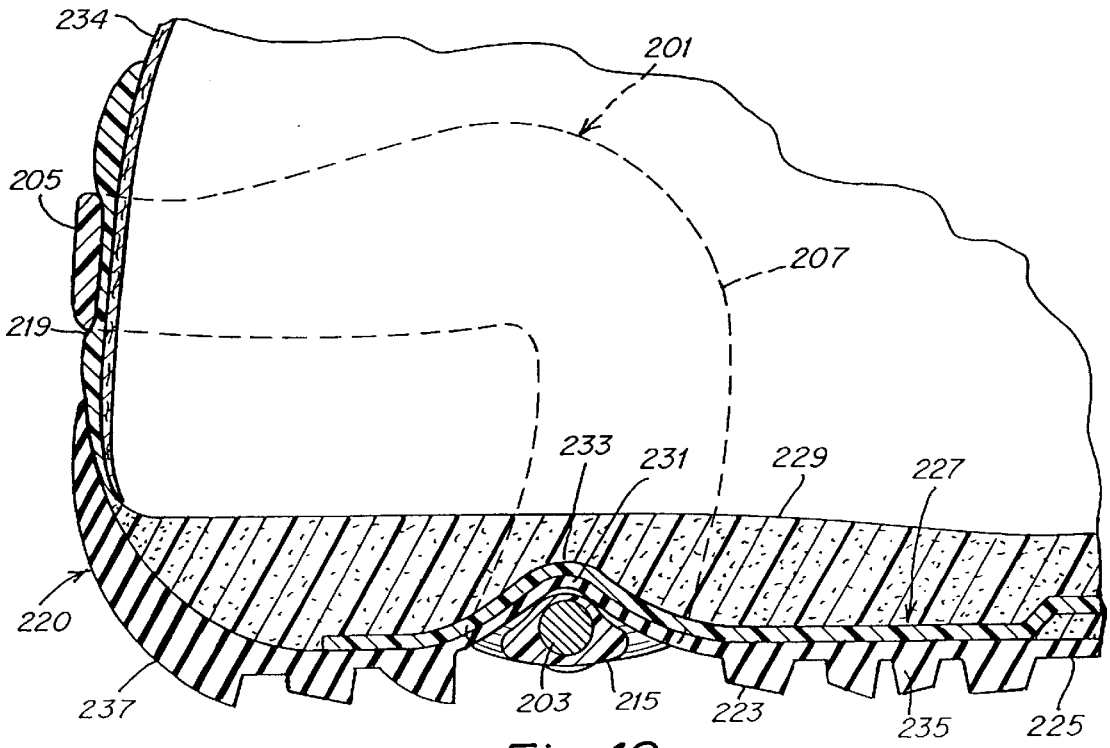
FIG. 19 is a cross-sectional detailed view of the engagement between the interface and boot taken along line 19—19 of FIG. 17.

It should be appreciated that in contrast to the binding disclosed in the '170 patent, the mounting of the high-back in the binding of FIG. 15 without the use of the relatively long arms employed in the '170 patent results in a greater moment being generated on the portion on the binding (i.e., the heel hoop 303) to which the high-back is attached. Thus, in one embodiment of the present invention, the binding 301 is formed of relatively strong material (e.g., aluminum) to resist this greater moment.

Although described in connection with the particular bindings of FIGS. 3 and 15, it should be appreciated that the hinged heel hoop aspect of the present invention can also be employed in connection with other binding designs. Furthermore, although this feature provides the advantages described above, it should be appreciated that the present invention is not limited in this respect, and that alternate binding designs are contemplated that do not employ a hinged heel hoop.

The rear locking mechanism in the binding of FIG. 15 is similar in many respects to that disclosed in the embodiment of FIGS. 3–14, but with additional features, e.g., a single lever 311 and a mechanism for maintaining the rear locking mechanism in a cocked open position. The binding 301 includes a guide 313 that includes a rearwardly extending ramp surface 315 that is similar to the ramped surface 105 (FIG. 9) in the embodiment of the invention described above in connection with FIGS. 3–14. As with the ramped surface 105, the ramped surface 315 provides the advantageous feature of drawing the rider's heel into engagement with the heel hoop 303 of the binding when the rider steps into the binding 301. Furthermore, the binding 301 also includes a pair of engagement cams 317 that are adapted to releasably engage the engagement pin 203 on the interface 201 to lock the heel of the rider's boot 217 into the binding. As with the cam 97 in the embodiment of FIGS. 3–14, the cam 317 can include a scalloped surface 319 to facilitate engagement with the engagement pin 203, although the scalloped surface is not necessary to practice the present invention.

Figure 20:
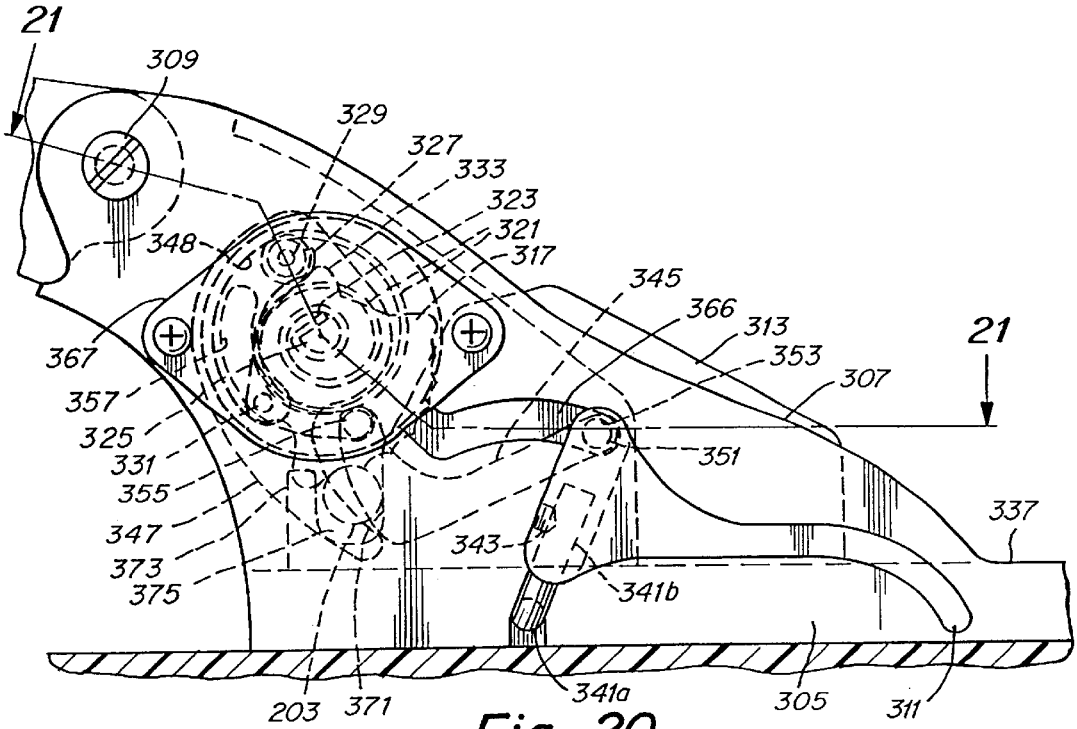
FIG. 20 is a partial side elevational view of the rear locking mechanism of the binding of FIG. 15 taken along line 20—20 of FIG. 15.
Figure 21:
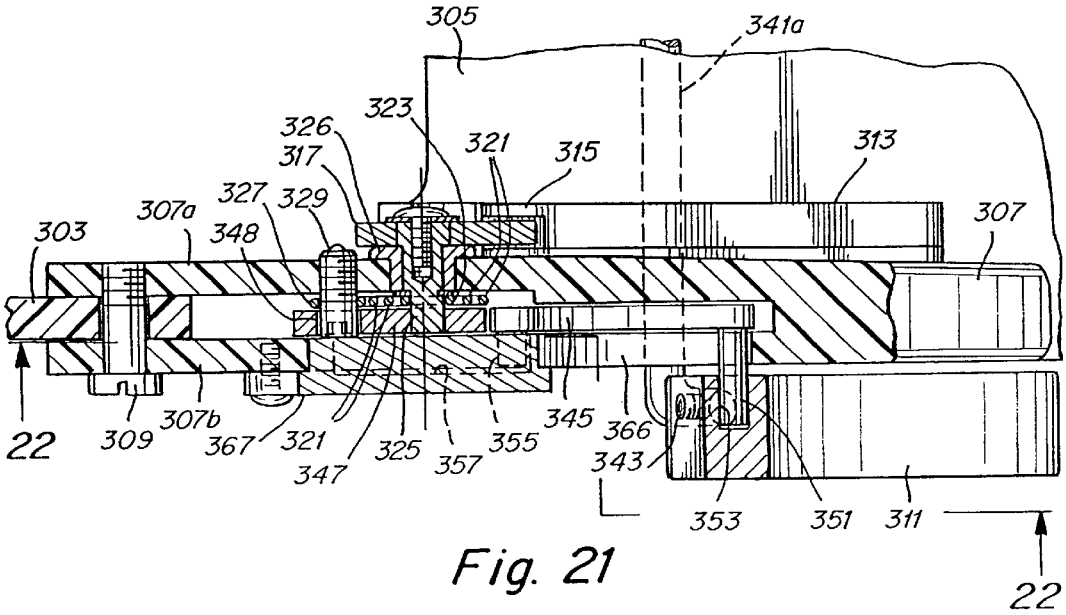
FIG. 21 is a cross-sectional plan view of the rear locking mechanism taken along line 21—21 of FIG. 20.

Like the embodiment of FIGS. 3–14, the engagement cam 317 is biased via a spring 321 (FIG. 20) for rotation (counterclockwise in FIG. 20) into the locked position for engaging with the engagement pin 203. However, unlike the spring 99 (FIG. 7) in the embodiment described above, the spring 321 is arranged to minimize the width of the binding. In this respect, as shown in FIG. 21, the spring 321 is disposed between the inner and outer walls 307*a* and 307*b* of the baseplate sidewalls 307. It should be appreciated that it is desirable to minimize the width of the binding 301. Therefore, as shown in FIG. 20, the spring 321 is wound in a manner that increases the vertical distance over which the spring extends, but not the width across the binding. The spring can obviously be fixed at its ends in any of a number of ways. In the embodiment shown in the drawings, a first end 323 of the spring is attached about a D-shaped shaft 325 to which the engagement cam 317 is mounted in a manner described below. A second end 327 of the spring is wrapped about a ball plunger 329 that is also further described below.

Figure 22:
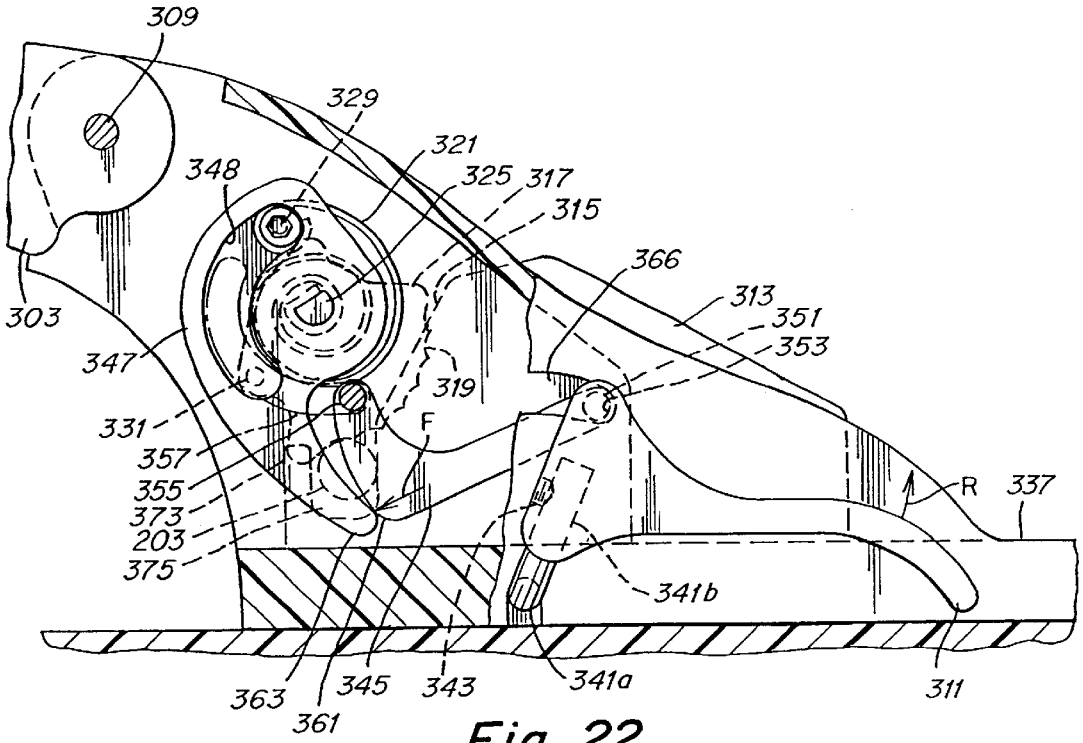
FIG. 22 is a partially broken away side view of the rear locking mechanism taken along line 22—22 of FIG. 21.
Figure 23:
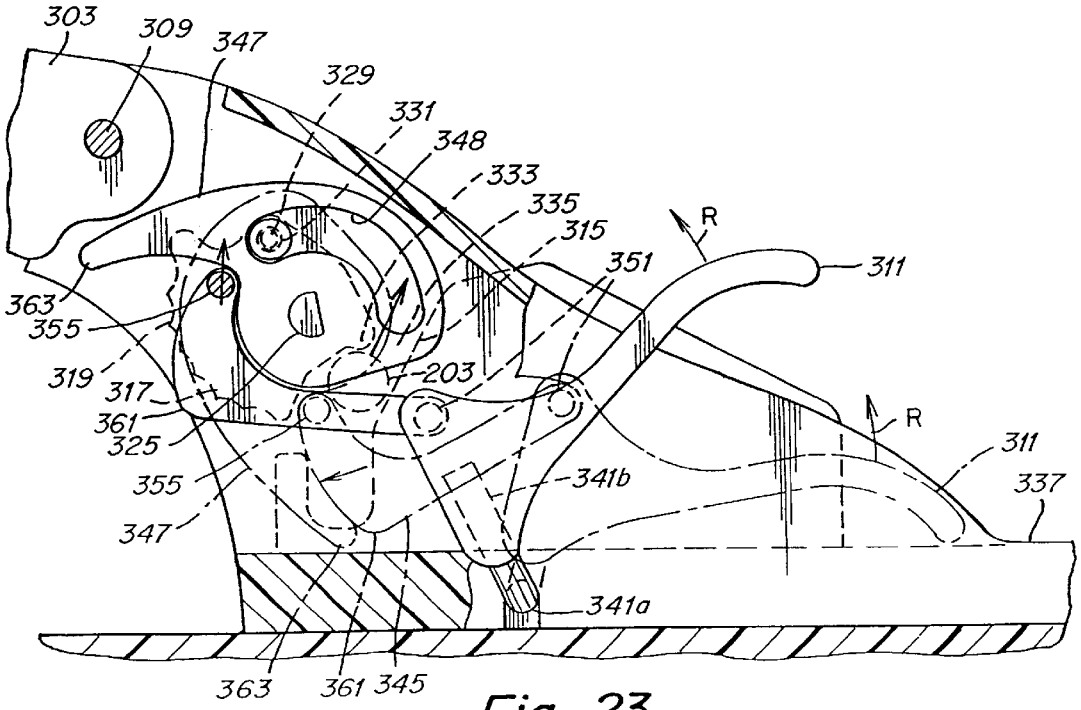
FIG. 23 is a schematic view similar to FIG. 22, but showing the open position of the locking mechanism in solid lines and a partially open position in phantom lines.
Figure 24:
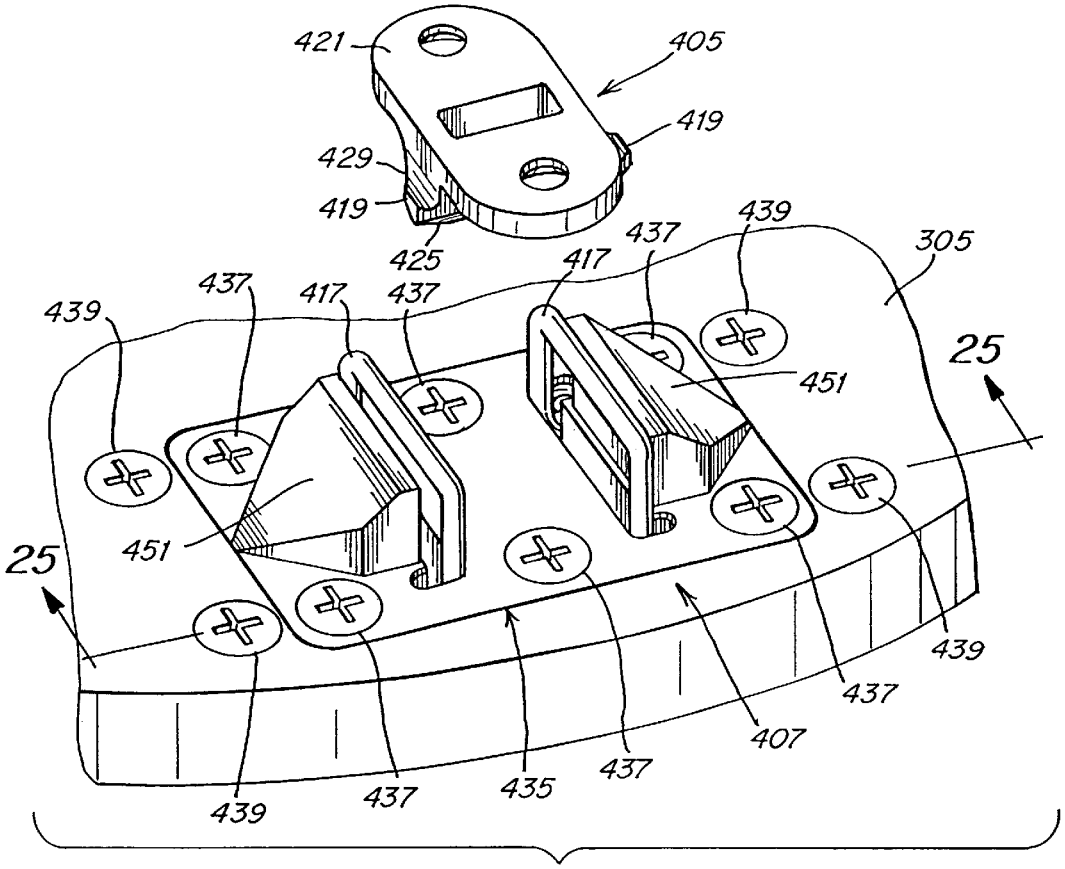
FIG. 24 is an exploded perspective detailed view of the forward engagement mechanisms on the boot and binding of FIG. 15.

As discussed above, in one embodiment of the present invention, a mechanism is provided to maintain the cam 317 in the cocked or release position shown in FIG. 23, so that the rider can initially manipulate the lever in the direction shown by the arrow R in FIG. 23 to place the heel locking mechanism in the open position, can release the lever 311, and can thereafter step out of the heel engaging mechanism whenever convenient. This type of cocking mechanism can obviously be implemented in a number of different ways, and the present invention is not limited to any particular implementation. However, one illustrative implementation is shown in FIGS. 20–23, and includes a ball plunger 329 mounted in the baseplate housing 307. A corresponding detent 331 (FIGS. 20 and 22) is provided on the engagement cam 317 and is adapted to mate with the ball plunger 329 when the cam is moved, via lever 311 and a linking mechanism described below, into the cocked release position shown in FIGS. 23. When the lever 311 is moved into this release position, the corresponding rotation of the engagement cam 317 brings the detent 331 into alignment with the ball plunger 329, thereby automatically engaging the cam 317 with the plunger 329. Thus, when the lever 311 is released, the engagement cam 317 stays in the cocked position shown in FIG. 23. The engagement cam 317 further includes a lip 333 (FIG. 23) that is adapted to cover an opening 335 between the cam and the rearward-facing ramp surface 315 when the cam 317 is in the cocked release position, so that the lip 333 intersects the path long which the engagement pin 203 will pass when stepping out of the binding. Thus, when the rider lifts the heel of the boot out of engagement with the rear latching mechanism, the engagement pin 203 will contact the lip 333, causing the cam to rotate in the counterclockwise direction in FIG. 23, and thereby disengaging the detent 331 from the ball plunger 329. This feature of the illustrative embodiment is advantageous in that when the rider exits from the binding, the rear locking mechanism is automatically returned to the position shown in FIG. 22 and is ready to be stepped into again. If no mechanism was provided for automatically disengaging the detent 331 and the ball plunger 329 upon exit of the engagement pin 203 from the rear locking mechanism, the rider would need to manually manipulate the lever 311 to reset the binding into the locked position.

Although the cocking and release mechanism described above is advantageous, it should be understood that the present invention is not limited to the particular illustrative implementation shown in the drawings, or even to the use of a cocking and release mechanism.

As mentioned above, in one illustrative embodiment of the present invention, a linkage assembly is provided that links together the engagement cams 317 on both the medial and lateral sides of the binding, so that a single lever 311 can be employed to manipulate both cams. This can be accomplished in any of a number of ways, and the present invention is not limited to any particular implementation. However, the illustrative embodiment shown in FIGS. 20–23 takes into account a number of design considerations, and provides a particularly advantageous implementation. A first design consideration is to develop a low profile linkage assembly that does not cause a substantial increase in the thickness of the baseplate 305. In this regard, it should be appreciated that in view of the fact that each of the engagement cams 317 is pivotally mounted to the baseplate about a shaft 325 that is mounted at a height above the top surface 337 of the baseplate, a direct drive linkage assembly cannot be employed because the rider's boot will be disposed in the area about which a direct shaft would extend between the two cams 317. Thus, it is desirable to provide a linkage assembly that bridges the gap between the two engagement cams 317 in a manner that does not substantially increase the profile of the binding 301.

A second design consideration for the linkage assembly relates to the degree of rotation that each of the engagement cams 317 undergoes when moving from the locked position of FIG. to the open or release position of FIG. 23. In this respect, each cam undergoes a range of rotation through approximately 115°. It is desirable to provide a linkage mechanism that does not require that the rider rotate the lever 311 through as great a degree range to move the heel locking mechanism into the released position. A related consideration is that there are some segments of the range of movement for the engagement cam 317 wherein greater torque is desired to be imparted to the cam 317, e.g., when initially moving the cam from the locked position of FIG. 20 wherein it engages the pin 203 and when seating the ball plunger 329 into the detent 331.

One illustrative implementation of a linkage assembly that balances these design considerations in an advantageous manner is shown in FIGS. 20–23. The linkage assembly includes a substantially U-shaped connecting rod 341 having an elongated section 341*a* that passes underneath the upper surface 337 of the baseplate 305 and upstanding sections 341*b* disposed on both the medial and lateral sides of the binding. At least one of the upstanding sections 341*b* is attached on one side of the binding to the lever 311, for example via a set screw 343. It should be appreciated that the binding 301 can be provided with a pair of levers 311, one on each side of the binding, although manipulation of only one of the two levers is necessary in view of the linkage assembly. Alternatively, the handle 311 can be replaced on one side of the binding via a link that couples the connecting rod 341 with the remainder of the linkage assembly discussed below.

The remainder of the linkage assembly on each side of the binding includes two additional components, i.e., an L-shaped link 345 and an apostrophe-shaped cam 347. The apostrophe-shaped cam 347 is directly mounted to the same shaft 325 as the engagement cam 317 that is adapted to engage the engagement pin 203 on the interface. Thus, rotation of the apostrophe-shaped cam 347 causes direct corresponding rotation of the engagement cam 317. The shaft 325 is received through a bushing 326 mounted in the outer housing wall 307*a*.

The lever 311, or a corresponding link that replaces it on one side of the binding, pivots about a pivot axis defined by the elongated section 341*a* of the connection rod. The L-shaped link is attached to the lever 311 via a pin 351, which can be attached to the lever in any number of ways, for example via the use of a socket 353 (FIG. 21). The remainder of the L-shaped link 345 is free floating, and is not rigidly fixed to any other component of the linkage assembly. However, the L-shaped cam does include a nub 355 that is adapted to be received in a track 357 within the outer housing wall 307*b*, or a cover plate 367 described below. Engagement between the track 357 and the nub 355 merely maintains the L-shaped cam in the proper orientation for bearing on the apostrophe-shaped cam 347 through the entire pivoting range for the lever 311. It should be appreciated that the orientation of the L-shaped cam 345 can be maintained in numerous other ways, and that the present invention is not limited to the particular implementation shown in the drawings.

The manner in which the engagement between the L-shaped link 345 and the apostrophe-shaped cam 347 achieves the above-described goals of varying the amount of torque and rotation imparted to the engagement cam 317 will now be described. When the heel locking mechanism is in the locked position shown in FIGS. 20 and 22, the cam 317 is in engagement with the engagement pin 203 of the interface. Thus, to open the latching mechanism, a relatively high moment arm is initially desired to overcome the frictional engagement between the cam 317 and the engagement pin 203. The illustrative embodiment of the linkage assembly accomplishes this result because when the latching mechanism is in this closed position, rotation of the lever 311 in the counterclockwise direction of FIG. 22 is translated to a pushing force F (FIG. 22) generated by the heel end 361 of the L-shaped link 345 on the tip 363 of the apostrophe-shaped cam 347. Since the tip 363 of the apostrophe-shaped cam 347 is disposed a relatively large distance from the shaft 325 about which the cams 347 and 317 rotate, a relatively high moment arm is generated through actuation of the lever 311, thereby assisting in initially disengaging the cam 317 from the engagement pin 203.

As discussed above, after the engagement between the cam 317 and the engagement pin 203 is initially broken, it is desirable to reduce the moment arm generated on the shaft 325 to achieve a higher rate of rotation for each increment of rotation of the lever 311. The manner in which this is achieved in the illustrative implementation of the linkage mechanism is shown in FIG. 23. In FIG. 23, the lever 311 and L-shaped link 345 are shown in phantom at a transition point, wherein engagement between the L-shaped link and the apostrophe-shaped cam is switching from the heel end 361 of the L-shaped link to the toe end adjacent the nub 355. As shown in FIG. 23, this switching of the engagement corresponds to a significantly smaller moment arm about the shaft 325 as the toe end of the L-shaped link that takes over the action of pushing the apostrophe-shaped cam acts on a portion of the apostrophe-shaped cam 347 that is closer to its pivot axis 325. Thus, less rotation of the lever 311 is required to achieve the desired greater rotation of the apostrophe-shaped cam 347 and the engagement cam 317 directly driven thereby.

As discussed above, it is desirable to increase the moment generated on the apostrophe-shaped cam 347 as it nears its fully open position of FIG. 23 to assist in setting the spring ball 329 in the detent 331. This is achieved in the illustrative embodiment of the linkage assembly via the arrangement of the lever 311 and the L-shaped link 345, and through the use of toggle joint principles. It should be appreciated that two line segments can be drawn from the point wherein the pin 351 attaches the L-shaped link 345 to the lever 311. A first segment passes through the pivot point of the lever defined by the elongated section 341*a* of the connection rod, and a second passes through the nub 355 at the toe end of the L-shaped link. It should be appreciated that according to toggle joint principles, as these two line segments begin to straighten out such that the angle between them approaches zero, the amount of torque generated on the apostrophe-shaped cam 347 through its engagement at the toe edge of the L-shaped link 345 greatly increases, becoming a multiple of the torque exerted by the lever 311. Thus, although the distance from the rotation axis 325 does not increase for the point at which the torque is applied to the apostrophe-shaped cam 347, the moment generated on the apostrophe-shaped cam 347 greatly increases with the applied torque. This increase in torque begins when the angle between the two line segments approaches approximately 7°, achieves a significant multiple when the angle approaches 3°.

In the illustrative embodiment of the present invention described in connection with FIGS. 20–23, both sides of the heel locking mechanism are substantially identical, such that each side is provided with a spring 321 that biases its corresponding engagement cam 317 into the closed position, and each side includes the spring ball 329 and detent 331 arrangement for maintaining the locking mechanism in the open position. It should be appreciated that the present invention is not limited in this respect, and that these components of the locking mechanism can be provided on only one side of the binding, along with a linkage assembly that constrains both cams to have the same rotational orientation, such that rotation of one of the engagement cams 317 necessarily causes an identical amount of rotation for the other cam 317. However, the aspect of the present invention wherein the engagement cams 317 are independently biased is advantageous. In particular, the engagement cams 317, like the cams 97 discussed above in connection with the embodiment of FIGS. 3–14, have a geometry that provides the locking mechanism with a self-tightening feature in the event that an accumulation of snow develops under the sole of the boot or the engagement pin 203. By employing independently active engagement cams 317, the embodiment of the present invention shown in FIGS. 15–21 enables both sides of the binding to be locked independently, even if an accumulation of snow is present on one side of the binding and not the other. If the engagement cams 317 were directly mounted to one another and constrained to have the same rate of rotation, if an accumulation of snow developed under the engagement pin 203 on only one side of the binding, both engagement cams 317 would not rotate to their fully closed position, resulting in an undesirable loose connection on the side of the binding without the accumulation of snow. In contrast, the illustrative embodiment of the present invention shown in the drawings advantageously securely engages the engagement pin 203 on both sides of the binding, even if doing so requires independent positioning of the engagement cams 317.

In the illustrative embodiments shown in the drawings, the baseplate sidewalls 307 include a slot 366 (FIG. 15) that enables the pin 351 (FIG. 21) that interconnects the lever 311 and the L-shaped link 345 to move through the required range of motion as the lever 311 is moved between the closed and open positions. As discussed above, a similar slot or opening 357 (FIG. 21) can also be provided in the sidewall 307 to accommodate the nub 355 at the toe end of the L-shaped link 345. In the illustrative embodiment shown, a cover plate 367 is provided and includes the slot 357 on its interior surface. The sidewall 307 of the baseplate can simply be cut away in this area to enable access between the nub 355 and the slot 357. However, it should be appreciated that this aspect of the locking mechanism can be implemented in numerous other ways. For example, the lever 311 can simply be provided in an opening between the inner and outer sidewalls 307*a* and 307*b* of the baseplate, such that the slot 366 in the outer sidewall 307*b* would not be necessary. In addition, the slot 357 for receiving the nub 355 can be provided directly in the sidewall 307 of the baseplate. A cover can optionally be provided to overlie the slot, or the slot can be left exposed to the side of the binding. The present invention is not limited to any particular implementation in this regard.

As shown in FIGS. 20 and 22, the engagement pin 203 is constrained in the locked position not only by the engagement cam 317, but also by the rear surface 371 of the guide 313, and a rear retaining tab 373 extending upwardly from the bottom surface 337 of the baseplate. As shown in FIGS. 20 and 22, when in the fully locked position, a space 375 is provided between the bottom of the engagement pin 203 and the bottom of the channel that receives it. This space is advantageous in that if the rider lands a jump or a compression force is otherwise applied in the heel area of the boot, the engagement pin 203 can be forced deeper into the channel 375 as the sole of the boot compresses. Therefore, the engagement pin 203 will not dig into the heel of the rider and create an uncomfortable pressure point. The scalloped surface 319 of the cam 317 is arranged to rotate further in the clockwise direction of FIG. 20 if the engagement pin 203 drops into the channel 375, but will not further tighten down the engagement of the engagement pin 203.

As with the embodiment of FIGS. 3–14 described above, it should be appreciated that some mechanism should be provided for limiting the rotation of the engagement cams 317 and the lever 311 once the binding is in fully closed position. This can be accomplished in any number of ways, and the present invention is not limited to any particular implementation. For example, a stop can be provided on the outside of the binding housing 307*a* to limit the rotation of the lever 311, on the inside of the housing 307*b* to limit the rotation of the engagement cams 317 or the apostrophe-shaped cams 347, or a stop can be provided to directly limit the rotation of the shaft 325. In one embodiment of the invention, the rotation stop is provided by engagement between the shaft of the spring ball plunger 329 and the slot 348 in the apostrophe shaped cam 347 that receives the plunger 329.

The illustrative embodiment of the present invention shown in FIG. 15 also includes an alternate strapless forward engagement system for holding down the toe-end of the boot. In the embodiment of the invention shown in the figures, the strapless forward engagement system is disposed forward of the arch area of the boot 217, and underlies a toe area of the boot 217. As shown in FIG. 15, the shank 227 includes a forward section 401 that is reinforced by a plurality of ribs 403 to receive a hook 405 for engagement with a corresponding engagement mechanism 407 mounted on the baseplate 305. The hook 405 can be mounted to the shank 227 in any of a number of ways, including through the use of a pair of screws 409 and nuts 410 as shown in FIGS. 15 and 25.

The illustrative toe hook and active locking mechanism of FIG. 15 is shown in greater detail in FIGS. 24–31. This arrangement achieves the primary design objectives of being easy to step into and out of. As is described in greater detail below, the toe engagement mechanism can be stepped into by simply stepping the toe portion of the boot straight down into the engagement mechanism on the binding. This stepping in automatically (i.e., without requiring that the rider manipulate a lever or take any action other than stepping the boot into the binding) causes the active locking mechanism to move between an open position and a closed position wherein the active locking mechanism automatically engages the toe hook. After the mechanism is engaged, no amount of lifting force generated on the toe end of the boot will result in disengagement. However, when the rider desires to step out of the binding, all that is required is that the rider first lift the heel of the boot out of engagement with the rear engagement mechanism, and then simply roll the boot forward and lift the toe end out of engagement with the locking mechanism. This stepping out action automatically (i.e., without requiring that the rider manipulate a lever or take any action other than stepping the boot out of the binding) causes the active locking mechanism to move from the closed position to the open position wherein the active locking mechanism automatically disengages the toe hook. Thus, this toe locking mechanism is advantageous in that it is easy to get into and out of and does not require that a lever or any actuation mechanism be manipulated to lock or release the mechanism.

Figure 25:
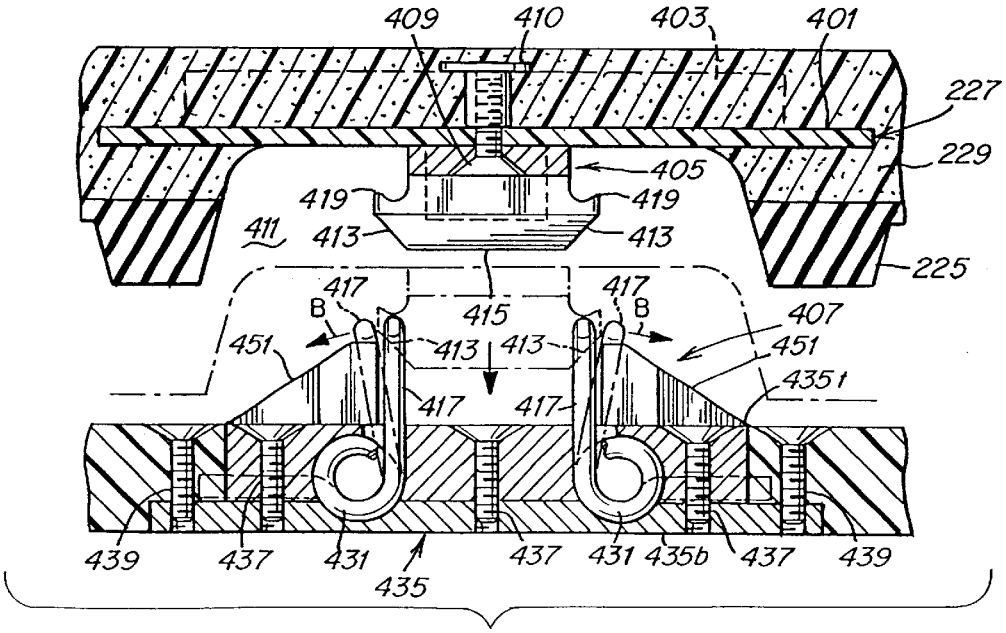
FIG. 25 is a cross-sectional view taken along lines 25—25 of FIG. 24, showing the toe hook mechanism of the boot and binding of FIG. 15.

As shown in FIG. 25, the outer sole 225 of the boot is provided with a recess 411 to expose the toe hook 405. It should be appreciated that the recess can be any shape. The recess 411 can be confined solely to the area of the boot surrounding the toe hook 405, and need not extend to the outer surface of the outer sole 225 either on the lateral sides of the boot or toward the front of the boot. However, the present invention is not limited in this respect, as the recess 411 can have any geometry that exposes the toe hook 405. The toe hook forms a cleat that extends downwardly from a base 421 (FIG. 24) mounted to the sole of the boot. As used herein, the reference to a base is intended to merely indicate a portion of the cleat that is mounted to the sole of the boot (or the binding if the locking mechanism is reversed as discussed below), and is not limited to any particular mounting structure. The cleat portion of the toe hook 405 is wedge-shaped and includes a pair of camming sections 413 that taper along the medial and lateral sides of the cleat from a wider base-end (i.e., top in FIG. 30) portion 418 to a narrower free-end (i.e., bottom in FIG. 30) portion 415.

Figure 26:
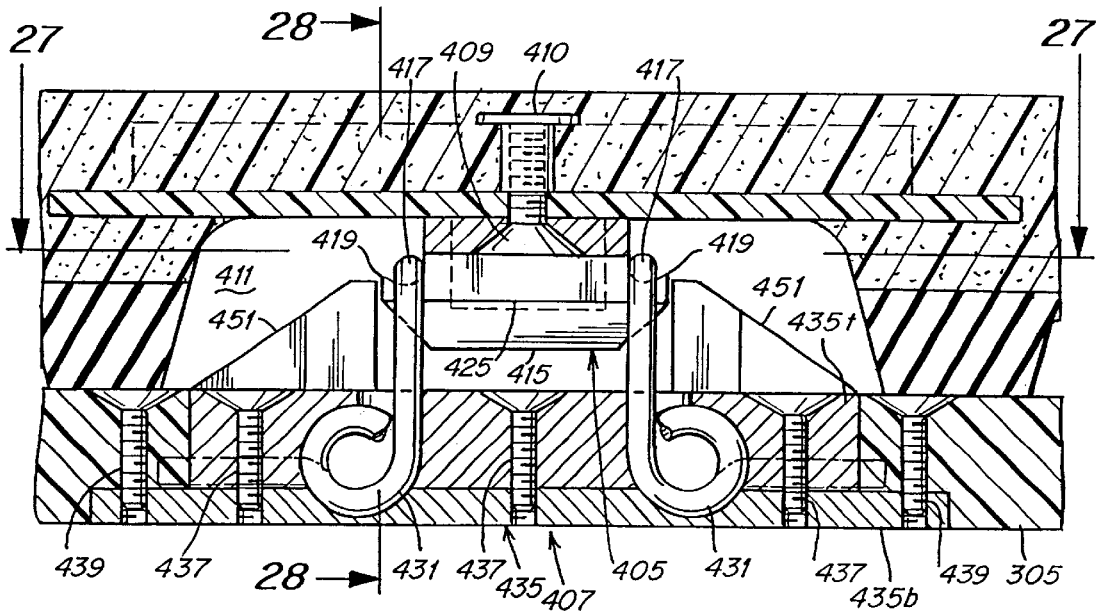
FIG. 26 is a cross-sectional view similar to FIG. 25, but with the toe-hook on the boot fully engaged with the engagement mechanism on the binding.
Figure 27:
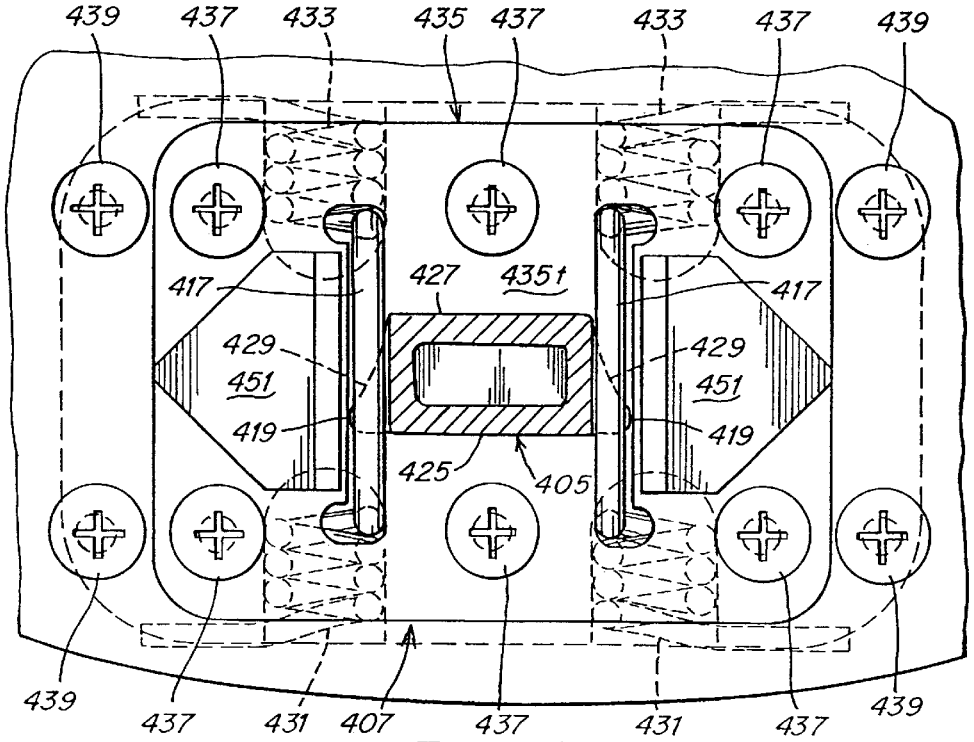
FIG. 27 is a cross-sectional plan view of the forward engagement mechanism taken along line 27—27 of FIG. 26.
Figure 28:
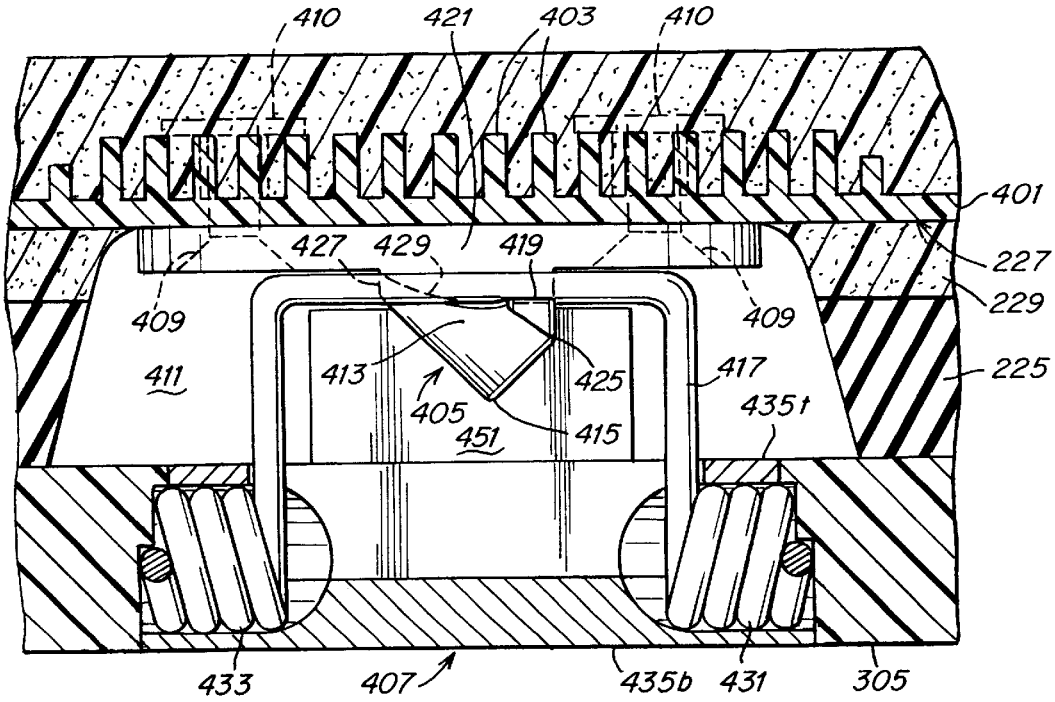
FIG. 28 is a cross-sectional side view of the forward engagement mechanism taken along line 28—28 of FIG. 26.

The locking mechanism on the baseplate 305 includes a pair of spaced apart loops 417, biased for movement toward each other, that are respectively adapted to engage with the two lateral sides of the toe hook 405. As shown in FIG. 25, the toe hook 405 is engaged with the locking mechanism 407 by the rider simply stepping down into the binding with the toe hook 405 aligned with the locking mechanism 407. The wider base-end portion 418 of the cleat portion of the toe hook 405 is wider than the spacing between the biased loops 417, while the narrower free-end portion 415 is narrower than this spacing. Thus, as the toe hook 405 is brought down into engagement with the locking mechanism, the cammed surfaces 413 automatically spread the biased loops 417 apart in the direction shown by the arrows B in FIG. 25. As shown in FIG. 25, the toe hook 405 includes a pair of upwardly facing shelves or hook portions 419 on each lateral side thereof. Once the toe hook is advanced sufficiently down into engagement with the locking mechanism so that biased loops clear the top of the hooks 419, the biased loops move inwardly to capture the hook portions 419 as shown in FIG. 26, thereby locking the toe portion of the boot to the baseplate 305. In this respect, as shown in FIG. 25, hook portions 419 are curved toward the base 421 (upwardly in FIG. 30) at the outer side edges. Therefore, a lifting force generated on the toe hook 405 actually acts to seat the biased loops 417 deeper into the hook portions 419, rather than acting to cause a release of the locking mechanism.

Figure 30:
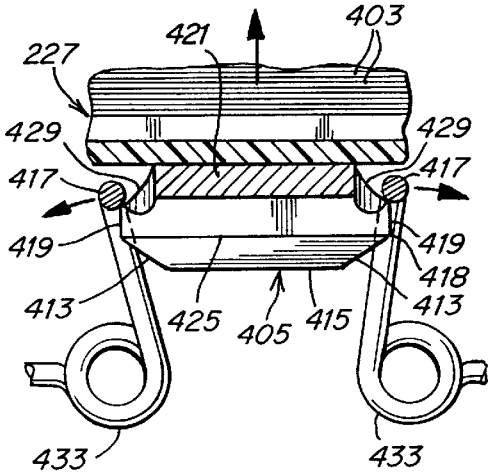
FIG. 30 is a schematic cross-sectional front view of the toe hook releasing from the latching mechanism.
Figure 31:
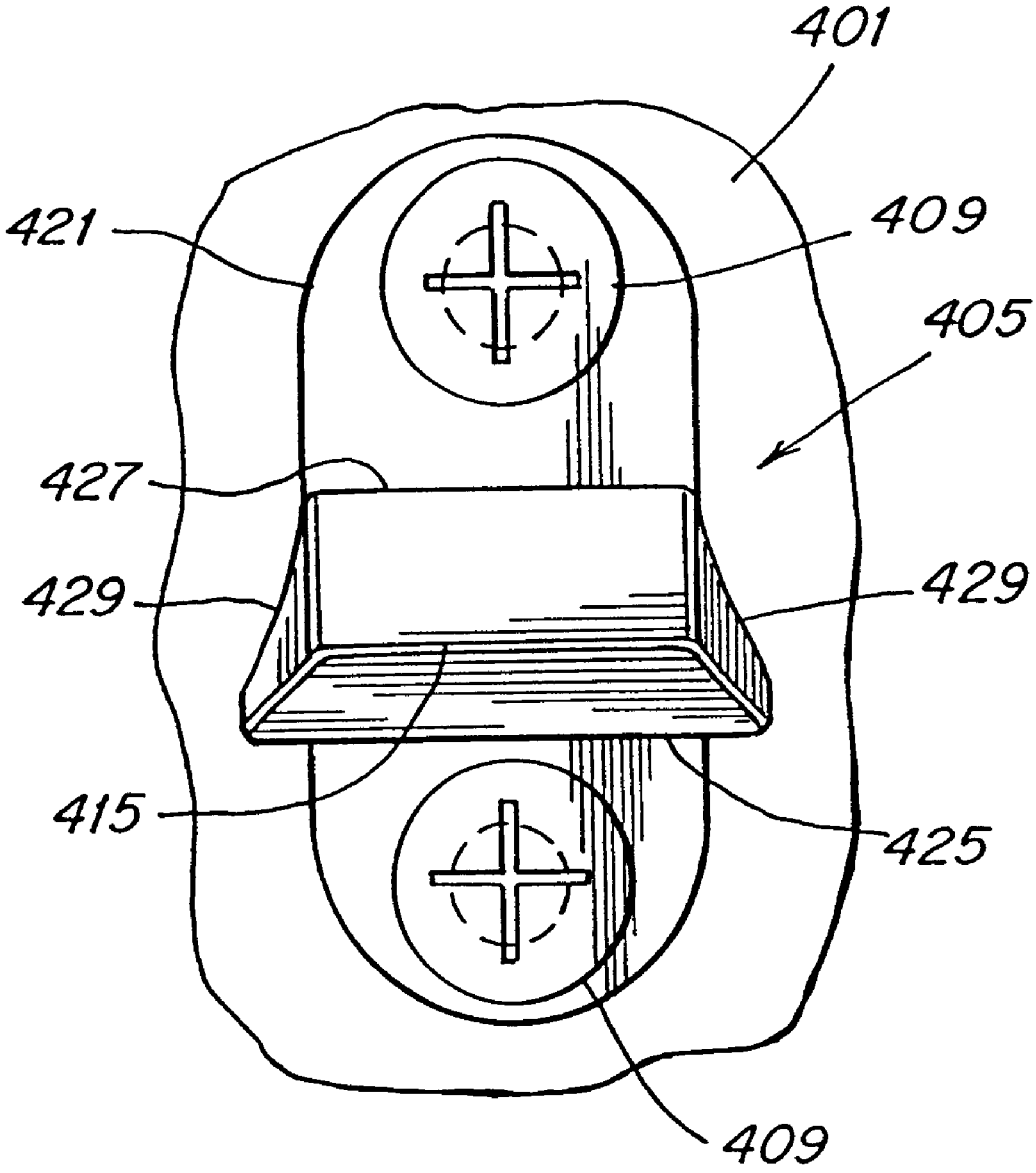
FIG. 31 is a bottom plan view of the toe hook mechanism of FIG. 15.

The toe hook 405 is provided with a geometry that facilitates disengagement with the locking mechanism 407 by the rider simply lifting the heel of the boot away from the surface of the baseplate 305. This geometry is shown in FIGS. 28–31. The toe hook extends downwardly from a base 421 (FIG. 24) to a lowest tip 415. A cleat portion of the toe hook 405 tapers from its toe edge 425 to the bottom tip 415. The cleat further tapers from its heel edge 427 to the tip 415, giving the cleat a wedge or V-shaped appearance in the cross-sectional view shown in FIG. 28. Finally, the cleat also tapers from a greatest width at its toe edge 425 to a thinnest width at its heel edge 427 as best shown in FIG. 31.

Figure 29:
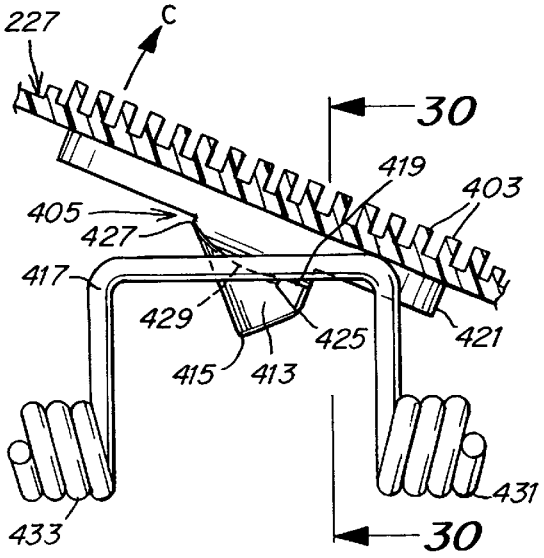
FIG. 29 is a schematic side view of the toe hook of FIG. 15 releasing from the toe hook mechanism.

As a result of the tapering in the width of the cleat from its front 425 to its rear 427, disengagement of the toe hook 405 from the locking mechanism is easily achieved by the rider simply lifting the heel edge of the boot and rolling the foot forward in the direction of arrow C as shown in FIG. 29. The rear edge 427 of the cleat has a width that is less than the spacing between the biased loops 417 when they are in the locked position shown in FIG. 26, whereas the front edge 425 of the cleat has a greater width than the biased loops when in this locked position. Thus, when the heel of the boot is lifted as shown in FIG. 29, the rearward portion of the tapered side edges 429 of the cleat wedge between the biased loops 417. As the heel of the boot is continually lifted and rolled forward, the tapered sides 429 of the cleat wedge the biased loops 417 apart, enabling the hook portions 419 (FIG. 26) of the toe hook to be disengaged from the biased loops as shown in FIG. 30.

Three characteristics of the toe hook 405 and latching mechanism 407 contribute to the mechanism resisting release as a result of lifting forces generated on the toe section of the boot during riding, while facilitating easy release by lifting the heel of the boot. First, the above-described geometry of the hook portions 419 that act to seat the biased loops 417 deeper in response to a lifting force. Second, as shown in FIG. 31, the cleat portion of the toe hook 405 is wedged facing the back of the boot, but not the front, so that the above-described wedging action would not take place in response to a lifting force generated at the toe end of the boot. Third, the front edge 425 of the cleat terminates at the widest point of the wedging surfaces 429, thereby facilitating full release of the hook portions 419 from the biased loops 417 that have been spread apart by the wedged surfaces 429. Fourth, and perhaps most importantly, since the heel end of the boot will be locked into engagement with the rear latching mechanism of the binding while riding, it will not be possible for the boot sole to achieve anything approaching the angle shown in FIG. 29 while pivoting back on the heel end of the boot. Therefore, although not desirable, the cleat could potentially be provided with a taper also extending to the forward section of the boot and still resist release upon a lifting force at the toe end. In this respect, although some wedging action might begin in response to a lifting force at the toe, the sole of the boot should not be able to attain the angle necessary to cause separation of the biased loops 417 and a release of the toe hook mechanism.

It should be appreciated that the toe hook 405 and the biased loops 417 will be used to resist lifting forces generated on the toe end of the boot during riding and should be formed from materials that are sufficiently strong to withstand these forces. These components can be formed from any of a number of different materials, such as stainless steel or hardened steel. Alternatively, the toe hook 405 could be molded from a suitable material (e.g., glass-filled nylon, polycarbonate, TPU, etc.).

It should further be appreciated that it is desirable for the toe hook 405 to not provide any pressure point or area of discomfort for the rider when walking. Thus, in one embodiment of the invention, the toe hook 405 is sized so that it does not protrude below the outer boot sole.

Although the particular geometry of the illustrative embodiment shown in the FIGS. provides the advantages described above, it should be appreciated that the present invention is not limited in this respect, and that other implementations are possible.

The biased loops 417 can be implemented in any of a number of ways, and the present invention is not limited to any particular implementation, including the one shown in the drawings which is provided merely for illustrative purposes. Each biased loop 417 in the illustrative embodiment shown in the drawings is implemented via a spring coiled at front 431 and rear 433 sections of the engagement mechanism in 407, and each extends in the heel-to-toe direction along the binding 301 (FIG. 15). The springs can be provided in a housing 435 including top and bottom sections 435t and 435b attached by a plurality of screws 437. The entire housing can then be attached to the baseplate 305 via an additional set of screws 439. To provide increased resistance to lifting forces, the housing 435 can be formed from a strong material, such as aluminum, stainless steel or hardened steel. Alternatively, the components of the engagement mechanism 407 can be attached directly to the baseplate 305, without the use of the housing 435.

It should be appreciated that during riding, lateral forces may be exerted on the snowboard boot 217 that may cause the toe end to shift laterally from side-to-side. To inhibit such lateral migration from causing an inadvertent disengagement of the toe hook 405 from the engagement mechanism 407, in one embodiment of the present invention, the engagement mechanism is provided with a pair of blocks 451, one disposed outside and adjacent each of the biased loops 417. The blocks 451 are formed of substantially rigid material and are sufficiently strong to resist lateral movement of the toe hook 405 after it is engaged with the biased loops 417. The blocks 451 are spaced sufficiently far apart to enable the widest surface 425 (FIG. 31) of the toe hook to be disposed therebetween, but are sufficiently close so as to prevent enough lateral migration of the toe hook 405 to cause either of the hook portions 419 (FIG. 26) to become disengaged from its corresponding biased loop 417. In addition, as shown in FIG. 25, the blocks 451 are sized and arranged so that the biased loops 417 can flex over and around them when spread apart by the toe hook cleat entering or exiting the engagement mechanism 407. For example, the blocks 451 have a length in the heel-to-toe direction that is less than a length of the biased loops 417.

It should be appreciated that the latching mechanism 407 is not limited to using the pair of blocks 451, as the same function can be accomplished in other ways. For example, only one biased loop 417 and accompanying block 451 could be provided, along with a rigid loop on the opposing side. Furthermore, the arrangements of the toe hook 405 on the boot and the engagement mechanism 407 on the binding can obviously be reversed, such that the baseplate 305 of the binding can be provided with a toe hook such as 405, and the snowboard boot can be provided an engagement mechanism such as 407.

As discussed above, the present invention is not limited to any particular engagement mechanism for engaging the toe-end of the binding. A number of alternate strapless engagement members will now be discussed below.

Figure 32:
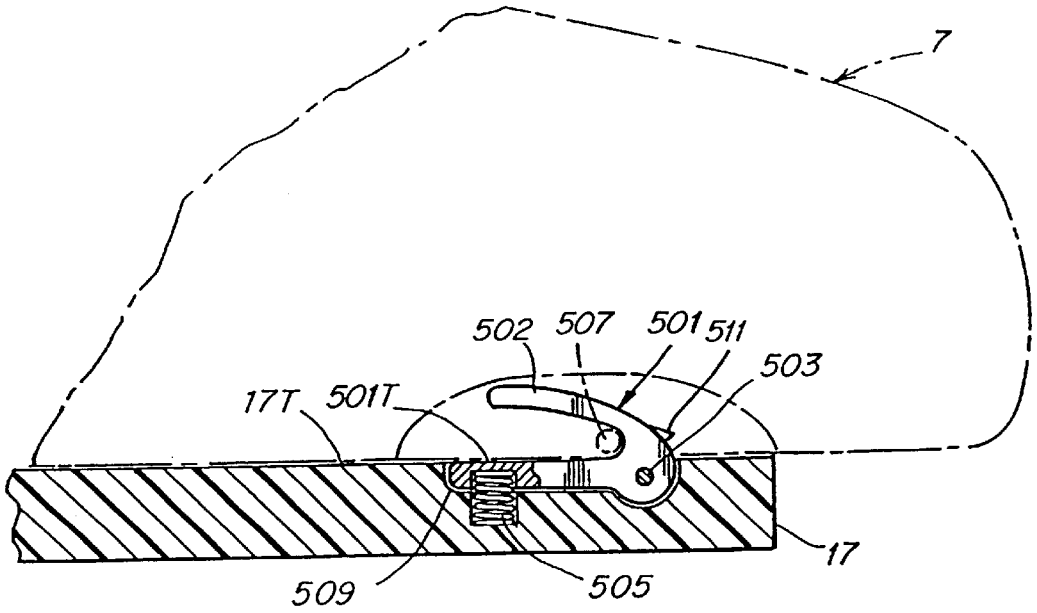
FIG. 32 is a side schematic representation of an alternate embodiment of an active toe hook locking mechanism.

An alternate embodiment of the strapless engagement member is disclosed in FIG. 32. In this embodiment of the invention, the forward engagement member 501 includes a hook portion 502 that is similar in many respects to the hook 61 discussed in the embodiment of FIG. 3, but is oriented so that it faces the heel section of the binding. As discussed above, this embodiment provides the advantageous feature that the boot is firmly seated between the high-back (e.g., 67 in FIG. 3) and the engagement member 501. However, it should be understood that in view of the heel hoop and high-back disposed at the heel of the binding, it may be difficult for the rider to place the heel of the boot down flush against the base plate 17, and then slide the boot forward so that the mating feature disposed on the sole can engage with the engagement member 501. In fact, when the boot is seated back against the high-back 67, the mating feature in the boot sole should be fully engaged with the hook 502, without having to be moved forward, as this corresponds to the position of the boot in the binding when riding. Thus, the embodiment of the invention disclosed in FIG. 32 provides a rear-facing engagement member 501 that is biased to facilitate engagement with the boot.

Figure 33:
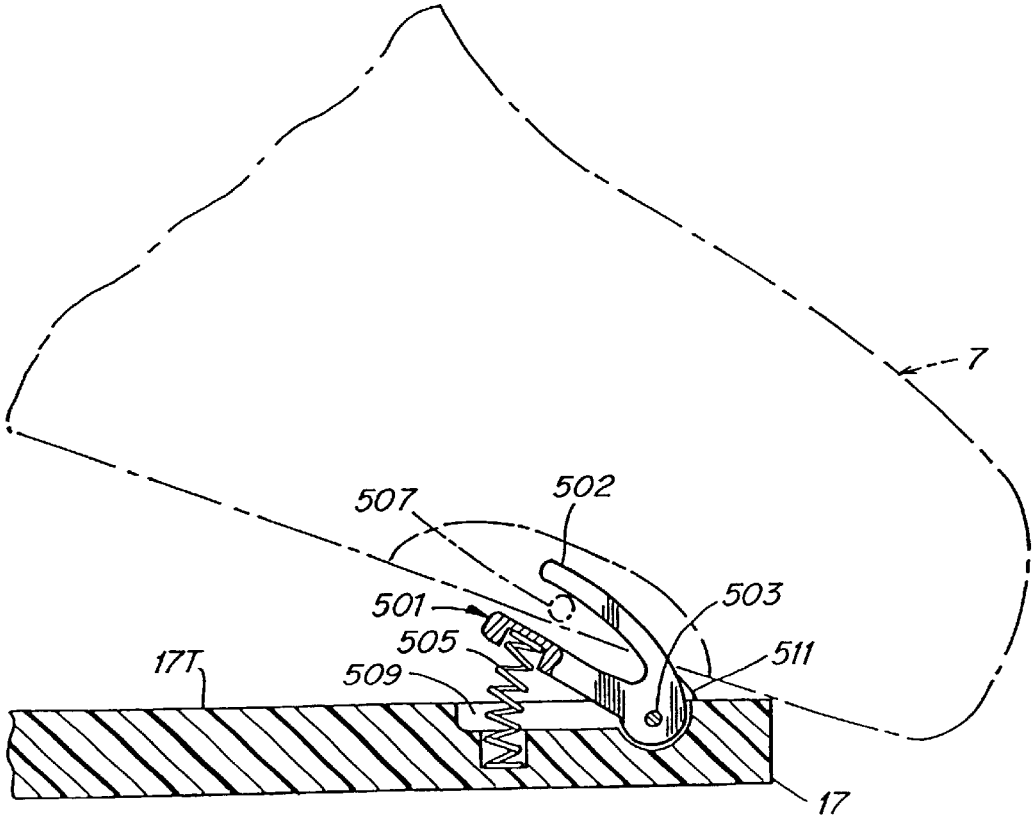
FIG. 33 is a side schematic representation of the boot stepping into the toe hook locking mechanism of FIG. 32.

As shown in the cross-sectional view of FIG. 32, the biased engagement member 501 is mounted to the base plate 17 via a hinge pin 503 that is embedded in the base plate 17 in any of a number of ways, examples of which are discussed below. The binding includes a spring 505 that biases the engagement member 501 for rotation upwardly about the axis defined by hinge pin 503. Thus, when stepping into the binding, the rider angles the boot in the manner shown in FIG. 33, such that the toe portion is lower than the heel portion. The biasing spring 505 causes the engagement member 501 to be angled upwardly in a position that facilitates entry of the mating feature 507 on the boot sole (which can be implemented in any number of ways as discussed below) under the hook 503. The rider can then bring the boot heel down into engagement with the rear portion of the binding, overcoming the force of the spring 505. As shown in the cross-sectional view of FIG. 32, the base plate 17 may include a recessed portion 509 underlying the bottom portion of the engagement member 501, such that when the rider has stepped into the binding, a top surface 501T of the engagement member disposed below the hook 502 lies flush with a top surface 17T of the base plate. In addition, the engagement member 501 may include a stop 511 that is adapted to engage with base plate 17 to limit rotation of the engagement member 501.

As mentioned above, the biased engagement member 501 can be mounted to the base plate for rotation in any of a number of ways. The present invention is not limited to any particular implementation. For example, the hinge pin 503 can be implemented with a rivet that is embedded in the base plate. Alternatively, the hinge pin 503 can be molded into the base plate 17, and the engagement member 501 can be provided with a slot for allowing it to be snapped onto the hinge pin 503.

Several illustrative implementations of the mating member on the boot for engaging with the strapless forward engagement member on the binding will now be described. It should be understood that the mating member can have any of a number of configurations and can be attached to the boot in numerous ways. The present invention is not limited to the particular implementations discussed below, which are provided merely for illustrative purposes.

Figure 34:
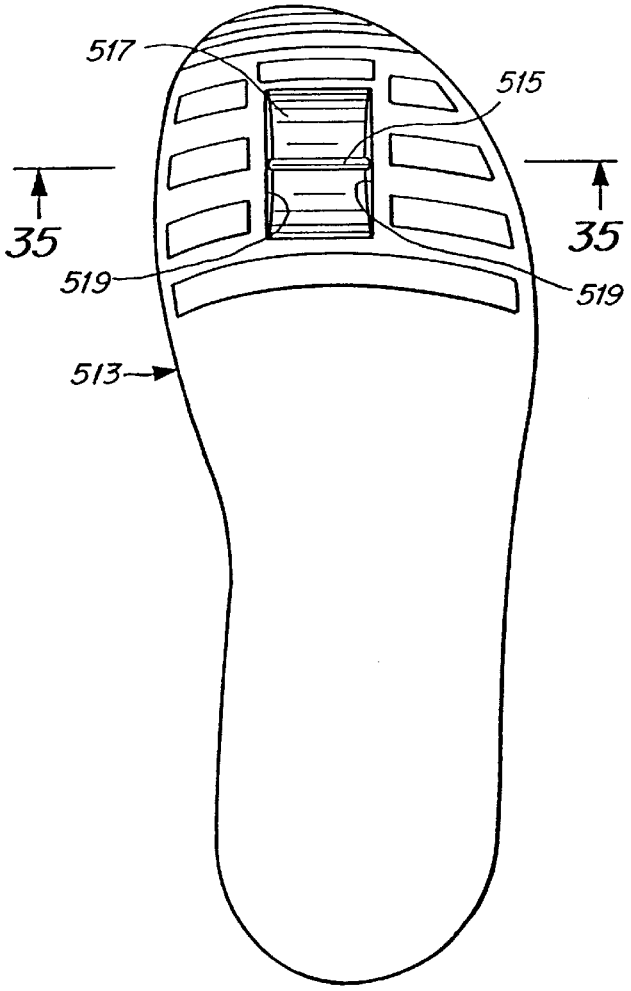
FIG. 34 is a bottom schematic representation of a boot including an engagement member for a toe hook locking mechanism.
Figure 35:
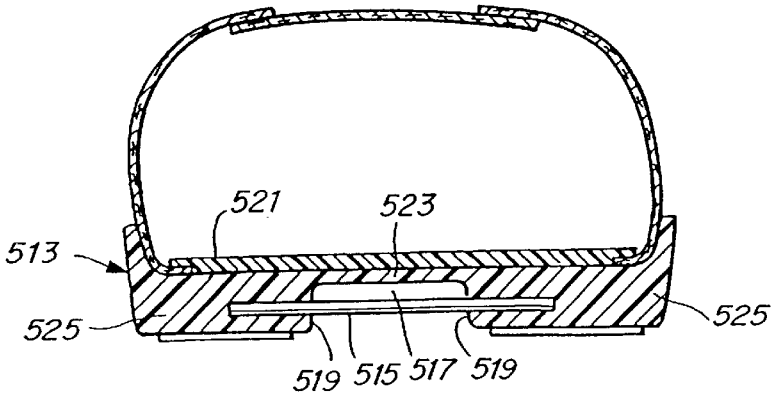
FIG. 35 is cross-sectional view, taken along line 35—35 of FIG. 34.

A first illustrative embodiment for the mating feature on the boot is shown in FIGS. 34–35. FIG. 34 is a bottom view of a boot sole 513 that includes a mating member 515 that is disposed in an opening or recess 517 in the sole. In this embodiment of the invention, the mating member 515 is a steel bar that is circular in cross-section. The bar 515 can be embedded in the outer sole 525 of the boot (which may be rubber or any other suitable material) by disposing the bar 515 in a mold and then injecting the material for the outer sole 525 into the mold around the bar 515. In one embodiment of the invention, the recess 517 is sized to have a width that is approximately equal to that of the forward engagement member 61 (FIG. 3) with which it is designed to mate, with some slight clearance provided for an accumulation of snow. Thus, engagement between the front engagement member 61 and sidewalls 519 of the boot recess advantageously prevents the front of the boot from shifting from side-to-side when riding.

FIG. 35 is a cross-sectional view taken along line 35—35 of FIG. 34. In the embodiment of the invention shown in FIG. 35, a support member or shank 521 is disposed in the sole of the boot above the recess 517. The support member 521 stiffens the sole in the area above the recess, so that the sole does not sink down into the recess 517 under the rider's weight. The shank 521 can be in the form of an insole extending across the entire sole of the boot from the heel to toe. The shank can for example, be formed from nylon at a thickness of approximately 2 mm, which is not sufficiently stiff to impact the ability of the rider to walk in the boot, but which achieves the desired goal of preventing the sole in the area above the recess from sinking. Alternatively, the shank can extend across the full boot sole and have a reduced thickness in areas other than that above the recess 517, or can just be provided in that area.

Although the support member 521 provides the advantage discussed above, it is not necessary to practice the invention. Other techniques for ensuring that the sole does not sink down into the recess 517 can also be employed. For example, as is discussed more fully below, the strapless forward engagement member can be provided with a geometry that matches that of the recess 517, such that the upper portion of the forward engagement member can sit flush against the top of the recess 517, thereby supporting the boot sole in the area above the recess and preventing it from sinking into the recess when riding. The provision of a strapless engagement member having a geometry matching that of the recess 517 obviously provides no support for the recess 517 when the rider is not engaged in the binding and is walking about. However, support is much less critical at this time, because the forces generated on the recess 517 when walking are not nearly as great as those experienced when riding. Thus, the rigidity of the thinned out outer sole region 523 in the area above the recess should be sufficient to prevent the sole from sinking into the recess when walking. In this respect, the outer sole can be thinned in the region 523 to approximately one mm, whereas the remainder of the outer sole 525 will have a more normal thickness ranging anywhere from 2–16 mm.

Figure 36:
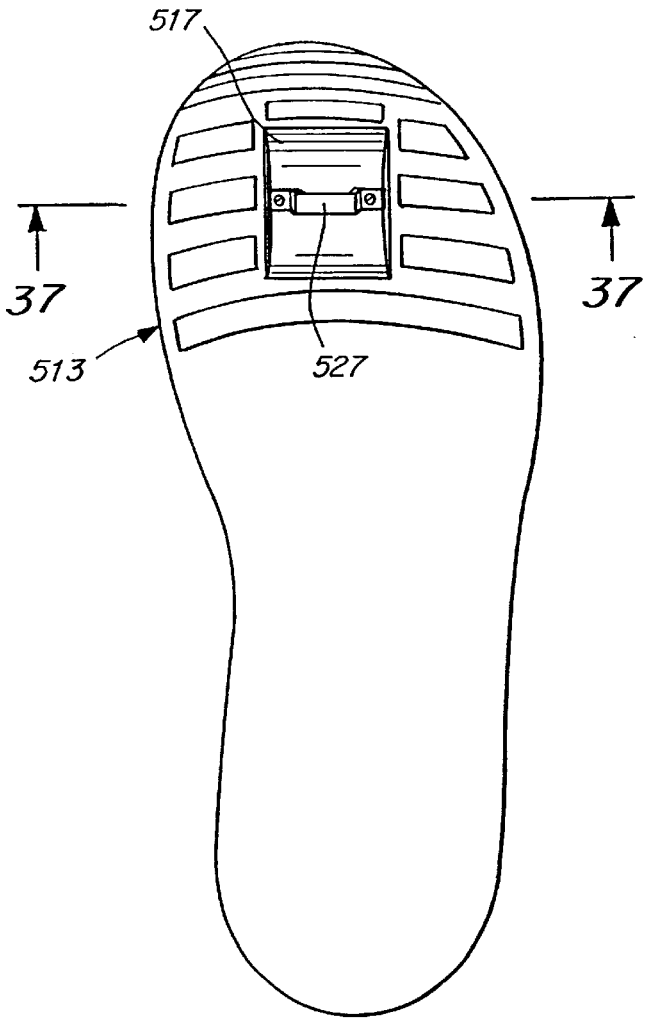
FIG. 36 is a bottom schematic representation of an alternate boot with an engagement member for engaging with a toe hook locking mechanism.
Figure 37:
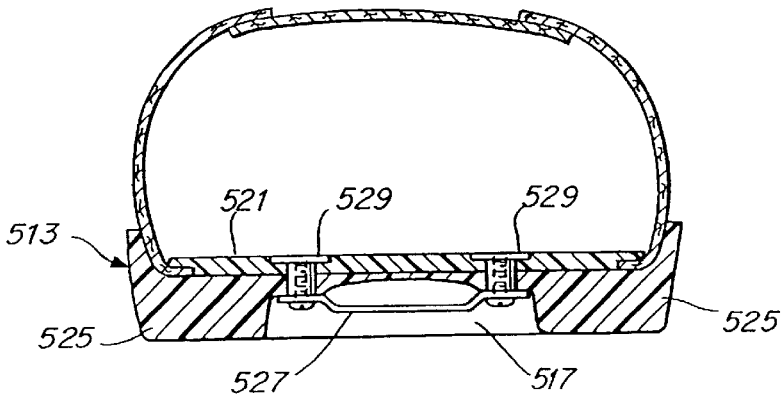
FIG. 37 is a cross-sectional view taken along line 37—37 of FIG. 36.

An alternate embodiment of the mating feature in the boot sole is shown in FIGS. 36–37, wherein a flat bar 527 is attached to the sole of the boot in the recess 517. As shown in the cross-sectional view of FIG. 37 (taken along line 37—37 of FIG. 36), this embodiment of the invention also employs a shank 521 in the sole of the boot to provide the stiffening feature discussed above. However, unlike the embodiment of FIGS. 34–35, the bar that forms the mating member 527 is not embedded in the sole, but rather, is attached to the shank 521 via a pair of screws and T-nuts 529. As should be appreciated from the two embodiments described above, the mating feature attached to the sole of the boot need not have any particular shape. It can be a bar that is round in cross-section, a flat strip, or any other shape that enables the mating feature to engage with a corresponding strapless engagement member on the binding to hold down the forward portion of the boot when riding. For example, the mating feature need not be in the shape of a single bar, and can include two or more hooks for engaging with a corresponding strapless engagement member on the binding. Alternatively, the arrangement can be reversed so that the strapless engagement member on the binding can be a bar, and the mating feature on the boot can be in the form of a rear or forward facing hook. The present invention is not limited to any specific implementation.

As seen from the cross-sectional views of FIGS. 35 and 37, in one illustrative embodiment of the present invention, the mating feature attached to the sole of the boot does not extend below the outer boot sole 525, and therefore does not impact the feel of the boot when the rider walks. It should be appreciated that in general, the lower the mating member extends, the easier it is for the rider to engage with the strapless engagement member on the binding. Thus, for the embodiments of the present invention wherein the mating member is implemented as a metal piece, it is desired to have the mating member extend just slightly above the bottom of the outer sole 525, such that the metal piece does not touch the ground when the rider walks. However, as discussed below, the mating member need not be formed from a metal piece, and can alternatively be formed from any of the materials discussed above as being suitable for use in forming the strapless forward engagement member, e.g., glass filled nylon, rubber or polyurethane. When formed from a non-metallic material, the mating feature on the boot sole can extend down to the point where it is flush with the bottom surface of the outer sole, such that it extends as low as possible to facilitate engagement with the binding without being noticeable to the rider when walking.

Figure 38:
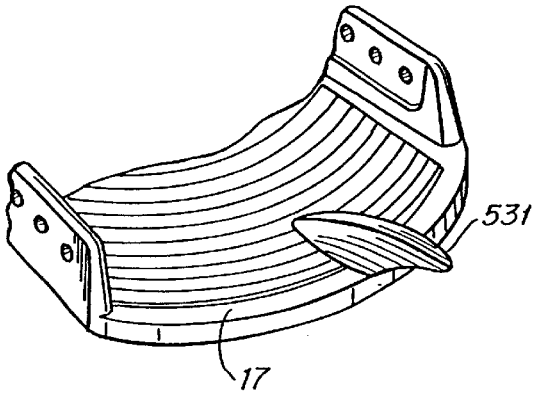
FIG. 38 is a partially broken away perspective representation of a binding including a sculpted toe hook.
Figure 39:
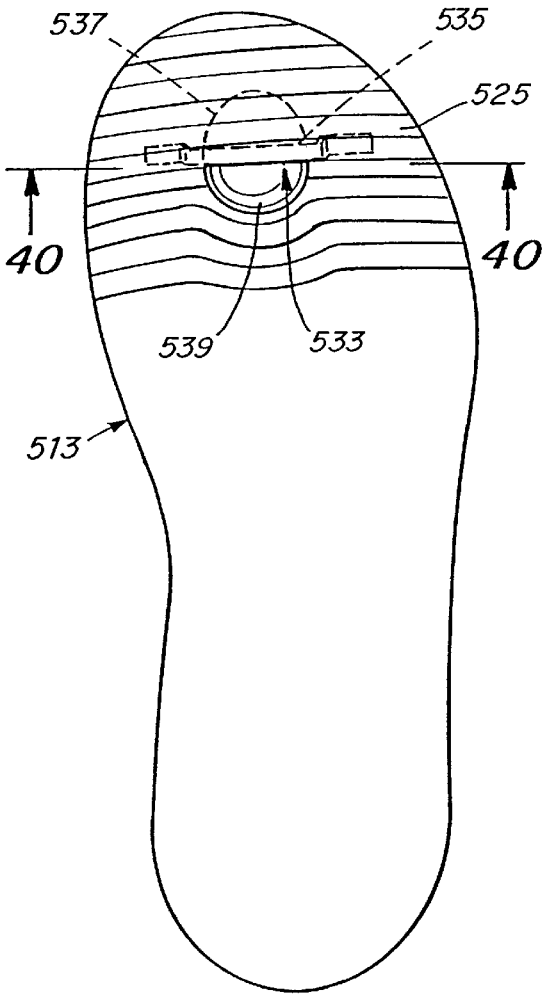
FIG. 39 is a bottom schematic representation of a boot including an engagement feature for mating with the sculpted toe hook of FIG. 38.
Figure 40:
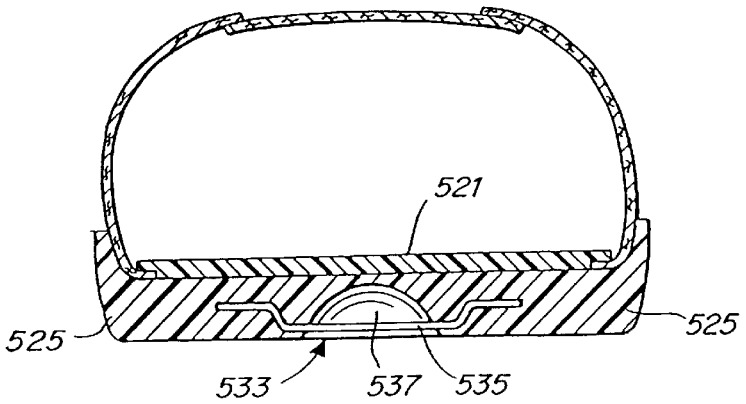
FIG. 40 is a cross-sectional view taken along line 40—40 of FIG. 39.

An alternate arrangement of a strapless engagement member for mounting to the binding and a corresponding mating feature in the boot sole is described making reference to FIGS. 38–40. FIG. 38 is a partial schematic view of the base plate 17 showing a strapless engagement member 531 that is in the form of a sculpted toe hook. The toe hook 531 can be formed integrally with the base plate 17 in a single injection molding process and positioned in the same manner as the strapless members discussed above. Alternatively, the toe hook 531 can be formed separately from the base plate 17 to enable adjustment in the position of the toe hook 531 along the length of the binding, in much the same manner as the other embodiments discussed above.

FIGS. 39–40 illustrate a boot sole 513 that includes a mating feature 533 that is adapted to engage with the sculpted toe hook 531 of FIG. 38. In this embodiment of the invention, a support member 535 is disposed within the outer boot sole 525 (as shown in the cross-sectional view of FIG. 40, which is taken along line 40—40 of FIG. 39) and is not exposed by a recess in the outer boot sole 525. Rather, the mating feature 533 includes an opening in the sole defined by a hollowed out cavity 537, including a rear-facing mouth 539, that is adapted to receive the sculpted toe hook 531. The support member 535 is disposed below the cavity 537 and is adapted to support the outer sole 525 below the area wherein it is engaged by the sculpted toe hook 531. In addition, the boot sole may include a support member or shank 521 to prevent the sole from sinking in the area above the cavity 537 in much the same manner as the embodiments described above.

It should be understood that the support member 535 can be disposed within the outer boot sole 525 in the same manner as that described above in connection with the bar 515 in FIGS. 34–35. For example, the support member 535 can be disposed in a mold for forming the outer boot sole 525 and be embedded therein when the outer sole material 525 is injected into the mold about the support member 535.

In one illustrative embodiment of the invention, the dimensions of the cavity 537 are selected to match those of the sculpted toe hook 531, such that when the toe hook is inserted into the cavity, the toe hook substantially fills the cavity, allowing some slight clearance for an accumulation of snow. In this manner, when the rider steps onto the binding and engages the toe hook 531 within the cavity 537, the toe hook supports the upper surface of the cavity to prevent it from sinking under the weight of the rider. Thus, in this embodiment of the invention, the shank 521 can optionally be eliminated.

Figure 43:
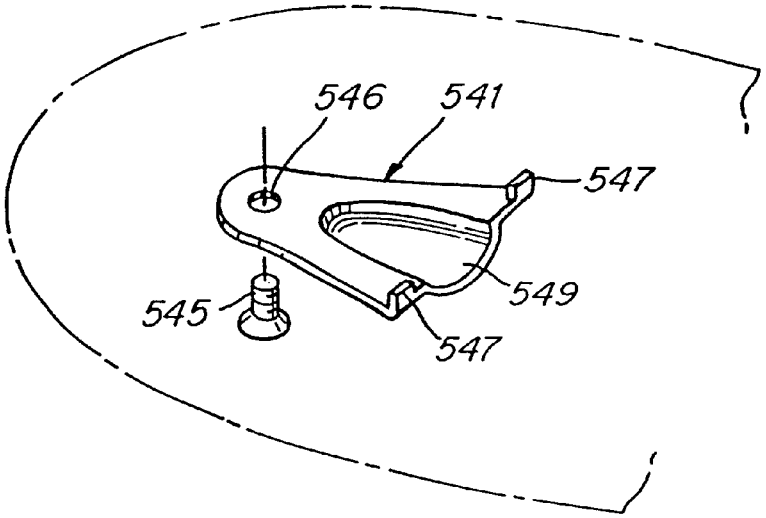
FIG. 43 is a schematic representation of an alternate implementation of an engagement member compatible with a sculpted toe hook such as the one shown in FIG. 38.
Figure 44:
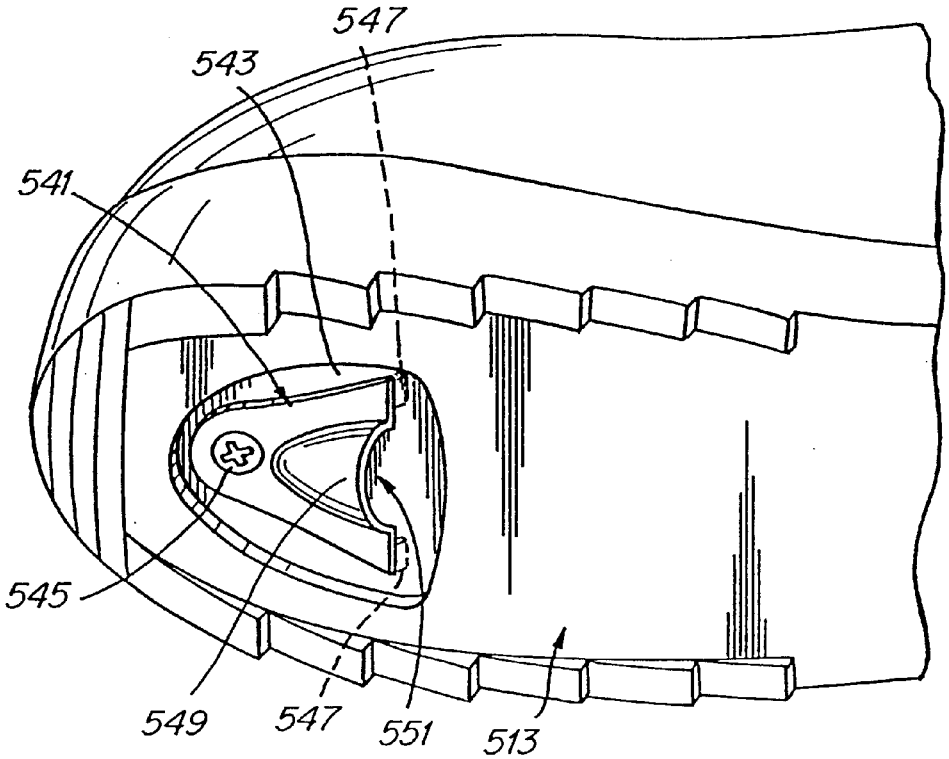
FIG. 44 is a bottom perspective view of the engagement member of FIG. 43 mounted to the sole of a snowboard boot.

FIGS. 43–44 illustrate an alternate embodiment of a boot sole mating feature 541 for engagement with a toe hook such as hook 531 shown in FIG. 38. The mating feature 541 is disposed within a recess 543 disposed in the boot sole 513, so that the mating feature 541 does not extend below the bottom of the boot sole 513, and therefore, does not impact the feel of the boot when the rider walks. The mating feature 541 is attached to the bottom of the boot sole via a fastener, such as a screw 545 that passes through an opening 546 in the mating feature and is received in a T-nut (not shown) in the boot sole. The mating feature 541 also includes a pair of tabs 547 that are adapted to be received in recessed portions (not shown) in the boot sole recess 543. The tabs 547 serve to prevent the mating feature 541 from rotating about the screw 545 during riding.

The mating feature 541 has a recessed top surface 549 that, when the mating feature 541 is attached to the boot sole recess 543, defines a cavity between the recessed surface 549 and a portion of the sole that defines the boot sole recess 543. The cavity has an opening 551 and is configured to receive a toe hook (such as the hook 531 shown in FIG. 38) in much the same manner as the cavity 537 (FIGS. 39–40) described above.

The mating feature 541 shown in FIGS. 43–44 is advantageous in that it is detachable from the boot sole 513. Although attached to the boot sole via a single screw 545 in the embodiment shown in the figures, it should be understood that the invention is not limited in this respect. The detachable mating feature 541 can alternatively be attached to the boot sole with multiple screws, or with any of a number of other types of fasteners.

It should be understood that in addition to holding down the front portion of the boot, the toe strap in conventional strap bindings also provides downward pressure on the toes of the rider, providing a feel that many riders have become accustomed to. Thus, in one embodiment of the present invention, some mechanism is provided for providing comparable toe pressure in conjunction with the bindings of the present invention, which eliminate the use of the toe strap. This mechanism can, for example, include a boot that employs a dual lace system, with one set of laces controlling the manner in which the boot is tightened above the toe area, and the other set of laces controlling the tightening of the remainder of the boot. In this manner, the rider can tighten down the lacing in the toe area more than the remainder of the boot, to provide the desired toe pressure. Alternatively, a buckle and strap can be provided along the boot overlying the toe area, and can be used to tighten down the boot over the toes, thereby providing the desired toe pressure. It should be understood that the present invention is not limited to either of these particular implementations, or even to the providing of some mechanism to increase toe pressure.

As should be appreciated from the foregoing, the various illustrative embodiments of the boot in accordance with the present invention do not employ a large metal plate that is attached to the boot sole as in many conventional strapless bindings, and are as comfortable to walk in as traditional boots employed with strap bindings. In this respect, the above-described boots in accordance with the present invention can be used not only with a binding having a strapless forward engagement member or engagement interface in accordance with the present invention, but can also be used in conjunction with a conventional strap binding.

Figure 41:
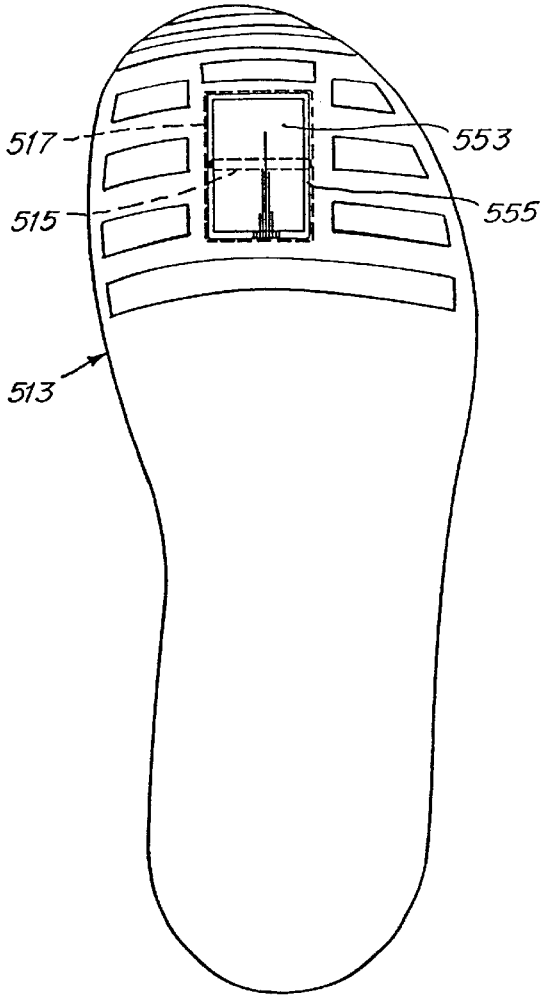
FIG. 41 is a bottom schematic representation of a boot including an engagement member for engaging with a toe hook locking mechanism, and a plug covering the engagement member.

In accordance with one illustrative embodiment of the invention shown in FIG. 41, the boot includes a plug 553 that covers the boot recess and binding mating feature (e.g., recess 517 and rod 515 in the embodiment of FIGS. 34–35), so that those features of the boot are not exposed to snow, dirt, and the like when the boot is to be employed with a strap binding. In the illustrative example shown in FIG. 41, the plug 553 is shown in connection with a boot of the type shown in FIGS. 34–35, with the rod 515 being shown in phantom as it is covered by the plug 553. It should be understood that any of the other embodiments of a boot in accordance with the present invention can also include a plug such as 553.

The plug 553 can be formed from the same material (e.g., rubber) as the outer sole of the boot, and can be formed integrally therewith. The border 555 of the plug 553 can be provided with a reduced thickness, thereby facilitating removal of the plug when the rider desires to expose the mating member (e.g., the rod 515 in FIG. 34) for use with a binding having a strapless engagement member in accordance with the present invention. The border 555 is provided with a thickness (e.g., 0.5–1 mm) that is relatively thin in comparison to the portion of the outer sole 525 that surrounds the border and the remainder of the patch 553. Thus, the border 555 will tear relatively easily so that the rider can remove the patch 553 by simply grasping it with a pair of pliers and pulling to separate the patch along the border 555, or by carefully using a knife or other sharp instrument to cut the patch at the border. The patch 553 can be provided with a visual indicator identifying the border 555 to facilitate removal of the patch.

Figure 42:
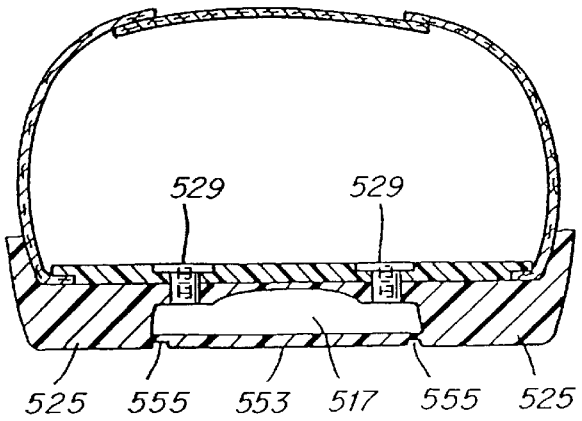
FIG. 42 is a cross-sectional view showing a snowboard boot with a patch covering a recess in which an engagement member for a toe hook latching mechanism can be installed.

In contrast with the embodiment of FIG. 41, wherein the boot is provided with the mating feature (e.g., 515) underlying the patch, in another illustrative embodiment of the invention shown in FIG. 42, the mating feature is not disposed under the patch 553. Rather, removal of the patch 553 reveals a mounting feature that is adapted to mount the mating feature within the boot recess. In the illustrative example shown in FIG. 42, the mounting feature includes a pair of T-nuts 529 as discussed above in connection with the embodiment of FIG. 37. Thus, when the plug 553 is removed, the rider can insert the mating member (e.g., the bar 527 in the embodiment of FIGS. 36–37) into the boot recess, and attach the mating member to the exposed mounting feature. For example, the bar 527 can be attached to the T-nuts 529 with a pair of screws in the manner described above in connection with FIGS. 36–37. Thus, when the boot shown in FIG. 42 is used in connection with a strap binding, the boot advantageously does not have the mating member attached thereto. Rather, it is only after the rider decides to employ the boot with a binding including a strapless engagement member that the patch 553 is removed, and the mating member is attached to the boot sole.

It should be understood that the particular mounting features 529 shown in the illustrative embodiment of FIG. 42 are provided merely for illustrative purposes. Other arrangements are possible. For example a single T-nut 529 can be employed, as well as any other mounting feature compatible with a similar or different type of mating feature. In this respect, the rider can use a single pair of boots to adapt with a strap binding and with multiple types of bindings having different strapless engagement members by switching between different mating features to be compatible with the different types of strapless engagement members.

In the embodiment of the invention shown in FIG. 42, the mounting features 529 are arranged to accommodate the mounting of the mating feature in a single position. However, it should be appreciated that the boot can be provided with multiple mounting features that are arranged to mount the mating feature in two or more spaced locations, thereby providing the rider with some control over the precise positioning of the mating feature.

In the embodiments described above, it is contemplated that the patch 553 would be disposable, and not reattachable to the boot sole, such that once the rider decides to switch from a boot having a conventional sole for operation with a strap binding to one that is adapted to mate with a binding including a strapless engagement member, the patch would not be reattached. However, in another embodiment of the invention, it is contemplated that the patch 553 be reattachable to the boot sole after its removal. This can be done in any number of ways. For example, the patch can include a pair of screw holes adapted to receive screws for engagement into the mounting feature in the sole that receives the binding engagement member (e.g., T-nuts 529 shown in FIG. 42) to releasably engage the patch to the boot sole. Alternatively, the inner surface of the patch can include a pair of protrusions that are sized to fit within the T-nuts 529, such that the patch can be press-fitted into engagement therewith. In addition, the boot sole can be provided with a dedicated mounting feature, separate from that employed to mount the binding mating feature, to mount the reattachable patch to the sole. Thus, a reattachable patch can be used to cover not only the opening in the sole of the boot, but also the binding mating feature mounted therein. These particular implementations are provided merely for illustrative purposes, and it should be understood that the present invention is not limited to these or any other particular implementation of a reattachable patch.

Figure 45:
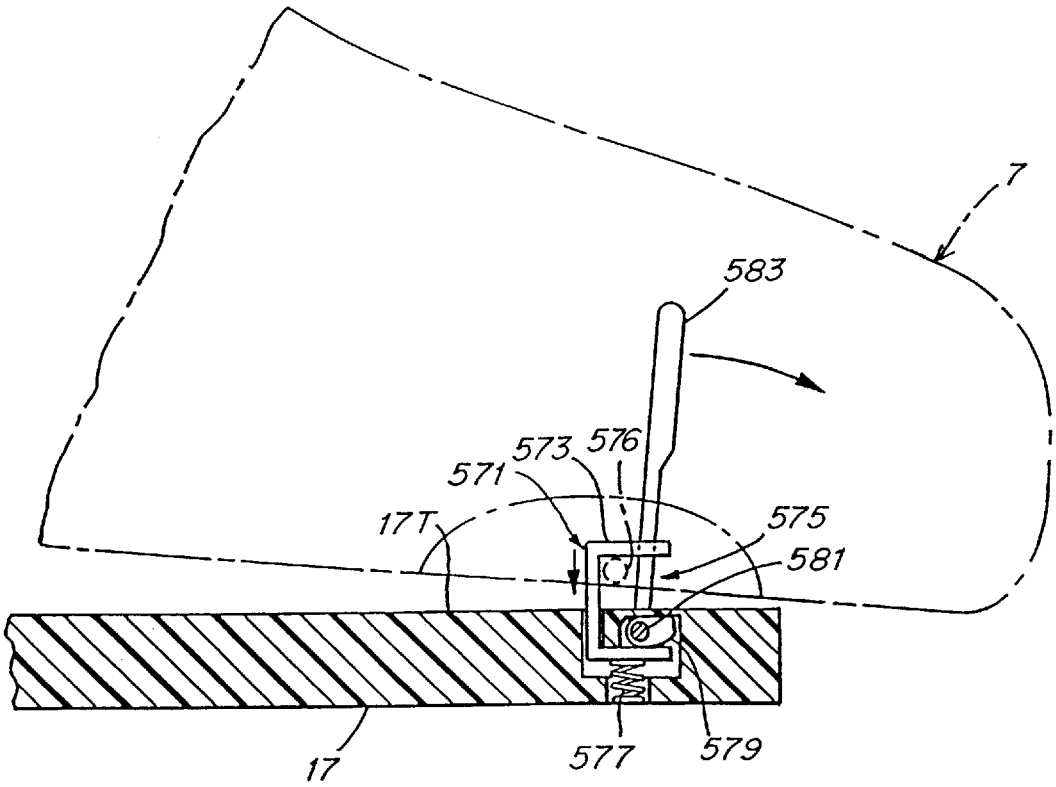
FIG. 45 is a side schematic representation of an alternate embodiment of an active toe hook in the open position.
Figure 46:
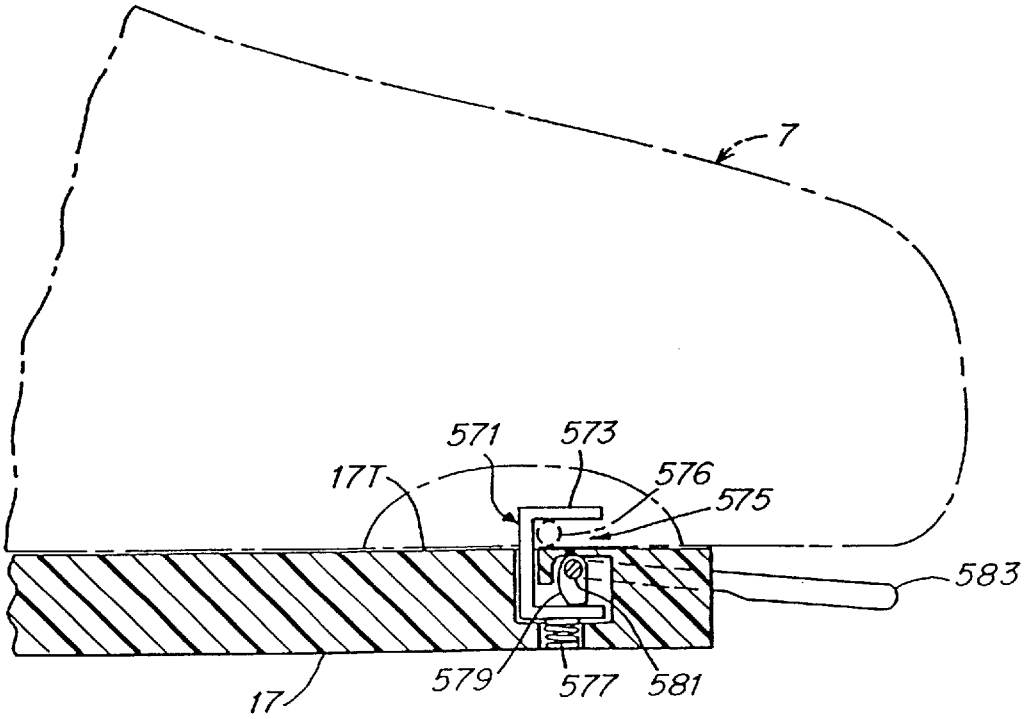
FIG. 46 is a side schematic representation of the active locking mechanism of FIG. 45 in the closed position.

An alternate embodiment of the strapless engagement member is disclosed in FIGS. 45–46. In this embodiment of the invention, the strapless engagement member 571 includes a hook portion 573 that is similar in many respects to the hook embodiments of the invention discussed above. However, in the embodiment of the invention shown in FIGS. 45–46, the engagement member 571 is active (i.e., has a movable portion), so that the opening 575 between the hook portion 573 and a top surface 17T of the base plate 17 can be altered from a larger opening size when the strapless engagement member is in the open position shown in FIG. 45, to a smaller size when the engagement member 571 is in the closed position shown in FIG. 46. Thus, the strapless engagement member 571 has an open position wherein it is relatively easy for the rider to engage and disengage, and a closed position wherein the hook portion 573 snugly engages the boot mating feature 576 (which can be implemented in any of a number of ways as discussed above) to tightly hold down the boot when riding.

The active strapless engagement member 571 can be implemented in any of a number of ways, and the present invention is not limited to the particular implementation shown in FIGS. 45–46, which is provided merely for illustrative purposes. In the particular implementation shown in the figures, the strapless engagement member 571 is biased upwardly via a biasing element (e.g., a spring) 577. A cam 579 is mounted to the baseplate 17 for rotation about a pivot axis defined by a rod 581 extending across the baseplate 17. A lever 583 is attached to one end of the rod 581 and can be used by the rider to rotate the shaft 581, and consequently the cam 579 attached thereto. When the lever is rotated downwardly from the open position shown in FIG. 45 to the closed position shown in FIG. 46, the engagement between the cam 579 and the engagement member 571 causes the hook portion 573 to be pulled downwardly to the position shown in FIG. 46, wherein the boot mating feature 576 is tightly held between the hook portion 573 and the top surface 17T of the baseplate. To open the strapless engagement member at the end of a ride, the lever 583 is simply rotated in the reverse direction to the position shown in FIG. 45.

As mentioned above, the concept of the present invention related to the active strapless engagement member for actively engaging the boot mating feature is not limited to the particular implementation shown in the figures, as numerous other implementations are possible. All that is necessary is that some portion of the strapless engagement member be moveable between an open position that facilitates engagement with the boot mating feature, and a closed position wherein the boot mating feature is firmly held down.

Although the particular mating features of the boot and the patch disclosed for use therewith have been described above for use in connection with the types of bindings disclosed in this application, it should be understood that these aspects of the present invention are also not so limited, and that these features of the present invention can be employed with other types of bindings.

As mentioned above, the strapless forward engagement member in accordance with the present invention can be implemented in any number of ways. Although the illustrative embodiments of the invention shown in the drawings each employs a strapless engagement member in the form of a hook, the present invention is not limited to these or any other particular implementations. Any arrangement that enables the boot to be held down while still experiencing lateral foot roll can be employed, including arrangements that do not employ a hook on either the boot or binding.

As discussed above, some embodiments of the present invention are directed to a binding system including a rear engagement mechanism for holding down the heel of the snowboard boot, and an active forward engagement mechanism for holding down the toe end of the boot. Each of the rear and forward engagement mechanisms may include a lever to move the engagement mechanism between its open and closed positions. In accordance with one illustrative embodiment of the present invention, a binding is provided with active rear and forward engagement mechanisms that are linked to a single lever for manipulating both engagement mechanisms.

The above-described aspects of the present invention relating to step-in snowboard bindings are advantageous because they provide for convenient entry into and exit from the binding. However, in one embodiment of the present invention, any of the above-described step-in bindings can also be provided with apertures (e.g., in the sidewalls of the baseplate) similar to those provided in conventional tray bindings to enable one or more straps to be mounted to the binding so that the binding can be used in the same manner as a tray binding. For example, the binding 301 of FIG. 15 can be employed without the interface 201, such that the rear latching mechanism would not be employed to hold down the heel of the boot. Rather, an ankle strap could be mounted to the sidewall 307 to serve this purpose. Similar, engagement mechanism 407 could be replaced by a toe strap. This feature of the present invention provides the rider with the option of converting the binding 301 into a tray binding. It should be appreciated that this aspect of the present invention is not limited to use with the bindings described herein, and can be employed with any step-in or other binding that does not employ straps to engage the boot to the binding.

It should be appreciated that different aspects of the present invention are directed to all aspects of a snowboard boot and binding system, including aspects directed to a unique step-in binding, unique boot configurations, a unique interface system for interfacing a snowboard boot to a binding, aspects relating to a rear binding latching mechanism, and aspects relating to numerous strapless forward engagement systems for engaging a snowboard boot to a binding or interface. Although numerous of these aspects of the present invention are advantageously employed together in accordance with the illustrative embodiments of the invention shown in the drawings, the present invention is not limited in this respect, as each of these aspects of the present invention can also be employed separately. For example, the binding aspects of the present invention can be employed to directly engage a snowboard boot, rather than engaging a snowboard boot through the use of a separate interface, and can be employed separately. For example, any of the rear latching aspects of the present invention can be employed with any of the forward latching aspects of the invention, or any other forward latching mechanism. Likewise, any of the forward latching aspects of the invention can be employed with any type of rear latching mechanism, including some not disclosed herein. Similarly, the interface aspects of the present invention can be employed with numerous types of bindings, and are not limited to use with the illustrative embodiments disclosed herein.

Having just described several illustrative embodiments of the invention, various alterations, modifications and improvements will readily occur to those skilled in the art. Such alterations, modifications and improvements are intended to be in the spirit and scope of the invention. Accordingly, the foregoing description is by way of example only and is not intended as limiting. The invention is limited only as defined in the following claims and the equivalence thereto.

What is claimed is:

1. A system for mounting a rider to a snowboard, the system comprising:

a snowboard boot to receive a foot of the rider, the snowboard boot including an outer sole having a heel area, an arch area and a toe area;

a snowboard binding to be mounted to the snowboard; and an interface having at least one mating feature adapted to be releasably engaged by the snowboard binding, the interface further including at least one strap adapted to mount the interface to the snowboard boot;

wherein the outer sole of the snowboard boot includes a recess rearward of the arch area that is adapted to receive the interface so that the interface does not protrude below the outer sole when the interface is mounted to the snowboard boot, and wherein the interface has a forward edge that terminates rearward of a midline of the snowboard boot when the interface is mounted to the snowboard boot so that the interface does not underlie any portion of the snowboard boot forward of the midline.

2. The system of claim 1, wherein the snowboard binding is a step-in binding that includes at least one strapless engagement member adapted to releasably engage the at least one mating feature on the interface.

3. The system of claim 1, wherein the snowboard binding includes a high-back.

4. The system of claim 1, wherein the outer sole includes a bottom surface, and wherein the interface includes a bottom surface that sits flush with the bottom surface of the outer sole of the snowboard boot when the interface is mounted in the recess in the outer sole.

5. The system of claim 4, wherein the at least one mating feature on the interface includes at least one engagement pin that extends outwardly from medial and lateral sides of the interface.

6. The system of claim 5, wherein the at least one engagement pin is circular in cross-section.

7. The system of claim 1, wherein the snowboard binding includes at least one forward strapless engagement member, and the snowboard boot includes at least one strapless mating feature adapted to engage with the at least one forward strapless engagement member on the binding to hold down a toe end of the boot during riding.

8. The system of claim 7, wherein at least one of the at least one forward strapless engagement member on the binding and the at least one strapless mating feature on the snowboard boot is an active engagement component that is automatically movable between an engagement position and a release position in response to the rider stepping into and out of the binding.

9. The system of claim 1, wherein the snowboard boot has a recess periphery that defines the recess, wherein the recess periphery includes a first mating feature, and wherein the interface includes a second mating feature that is adapted to mate with the first mating feature to automatically maintain alignment of the interface within the recess during riding.

10. The system of claim 9, wherein the at least one mating feature on the interface includes at least one engagement pin that extends outwardly from medial and lateral sides of the interface.

11. The system of claim 10, wherein the at least one engagement pin is circular in cross-section.

12. The system of claim 1, wherein the interface includes a pair of sidewalls adapted to extend upwardly along the medial and lateral sides of the snowboard boot, the pair of sidewalls having the strap mounted thereto.

13. The system of claim 12, wherein each of the pair of sidewalls is sufficiently rigid to resist wrapping around the snowboard boot when the interface is mounted to the snowboard boot and subjected to forces exerted by the snowboard boot during riding.

14. The system of claim 13, wherein each of the pair of rigid sidewalls is adapted to terminate below a section of the snowboard boot corresponding to the ankle bone of the rider.

15. The system of claim 12, wherein each of the pair of sidewalls is adapted to terminate below a section of the snowboard boot corresponding to the ankle bone of the rider.

16. The system of claim 12, wherein the interface further includes a heel counter that is adapted to extend between the pair of sidewalls behind a heel of the boot.

17. The system of claim 16, wherein the heel counter and the pair of sidewalls are formed as a single integral component.

18. The system of claim 16, wherein the heel counter is arranged to not extend above the ankle bone of the rider.

19. The system of claim 1, wherein the at least one mating feature on the interface includes at least one engagement pin that extends outwardly from medial and lateral sides of the interface.

20. The system of claim 19, wherein the at least one engagement pin is circular in cross-section.

21. An interface for use in a system for mounting a rider to a snowboard, the system comprising a snowboard binding to be mounted to the snowboard, a snowboard boot, and the interface, the interface comprising:

a body having at least one mating feature adapted to be releasably engaged by the snowboard binding, the body further including a base that is adapted to pass under a sole of the snowboard boot, the base having a non-planar contoured upper surface that is adapted to fit within a recess in the sole of the snowboard boot the base having a forward edge that is configured to terminate rearward of a midline of the snowboard boot when the base is placed within the recess so that the base does not underlie any portion of the snowboard boot forward of the midline; and at least one strap, supported by the body, adapted to mount the interface to the snowboard boot.

22. The interface of claim 21, wherein the interface is constructed and arranged to be disposed in the recess disposed rearward of an arch area of the sole.

23. The interface of claim 21, wherein the base includes a bottom surface that is adapted to sit flush with a bottom of the sole of the snowboard boot when the interface is mounted in the recess in the sole of the snowboard boot.

24. The interface of claim 21, wherein the interface includes a second mating feature that is adapted to mate with a first mating feature provided on a periphery that defines the recess in the sole of the snowboard boot to automatically maintain alignment of the interface within the recess during riding.

25. The interface of claim 21, wherein the at least one mating feature includes at least one engagement pin that extends outwardly from medial and lateral sides of the interface.

26. The interface of claim 25, wherein the at least one engagement pin is circular in cross-section.

27. The interface of claim 21, wherein the interface includes a second mating feature that is adapted to mate with a first mating feature provided on a periphery that defines the recess in the sole of the snowboard boot to automatically maintain alignment of the interface between medial and lateral sides of the recess during riding.

28. The interface of claim 27, wherein the second mating feature is adapted to mate with the first mating feature provided on the periphery to automatically maintain alignment of the interface between toe and heel ends of the recess during riding.

29. The interface of claim 21, wherein the interface includes a second mating feature that is adapted to mate with a first mating feature provided on a periphery that defines the recess in the sole of the snowboard boot to automatically maintain alignment of the interface between toe and heel ends of the recess during riding.

30. The interface of claim 21, further including a tread disposed on a bottom surface of the base.

31. The interface of claim 21, in combination with the snowboard boot.

32. The combination of claim 31, further in combination with the binding.

33. The interface of claim 21, in combination with the binding.

34. An interface for use in a system for mounting a rider to a snowboard the system comprising a snowboard binding to be mounted to the snowboard, a snowboard boot having medial and lateral sides and including a sole with a heel and a recess disposed in the heel, and the interface, the interface comprising:

a body having at least one mating feature adapted to be releasably engaged by the snowboard binding, the body including a base that is adapted to pass under the sole of the snowboard boot, the base having a non-planar contoured upper surface that is adapted to fit within the recess in the heel of the snowboard boot, the body further including a pair of sidewalls adapted to extend, from the base, upwardly along the medial and lateral sides of the snowboard boot, each of the pair of sidewalls adapted to terminate below a section of the snowboard boot corresponding to the ankle bone of the rider, and at least one strap mounted to the pair of sidewalls that is adapted to mount the interface to the snowboard boot.

35. The interface of claim 34, wherein each of the pair of sidewalls is sufficiently rigid to resist wrapping around the snowboard boot when the interface is mounted to the snowboard boot and subjected to forces exerted by the snowboard boot during riding.

36. The interface of claim 34, wherein the body further includes a heel counter that is adapted to extend between the pair of sidewalls behind the heel of the boot.

37. The interface of claim 36, wherein the body is formed as a single integral component.

38. The interface of claim 36, wherein the heel counter is arranged to not extend above the ankle bone of the rider.

39. The interface of claim 36, wherein the heel counter is arranged at an angle with respect to the pair of sidewalls that is ninety degrees or less.

40. The interface of claim 39, wherein the angle is approximately ninety degrees.

41. The interface of claim 34, wherein the body further includes a pair of trusses adapted to extend between the base and the pair of sidewalls to increase resistance of the pair of sidewalls to bending.

42. A system for mounting a rider to a snowboard, the system comprising:

a snowboard binding to be mounted to the snowboard, the snowboard binding including at least one forward strapless engagement member;

a snowboard boot to receive a foot of the rider, the snowboard boot including at least one strapless mating feature adapted to engage with the at least one forward strapless engagement member on the binding to hold down a toe end of the boot during riding; and an interface having at least one strap adapted to mount the interface to the snowboard boot, the interface further including at least one mating feature adapted to be releasably engaged by the snowboard binding, the at least one mating feature including at least one engagement pin that extends outwardly from medial and lateral sides of the interface and is circular in cross-section, at least one of the at least one forward strapless engagement member on the binding and the at least one strapless mating feature on the snowboard boot being an active engagement component that is automatically movable between an engagement position and a release position in response to the rider stepping into and out of the binding.

43. The system of claim 42, wherein the snowboard binding includes a high-back.

44. The system of claim 42, wherein the snowboard boot includes a toe portion and a heel portion, the at least one engagement pin including an engagement portion adapted to be engaged by the snowboard binding, the engagement portion extending outwardly in a direction that is substantially transverse to a toe-to-heel direction of the snowboard boot.

45. The system of claim 42, wherein the at least one engagement pin includes a single pin extending outwardly from each of the medial and lateral sides of the interface.

46. An interface for engaging a snowboard boot to a snowboard binding, the interface comprising:

a body having at least one mating feature adapted to be releasably engaged by the snowboard binding, the at least one mating feature including at least one engagement pin that extends outwardly from medial and lateral sides of the interface and is circular in cross-section;

the body further including a pair of sidewalls adapted to extend upwardly along medial and lateral sides of the snowboard boot, wherein each of the pair of sidewalls is sufficiently rigid to resist wrapping around the snowboard boot when the interface is mounted to the snowboard boot and subjected to forces exerted by the snowboard boot during riding;

the body further including a base that is adapted to pass under the sole of the snowboard boot and a pair of trusses that extends between the base and the pair of sidewalls to increase resistance of the pair of sidewalls to bending; and at least one strap, mounted to the pair of sidewalls of the body, adapted to mount the interface to the snowboard boot.

47. The interface of claim 46, wherein the body includes a bottom surface that is adapted to sit flush with a sole of the snowboard boot when the interface is mounted in a recess provided in the sole.

48. The interface of claim 47, wherein the interface includes a second mating feature that is adapted to mate with a first mating feature provided on a periphery that defines the recess in the sole of the snowboard boot to automatically maintain alignment of the interface within the recess during riding.

49. The interface of claim 46, wherein each of the pair of rigid sidewalls is adapted to terminate below a section of the snowboard boot corresponding to the ankle bone of the rider.

50. The interface of claim 46, in combination with the snowboard boot.

51. The combination of claim 50, further in combination with the binding.

52. The interface of claim 46, wherein the body extends in a medial-to-lateral direction so as to extend across a width portion of the sole of the snowboard boot in the medial-to-lateral direction, the at least one engagement pin including an engagement portion adapted to be engaged by the snowboard binding, the engagement portion extending outwardly from the body in the medial-to-lateral direction.

53. The interface of claim 46, wherein the at least one engagement pin includes a single pin extending outwardly from each of the medial and lateral sides of the interface.

54. A system for mounting a rider to a snowboard, the system comprising:

a snowboard boot to receive a foot of the rider, the snowboard boot including a sole having a recess;

a snowboard binding to be mounted to the snowboard; and an interface having;

a body including a base that is adapted to pass under the sole of the snowboard boot, the base having a non-planar contoured upper surface that is adapted to fit within the recess in the sole of the snowboard boot;

at least one mating feature that is supported by the body and is adapted to be releasably engaged by the snowboard binding; and at least one strap that is supported by the body and is adapted to mount the interface to the snowboard boot;

wherein the recess has a bottom-facing non-planar contoured surface that corresponds to the non-planar contoured upper surface of the interface to enable the sole of the boot to roll laterally relative to the interface while automatically maintaining alignment between the interface and the recess during riding.

55. The system of claim 54, wherein the recess in the sole of the snowboard boot is disposed rearward of an arch area of the sole.

56. The system of claim 54, wherein the base includes a bottom surface that is adapted to sit flush with the sole of the snowboard boot when the interface is mounted in the recess in the sole of the snowboard boot.

57. The system of claim 54, wherein the bottom-facing non-planar contoured surface of the recess includes a first mating feature, and wherein the interface includes a second mating feature that is adapted to mate with the first mating feature to automatically maintain alignment of the interface within the recess during riding.

58. The system of claim 57, wherein the first mating feature and the second mating feature are adapted to automatically maintain alignment of the interface between medial and lateral sides of the recess during riding.

59. The system of claim 58, wherein the first mating feature and the second mating feature are adapted to automatically maintain alignment of the interface between toe and heel ends of the recess during riding.

60. The system of claim 57, wherein the first mating feature and the second mating feature are adapted to automatically maintain alignment of the interface between toe and heel ends of the recess during riding.

61. A system for mounting a rider to a snowboard, the system comprising:

a snowboard boot to receive a foot of the rider, the snowboard boot including a sole having a recess with a bottom-facing non-planar contoured surface;

a snowboard binding to be mounted to the snowboard; and an interface having;

a body including a base that is adapted to pass under the sole of the snowboard boot, the base having a non-planar contoured upper surface that is adapted to fit within the recess in the sole of the snowboard boot, the bottom-facing non-planar contoured surface of the recess and the non-planar contoured upper surface of the base being configured with complimentary mating features that are adapted to prevent shifting of the interface relative to the sole of the snowboard boot in a side-to-side direction during riding;

at least one mating feature that is supported by the body and is adapted to be releasably engaged by the snowboard binding; and at least one strap that is supported by the body and is adapted to mount the interface to the snowboard boot.

62. The system of claim 61, wherein the non-planar contoured upper surface of the interface is adapted to mate with the bottom-facing non-planar contoured surface the recess in the sole of the snowboard boot to automatically maintain alignment of the interface within the recess during riding.

63. The system of claim 62, wherein the non-planar contoured upper surface of the interface and the bottom-facing non-planar contoured surface of the recess are adapted to automatically maintain alignment of the interface between toe and heel ends of the recess during riding.

64. The system of claim 61, wherein the recess in the sole of the snowboard boot is disposed rearward of an arch area of the sole.

65. The system of claim 61, wherein the base includes a bottom surface that is adapted to sit flush with the sole of the snowboard boot when the interface is mounted in the recess in the sole of the snowboard boot.

66. The system of claim 61, wherein the body further includes a pair of sidewalls adapted to extend, from the base, upwardly along medial and lateral sides of the snowboard boot, each of the pair of sidewalls adapted to terminate below a section of the snowboard boot corresponding to the ankle bone of the rider.

67. A system for mounting a rider to a snowboard, the system comprising:

a snowboard boot to receive a foot of the rider, the snowboard boot including a toe portion, an arch portion rearward of the toe portion and a heel portion rearward of the arch portion;

a snowboard binding to be mounted to the snowboard; and an interface having at least one strap adapted to mount the interface to the snowboard boot, the interface further including at least one mating feature adapted to be releasably engaged by the snowboard binding, the at least one mating feature including at least one engagement pin that extends outwardly from medial and lateral sides of the interface and is circular in cross-section, the interface being constructed and arranged to be mounted to the heel portion of the snowboard boot.

* * * * *